US007487032B2

(12) United States Patent
Nakagawa et al.

(10) Patent No.: US 7,487,032 B2
(45) Date of Patent: Feb. 3, 2009

(54) ENGINE CONTROL SYSTEM

(75) Inventors: Shinji Nakagawa, Hitachinaka (JP); Shinya Satou, Hitachinaka (JP); Mamoru Nemoto, Hitachiohta (JP)

(73) Assignee: Hitachi, Ltd., Tokyo (JP)

( * ) Notice: Subject to any disclaimer, the term of this patent is extended or adjusted under 35 U.S.C. 154(b) by 462 days.

(21) Appl. No.: 11/317,201

(22) Filed: Dec. 27, 2005

(65) Prior Publication Data

US 2006/0142924 A1 Jun. 29, 2006

(30) Foreign Application Priority Data

Dec. 27, 2004 (JP) ..... 2004-376007

(51) Int. Cl.
*F02D 45/00* (2006.01)

(52) U.S. Cl. ..... 701/110; 701/114; 701/115

(58) Field of Classification Search ..... 701/110, 701/114, 102, 115, 51, 69, 89; 73/117.3; 477/35

See application file for complete search history.

(56) References Cited

U.S. PATENT DOCUMENTS 5,020,391 A * 6/1991 Aoki et al. ..... 477/143
5,119,304 A * 6/1992 Seki ..... 73/114.15
5,996,547 A * 12/1999 Machida et al. ..... 123/295
6,580,994 B2 * 6/2003 Katayama et al. ..... 701/69

FOREIGN PATENT DOCUMENTS

| | | |
|---|---|---|
| DE | 10305092 A1 | 8/2004 |
| JP | 2-133242 A | 5/1990 |
| JP | 10-82719 A | 3/1998 |
| JP | 2002-332897 | 11/2002 |

OTHER PUBLICATIONS

Japanese Office Action.
Chinese Office Action issued Jan. 4, 2008.

* cited by examiner

*Primary Examiner*—Hieu T Vo
(74) *Attorney, Agent, or Firm*—Crowell & Moring LLP

(57) ABSTRACT

An engine control system, which is adaptable for individual differences among engines, changes with time, environmental changes, etc., and which can control engine torque with high accuracy and high response. The engine control system comprises a unit for detecting engine torque in at least one of direct and indirect manners, a unit for computing an engine control parameter, and a unit for modifying the engine control parameter based on the detected torque detected by the engine torque detecting unit.

40 Claims, 48 Drawing Sheets

$$G_air(Z) = \frac{b_air0 - b_air1Z^{-1} - b_air2Z^{-2} - \cdots - b_airmZ^{-m}}{1 - a_air1Z^{-1} - a_air2Z^{-2} - \cdots - a_airnZ^{-n}}$$

$$G_adv(Z) = \frac{b_adv0 - b_adv1Z^{-1} - b_adv2Z^{-2} - \cdots - b_advmZ^{-m}}{1 - a_adv1Z^{-1} - a_adv2Z^{-2} - \cdots - a_advnZ^{-n}}$$

$$G_af(Z) = \frac{b_af0 - b_af1Z^{-1} - b_af2Z^{-2} - \cdots - b_afmZ^{-m}}{1 - a_af1Z^{-1} - a_af2Z^{-2} - \cdots - a_afnZ^{-n}}$$

$$G_air_2(Z) = \frac{b2_air0 - b2_air1Z^{-1} - b2_air2Z^{-2} - \cdots - b2_airmZ^{-m}}{1 - a2_air1Z^{-1} - a2_air2Z^{-2} - \cdots - a2_airnZ^{-n}}$$

ENGINE CONTROL SYSTEM

BACKGROUND OF THE INVENTION

1. Field of the Invention

The present invention relates to a control system for performing control of an engine, and more particularly to an engine control system capable of controlling torque of an onboard engine with high accuracy.

2. Description of the Related Art

Recently, there has been a demand for higher accuracy in engine torque control against the background of a trend toward electronic driving (so-called X By Wire) of engine peripheral equipment, hybrid driving of a vehicle in combination with a motor, and so on. Engine torque is controlled using, as main control inputs, an intake air amount (fuel supply amount depending on it), an air/fuel ratio (fuel supply amount depending on it), and ignition timing. Devices (such as an electronically controlled throttle valve, a fuel injection valve, and an ignition plug) for controlling the control inputs inevitably undergo variations in torque sensitivity with respect to the control inputs due to variations in initial performance caused by differences among engines (individual differences), variations caused by performance changes with time, variations caused by environmental changes, etc. Also, it is an actual situation that, even when indicated torque is highly accurately controlled by controlling the intake air amount, the air/fuel ratio, and the ignition timing with high accuracy, axial torque cannot be always controlled with the desired high accuracy because internal loss (torque) of the engine is decided depending on many factors.

On the other hand, an engine torque system includes a transfer characteristic (delay) in a conversion path from the main control inputs, i.e., the intake air amount, the air/fuel ratio, and the ignition timing, to the torque, i.e., a control variable. To realize a torque control system with good response, therefore, the torque control system has to be constructed in consideration of such a transmission characteristic (delay).

Thus, in order to realize the engine torque control with high accuracy, it is required to construct a torque control system having not only robustness against the variations caused by the individual differences, the changes with time, the environmental changes, and the internal loss, but also high response in consideration of the transmission characteristic (delay) in the engine torque system.

SUMMARY OF THE INVENTION

As one example, there has hitherto been proposed a torque control system comprising an F/F (feed forward) system based on a reverse transfer model of an intake air system from a throttle valve to a cylinder (combustion chamber), and an intake air amount F/B (feedback) system based on an airflow sensor (air flowmeter). In the proposed torque control system, high response is ensured with the F/F system based on the reverse transfer model of the intake air system, and robustness is ensured with the intake air amount F/B system based on the airflow sensor. The proposed torque control system is effective in increasing the accuracy of the intake air amount control, but it still accompanies the above-described problem. Namely, while the accuracy in control of the indicated torque is increased, the axial torque cannot be always controlled with the desired high accuracy due to the influence of internal loss even though the accuracy of the intake air amount control is increased.

Patent Document 1 (JP-A-10-82719) proposes a system for computing an opening (opening degree) command with a PI controller, which changes a P gain per operating condition, based on the difference between a torque sensor signal and a torque command. This system is effective in ensuring robustness because F/B control is performed in accordance with actual torque. However, as described above, the engine torque system includes the transfer characteristic (delay) in the conversion path from the main control inputs, i.e., the intake air amount, the air/fuel ratio, and the ignition timing, to the torque, i.e., a control variable. To realize the torque control system with good response, therefore, the torque control system has to be constructed in consideration of such a transmission characteristic (delay). In particular, the engine can be said as being essentially a dead time system from its specific mechanism. On the other hand, the proposed PI control system computes the control input (opening command) based on the detected torque. Accordingly, sufficiently high response cannot be obtained even when the proposed PI control system is applied to the engine torque system (i.e., the dead time system) in which the detected torque shows no response for a certain time.

Patent Document 2 (JP-A-2-133242) proposes an engine control system for controlling output torque of a torque converter so that the output torque approaches target torque. In this engine control system, the torque converter output torque is computed from the torque capacity coefficient and torque ratio of the torque converter and the engine revolution speed. Accordingly, the accuracy in detecting a response characteristic in the conversion path from the control inputs (i.e., the intake air amount, the air/fuel ratio, and the ignition timing) to the engine torque is deteriorated in a transient state of the engine operation due to the influence of a delay in the torque converter. For that reason, it is basic to detect steady performance. Further, even in detection of the steady performance, the detection inevitably contains certain steady errors with respect to indicated torque and axial torque of the engine because the torque converter is interposed midway the path.

In view of the state of the art mentioned above, an object of the present invention is to provide an engine control system, which is adaptable for individual differences among engines, changes with time, environmental changes, etc., and which can control engine torque with high accuracy and high response.

To achieve the above object, the present invention provides, as a first form, an engine control system comprising a unit for detecting engine torque in at least one of direct and indirect manners; a unit for computing an engine control parameter; and a unit for modifying the engine control parameter based on the detected torque detected by the engine torque detecting unit (see FIG. 1).

Stated another way, a unit for computing the engine control parameter (e.g., a target intake air amount, a target fuel supply amount or target ignition timing) related to the engine torque is provided (preferably, the unit executes parameter operations taking into account the transfer characteristic of an engine torque system), to thereby ensure high response. On the other hand, the engine torque is detected, and it is confirmed with an F/F system whether a desired torque characteristic is realized. A control parameter of the F/F system is then modified as appropriate.

Thus, by constructing a torque control system that is basically made of the F/F system in consideration of the transfer characteristic of the engine torque system and modifies the control parameter of the F/F system as appropriate, the torque control system having high response and high robustness is realized.

In a second form of the engine control system according to the present invention, the engine control system further comprises a unit for estimating engine torque; a unit for computing the engine control parameter based on the estimated torque estimated by the engine torque estimating unit; and a unit for modifying the engine control parameter and/or a parameter of the engine torque estimating unit based on the detected torque (see FIG. 2).

Stated another way, a unit for estimating or predicting engine torque is provided, and a control input for torque control (i.e., the engine control parameter) is decided based on the estimated (predicted) torque. Because the engine torque system has a large delay as described above, satisfactory performance cannot be obtained with actual time control based on the detected torque. For that reason, the torque estimating (predicting) unit is provided to execute pseudo F/B control.

In a third form of the engine control system according to the present invention, the engine torque detecting unit detects axial torque of an engine.

From the viewpoint of realizing higher performance of the engine torque control, it is advantageous that the detected torque is axial torque.

In a fourth form of the engine control system according to the present invention, the engine torque detecting unit is constituted as a torque sensor.

In a fifth form of the engine control system according to the present invention, the engine torque detecting unit indirectly detects the engine torque based on at least one of a fuel injection amount, an intake air amount, and ignition timing (see FIG. 3).

Stated another way, the engine torque is indirectly detected based on at least one of the fuel injection amount, the intake air amount, and the ignition timing, which are predominant factors deciding the engine torque and can be detected online.

In a sixth form of the engine control system according to the present invention, the engine torque detecting unit indirectly detects the engine torque based on at least one of a fuel injection amount, an intake air amount, ignition timing, and an engine revolution speed.

Stated another way, the engine torque is indirectly detected with higher accuracy by taking into account the engine revolution speed in addition to the parameters used in the fifth form.

In a seventh form of the engine control system according to the present invention, the engine torque detecting unit indirectly detects the engine torque based on an engine revolution speed during idling.

In an eighth form of the engine control system according to the present invention, the engine torque detecting unit detects indicated torque of an engine.

The idling means a state where the axial torque of the engine performs no work. Therefore, the indicated torque of the engine can be more accurately detected from the idling revolution speed.

In a ninth form of the engine control system according to the present invention, the engine torque detecting unit detects indicated torque and axial torque of an engine.

By detecting both the indicated torque and the axial torque, the torque control can be realized with higher accuracy.

In a tenth form of the engine control system according to the present invention, the engine torque detecting unit indirectly detects the indicated torque of the engine based on at least one of a fuel injection amount, an intake air amount, and ignition timing (see FIG. 4).

Stated another way, the indicated torque of the engine is indirectly detected based on at least one of the fuel injection amount, the intake air amount, and the ignition timing, which are predominant factors deciding the indicated torque of the engine and can be detected online.

In an eleventh form of the engine control system according to the present invention, the engine control system further comprises an internal loss torque estimating unit for estimating internal loss torque based on a difference between the indicated torque and the axial torque of the engine (see FIG. 5).

In a twelfth form of the engine control system according to the present invention, the engine control system further comprises a torque setting unit for setting the indicated torque resulting when the axial torque is 0, as balance torque representing a state where the axial torque performs no work under the relevant operating conditions (see FIG. 6).

By detecting both the indicated torque and the axial torque (ninth form), it is possible to obtain the balance torque representing the state where the axial torque performs no work under the relevant operating conditions.

In a thirteenth form of the engine control system according to the present invention, the engine torque estimating unit includes a transfer characteristic model from at least one of a fuel injection amount, an intake air amount, ignition timing, and an air/fuel ratio to indicated torque and/or axial torque of an engine (see FIG. 7).

As described above, the engine torque system has a delay (transfer characteristic). By including, in the engine torque estimating unit, a transfer characteristic (model) from at least one of the fuel injection amount, the intake air amount, the ignition timing, and the air/fuel ratio to the indicated torque and/or the axial torque of the engine, the engine torque can be estimated (predicted) with higher accuracy.

In a fourteenth form of the engine control system according to the present invention, the engine torque estimating unit includes a transfer characteristic model from the intake air amount to the torque under a condition of the air/fuel ratio being constant (see FIG. 8).

Stated another way, the engine torque estimating unit includes, for example, a transfer characteristic model from the intake air amount (fuel amount depending on it) to the torque under a condition of the stoichiometric air/fuel ratio being constant in order to clearly separate torque change (influence) related to the air/fuel ratio. This leads to an advantage of making easier a process for computing the control input (target air intake amount in this case).

In a fifteenth form of the engine control system according to the present invention, the engine torque estimating unit includes a transfer characteristic model up to the torque when the air/fuel ratio is changed (see FIG. 9).

By clearly separating torque change (influence) related to the air/fuel ratio as in the fourteenth embodiment, an advantage of making easier the process for computing the control input (target air/fuel ratio in this case) can be obtained.

In a sixteenth form of the engine control system according to the present invention, the engine torque estimating unit includes a transfer characteristic model up to the torque when the air/fuel ratio is changed with the air intake amount (see FIG. 10).

While the air/fuel ratio can be controlled with either the air amount or the fuel amount, a transfer characteristic from the intake air amount (throttle valve) to the torque differs from that from the fuel supply amount (fuel injection valve) to the torque. This sixteenth embodiment takes into consideration the case of controlling the air/fuel ratio with the intake air amount.

In a seventeenth form of the engine control system according to the present invention, the engine torque estimating unit includes a transfer characteristic model up to the torque when the air/fuel ratio is changed with fuel (see FIG. 11).

Similarly to the sixteenth embodiment, while the air/fuel ratio can be controlled with either the air amount or the fuel amount, a transfer characteristic from the intake air amount (throttle valve) to the torque differs from that from the fuel supply amount (fuel injection valve) to the torque. This seventeenth embodiment takes into consideration the case of controlling the air/fuel ratio with the fuel supply amount.

In an eighteenth form of the engine control system according to the present invention, the engine torque estimating unit includes a transfer characteristic model up to the torque when the ignition timing is changed (see FIG. 12).

By clearly separating torque change (influence) related to the ignition timing, an advantage of making easier the process for computing the control input (ignition timing in this case) can be obtained.

In a nineteenth form of the engine control system according to the present invention, the transfer characteristic model is expressed by a transfer function (see FIG. 13).

By expressing the torque transmission system with the transfer function, the torque transmission system can be more easily handled from a mathematical point of view, or can be more suitably adapted for onboard design.

In a twentieth form of the engine control system according to the present invention, the unit for modifying the parameter of the engine torque estimating unit modifies the parameter of the engine torque estimating unit based on the estimated torque estimated by the engine torque estimating unit and the detected torque detected by the engine torque detecting unit (see FIG. 14).

Stated another way, the accuracy (adaptability) of the engine torque estimating unit is increased onboard by comparing the estimated torque with the detected torque to determine accuracy of the estimated torque, and then modifying the parameter of a unit for estimating the estimated torque (i.e., the engine torque estimating unit) as appropriate.

In a twenty-first form of the engine control system according to the present invention, the unit for modifying the parameter of the engine torque estimating unit modifies the parameter such that a difference between the estimated torque estimated by the engine torque estimating unit and the detected torque detected by the engine torque detecting unit is reduced (see FIG. 15).

On the basis of the twentieth embodiment, more particularly, the parameter of the engine torque estimating unit is modified such that the difference between the estimated torque and the detected torque is reduced.

In a twenty-second form of the engine control system according to the present invention, the unit for modifying the parameter of the engine torque estimating unit computes a relationship between the ignition timing and torque sensitivity from a torque change amount with respect to an ignition timing change amount, and modifies the transfer characteristic up to the torque when the ignition timing is changed (see FIG. 16).

In the unit for modifying the parameter of the engine torque estimating unit, the advantage of making easier the process for computing the control input (ignition timing in this case) can also be obtained by clearly separating torque change (influence) related to the air/fuel ratio as described above.

In a twenty-third form of the engine control system according to the present invention, the unit for modifying the parameter of the engine torque estimating unit computes a relationship between the ignition timing and torque sensitivity from an intake air change amount with respect to an ignition timing change amount during idling, and modifies the transfer characteristic up to the torque when the ignition timing is changed (see FIG. 17).

As mentioned above, the idling means a state where the axial torque of the engine performs no work, and therefore the indicated torque of the engine can be more accurately detected from the idling revolution speed. When the ignition timing is changed in the idling state, the idling revolution speed is changed if the intake air amount, the fuel supply amount, and the air/fuel ratio are constant. Torque sensitivity with respect to the ignition timing can be indirectly detected from such a change of the idling revolution speed. Also, it is general that the intake air amount or the fuel supply amount is controlled (or changed) to keep the idling revolution speed constant. Accordingly, the torque sensitivity with respect to the ignition timing can be indirectly detected from a change of the intake air amount or the fuel supply amount resulting when the ignition timing is changed.

In a twenty-fourth form of the engine control system according to the present invention, the transfer characteristic up to the torque when the ignition timing is changed, which has been modified during idling, is applied to a state other than the idling.

It is known that change of the torque sensitivity with respect to the ignition timing is constant regardless of the operating region. Accordingly, the relationship between the torque sensitivity and the ignition timing, which has been detected during the idling, is also applicable to the state other than the idling.

In a twenty-fifth form of the engine control system according to the present invention, the unit for modifying the parameter of the engine torque estimating unit computes a relationship between the air/fuel ratio and torque sensitivity from a torque change amount with respect to an air/fuel ratio change amount, and modifies the transfer characteristic up to the torque when the ignition timing is changed (see FIG. 18).

In the unit for modifying the parameter of the engine torque estimating unit, the advantage of making easier the process for computing the control input (air/fuel ratio in this case) can also be obtained by clearly separating torque change (influence) related to the air/fuel ratio as described above.

In a twenty-sixth form of the engine control system according to the present invention, the unit for modifying the parameter of the engine torque estimating unit modifies a parameter of the transfer function (see FIG. 19).

When the torque transmission system is expressed using the transfer function to be adapted for onboard design as mentioned in the nineteenth embodiment, the parameter of the transfer function is subjected to onboard tuning.

In a twenty-seventh form of the engine control system according to the present invention, the unit for computing the engine control parameter computes the engine control parameter based on the estimated torque estimated by the engine torque estimating unit and the detected torque detected by the engine torque detecting unit (see FIG. 20).

Similarly to the twentieth embodiment, the accuracy (adaptability) of the torque control is increased by comparing the estimated torque with the detected torque to determine the accuracy of the estimated torque, and then computing the engine control parameter based on the accuracy of the estimated torque.

In a twenty-eighth form of the engine control system according to the present invention, the unit for computing the engine control parameter computes the engine control parameter such that a difference between the estimated torque estimated by the engine torque estimating unit and the detected torque detected by the engine torque detecting unit is reduced (see FIG. 21).

On the basis of the twenty-seventh embodiment, more particularly, the engine control parameter is computed such that the difference between the estimated torque and the detected torque is reduced.

In a twenty-ninth form of the engine control system according to the present invention, the engine control system further comprises a target engine torque computing unit for computing target torque, wherein the unit for computing the engine control parameter computes the engine control parameter based on the estimated torque estimated by the engine torque estimating unit and the target torque (see FIG. 22).

The accuracy (adaptability) of the torque control is increased by comparing the target torque with the detected torque to determine the accuracy of the torque control, and then computing the engine control parameter based on the accuracy of the torque control.

In a thirtieth form of the engine control system according to the present invention, the engine control parameter is modified based on the estimated torque estimated by the engine torque estimating unit and the detected torque detected by the engine torque detecting unit (see FIG. 23).

The accuracy (adaptability) of the torque control is increased by comparing the estimated torque with the detected torque to determine the accuracy of the torque control, and then computing the engine control parameter based on the accuracy of the torque control.

In a thirty-first form of the engine control system according to the present invention, the unit for computing the engine control parameter computes the engine control parameter such that a difference between the estimated torque estimated by the engine torque estimating unit and the target torque is reduced (see FIG. 24).

On the basis of the twenty-ninth embodiment, more particularly, the engine control parameter is computed such that the difference between the estimated torque and the target torque is reduced.

In a thirty-second form of the engine control system according to the present invention, the unit for computing the engine control parameter includes an inverse transfer characteristic model from the engine torque to at least one of a fuel injection amount, an intake air amount, and ignition timing, and computes, based on the inverse transfer characteristic model, at least one of a target fuel injection amount, a target intake air amount, and target ignition timing for realizing the target torque (see FIG. 25).

When the control input (such as the fuel injection amount, the intake air amount, and ignition timing) for realizing the desired torque is computed, the control input canceling a torque response characteristics can be computed by deciding each control input based on an inverse transfer characteristic from the torque to the control input. As a result, torque response is improved. This thirty-second embodiment is intended for such an improvement of the torque response.

In a thirty-third form of the engine control system according to the present invention, the unit for computing the engine control parameter includes the inverse transfer characteristic model from the engine torque to at least one of the fuel injection amount, the intake air amount, and the ignition timing, and modifies parameter of the inverse transfer characteristic model based on the estimated torque estimated by the engine torque estimating unit and the detected torque detected by the engine torque detecting unit (see FIG. 26).

Each control input is decided based on the inverse transfer characteristic from the torque to the control input as in the thirty-second embodiment. In addition, by modifying the inverse transfer characteristic as appropriate based on the estimated torque and the detected torque, the torque control with higher accuracy is realized.

In a thirty-fourth form of the engine control system according to the present invention, the unit for computing the engine control parameter includes the inverse transfer characteristic model from the engine torque to at least one of the fuel injection amount, the intake air amount, and the ignition timing, and modifies a parameter of the inverse transfer characteristic model such that a difference between the estimated torque estimated by the engine torque estimating unit and the detected torque detected by the engine torque detecting unit is reduced (see FIG. 27).

On the basis of the thirty-third embodiment, more particularly, the parameter of the reverse transfer characteristic is computed such that the difference between the estimated torque and the detected torque is reduced.

In a thirty-fifth form of the engine control system according to the present invention, the unit for computing the engine control parameter includes the inverse transfer characteristic model from the engine torque to at least one of the fuel injection amount, the intake air amount, and the ignition timing, and modifies a parameter of the inverse transfer characteristic model based on the target torque and the detected torque detected by the engine torque detecting unit (see FIG. 28).

Each control input is decided based on the inverse transfer characteristic from the torque to the control input as in the thirty-second embodiment. In addition, by modifying the inverse transfer characteristic as appropriate based on the target torque and the detected torque, the torque control with higher accuracy is realized.

In a thirty-sixth form of the engine control system according to the present invention, the unit for computing the engine control parameter includes the inverse transfer characteristic model from the engine torque to at least one of the fuel injection amount, the intake air amount, and the ignition timing, and modifies a parameter of the inverse transfer characteristic model such that a difference between the target torque and the detected torque detected by the engine torque detecting unit is reduced (see FIG. 29).

In a thirty-seventh form of the engine control system according to the present invention, the target engine torque computing unit computes the target torque based on an accelerator opening and/or torque demanded from a driving system (see FIG. 30).

Stated another way, the accelerator opening and/or the torque demanded from the driving system is used as an important factor in deciding the engine target torque.

In a thirty-eighth form of the engine control system according to the present invention, the engine control system further comprises a unit for computing efficiency and/or fuel consumption of an engine based on a fuel injection amount and the detected torque (see FIG. 31).

Once the fuel supply amount and the detected torque are both known, it is possible to compute the engine efficiency and hence to calculate the fuel consumption.

In a thirty-ninth form of the engine control system according to the present invention, the unit for computing efficiency and/or fuel consumption computes an engine output from the detected axial torque and an engine revolution speed during a predetermined period, computes a total fuel supply amount during the predetermined period, and computes the efficiency and/or the fuel consumption based on a relationship between the engine output and the total fuel supply amount (see FIG. 32).

On the basis of the thirty-seventh embodiment, the engine output is computed from the detected axial torque and the engine revolution speed during the predetermined period, and the efficiency and/or the fuel consumption during the predetermined period is computed.

In addition, the present invention also provides an automobile equipped with an engine to which an engine control system for executing the torque control, as described above, is applied.

According to the present invention, the engine control is detected or estimated in at least one of direct and indirect manners, and the engine control input, i.e., at least one of the engine control parameters such as the intake air amount, the fuel injection amount and the ignition timing, is controlled so that the desired torque is realized. Therefore, the engine control system of the present invention is adaptable for individual differences among engines, changes with time, environmental changes, etc., and can control the engine torque with high accuracy and high response.

DESCRIPTION OF THE PREFERRED EMBODIMENTS

Embodiments of the present invention will be described below with reference to the drawings.

First Embodiment

Figure 1:
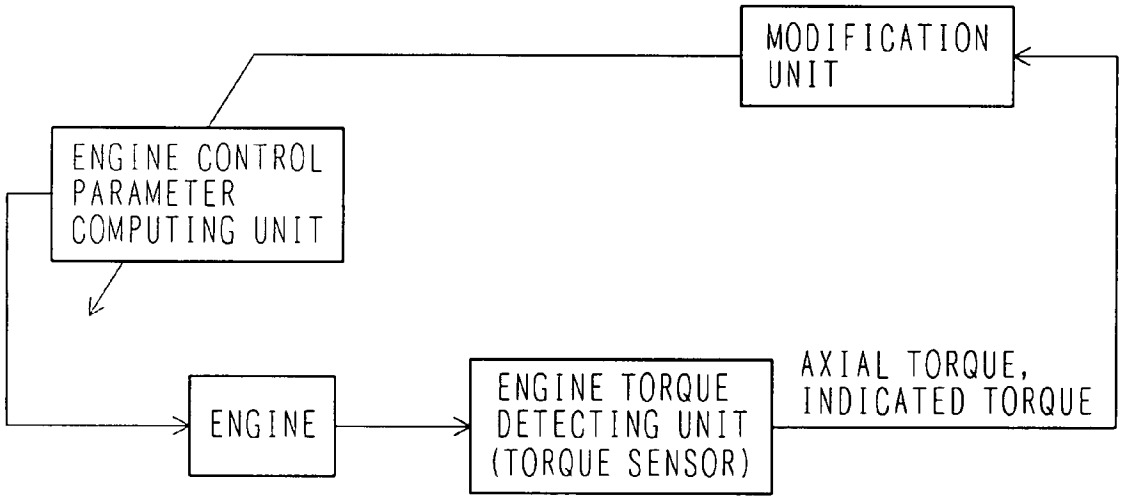
FIG. 1 is a block diagram for explaining a first form of an engine control system according to the present invention.
Figure 2:
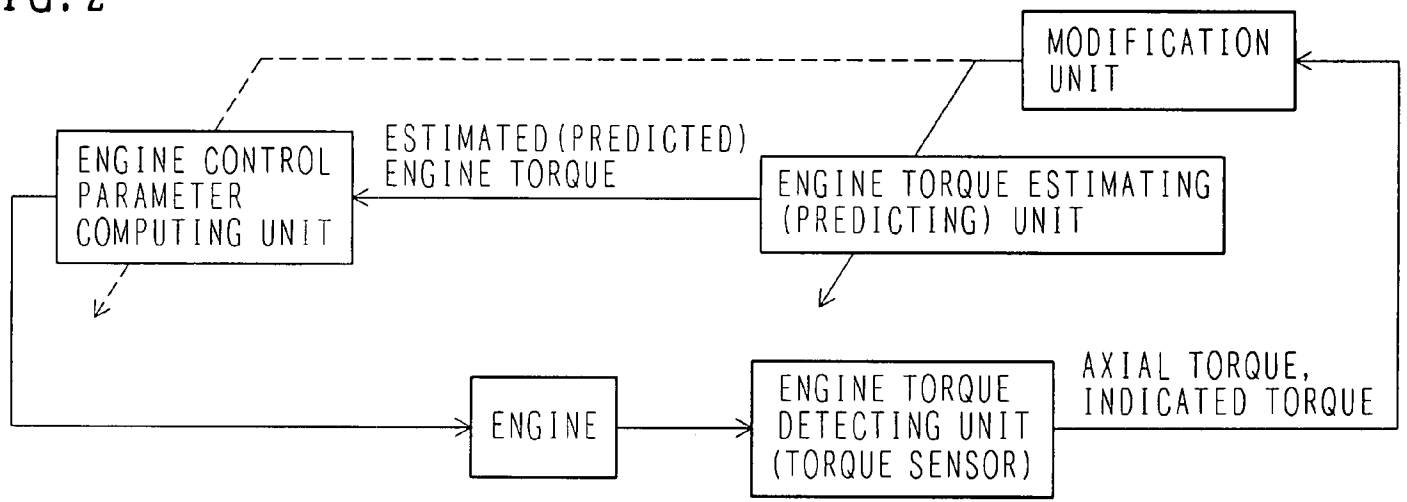
FIG. 2 is a block diagram for explaining a second form of the engine control system according to the present invention.
Figure 3:
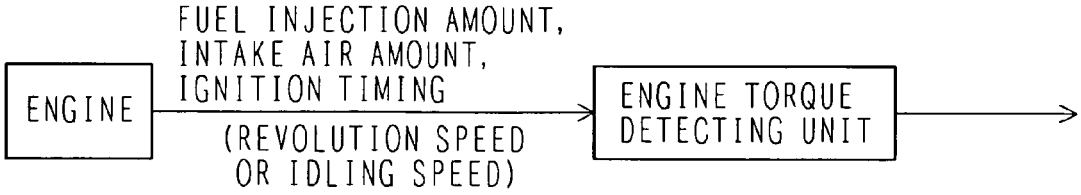
FIG. 3 is a block diagram for explaining a fifth form of the engine control system according to the present invention.
Figure 4:
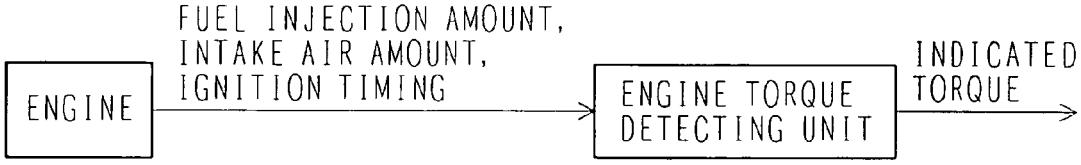
FIG. 4 is a block diagram for explaining a tenth form of the engine control system according to the present invention.
Figure 5:
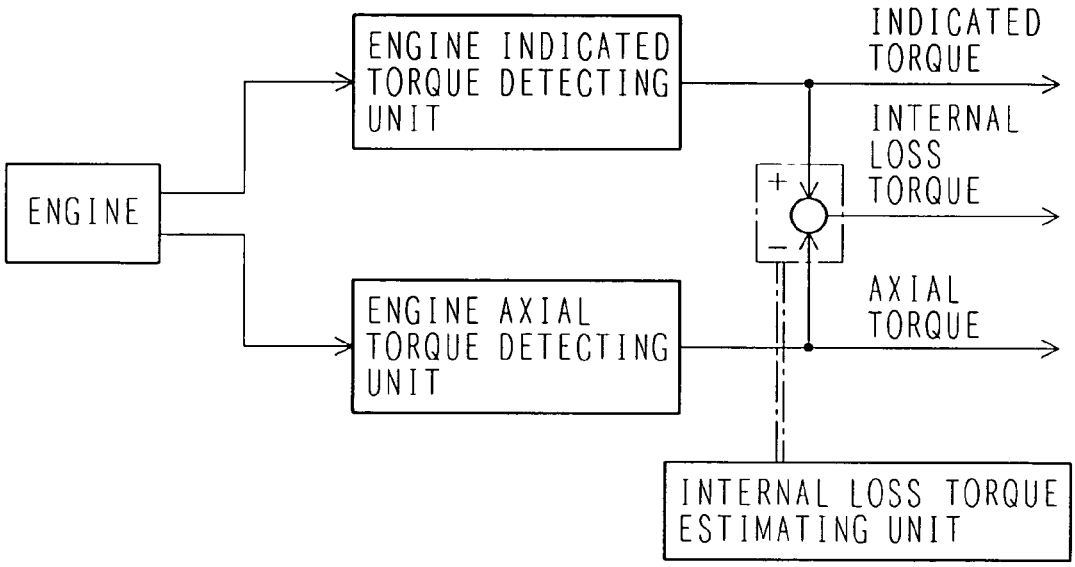
FIG. 5 is a block diagram for explaining an eleventh form of the engine control system according to the present invention.
Figure 6:
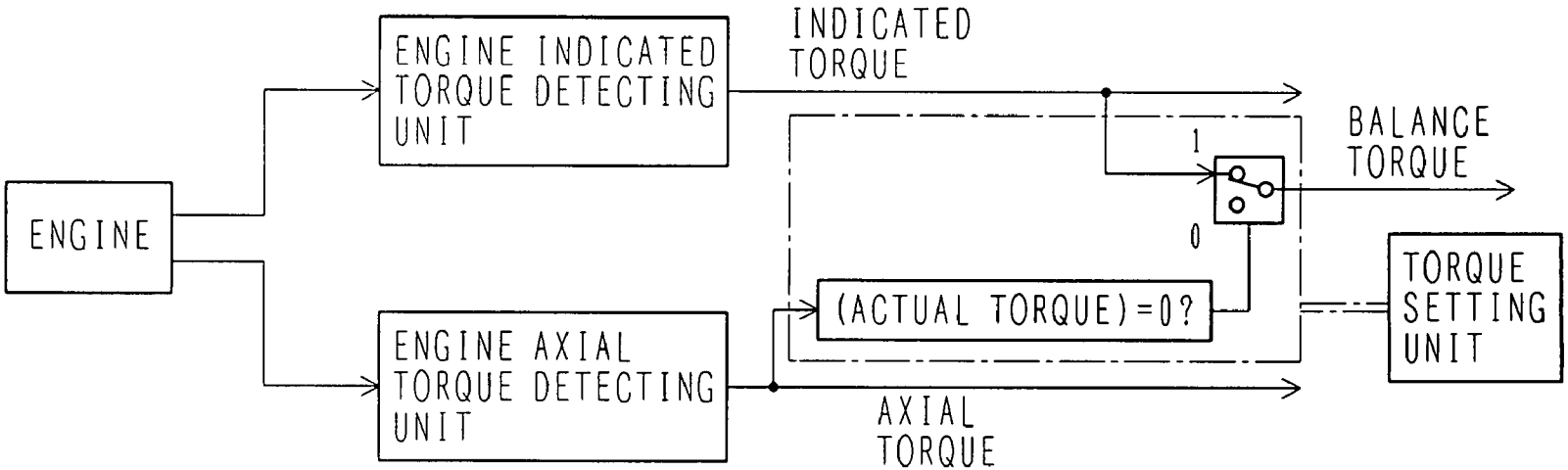
FIG. 6 is a block diagram for explaining a twelfth form of the engine control system according to the present invention.
Figure 7:
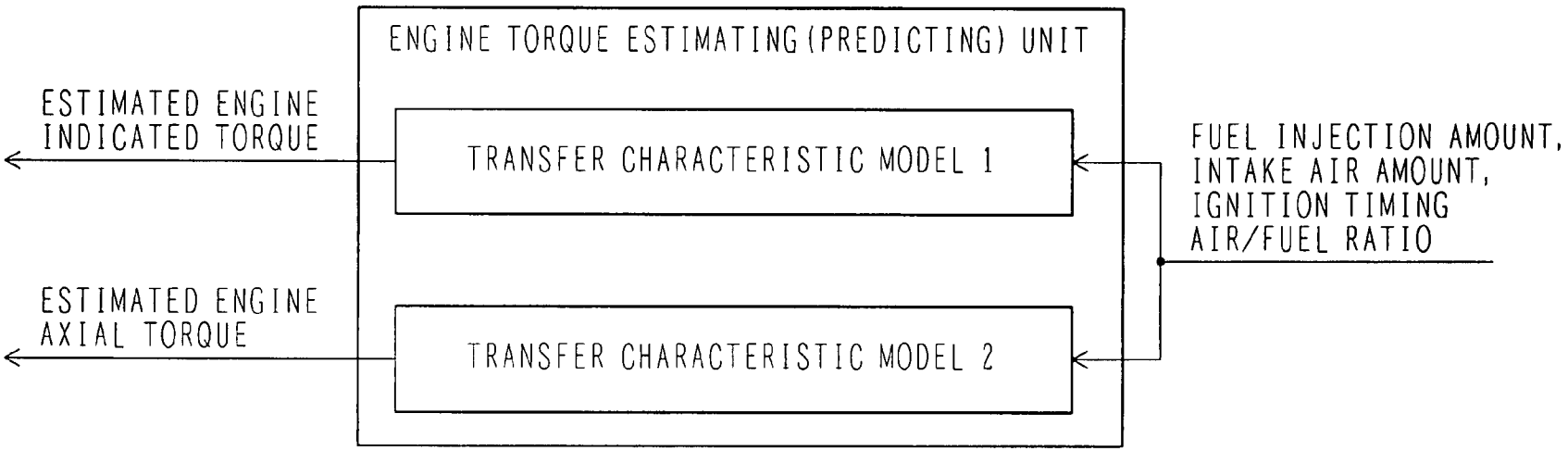
FIG. 7 is a block diagram for explaining a thirteenth form of the engine control system according to the present invention.
Figure 8:
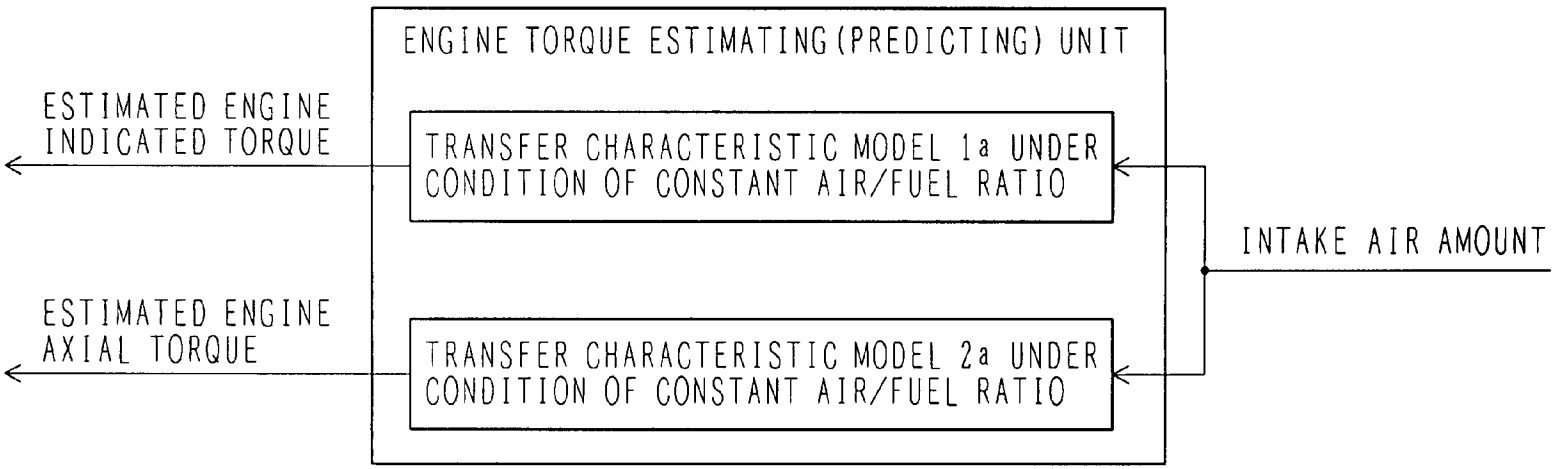
FIG. 8 is a block diagram for explaining a fourteenth form of the engine control system according to the present invention.
Figure 9:
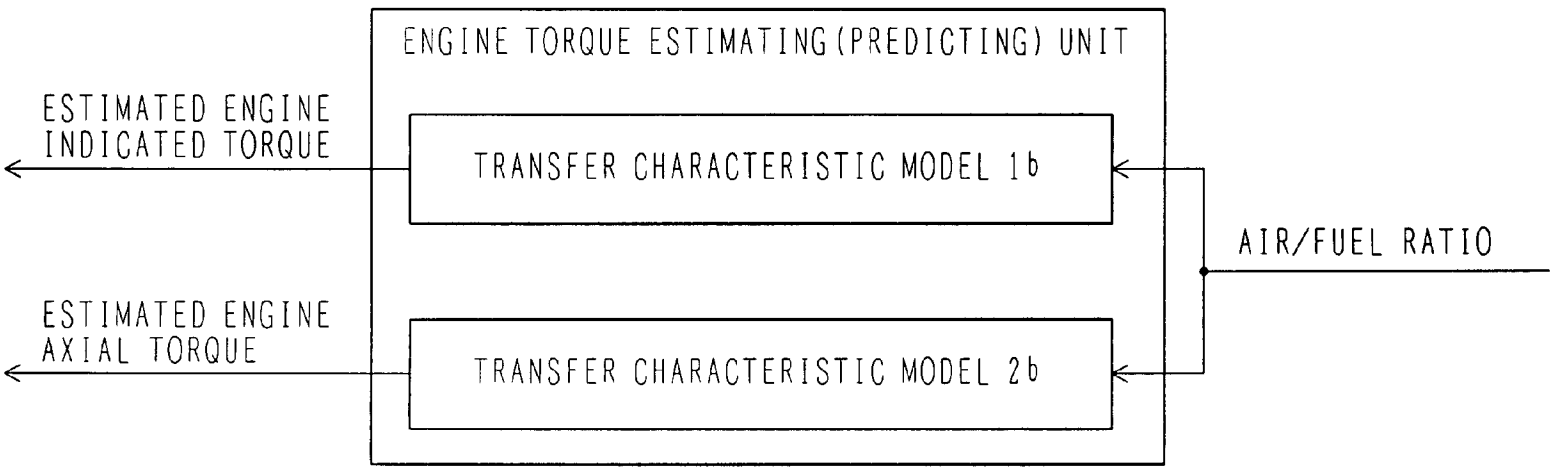
FIG. 9 is a block diagram for explaining a fifteenth form of the engine control system according to the present invention.
Figure 10:
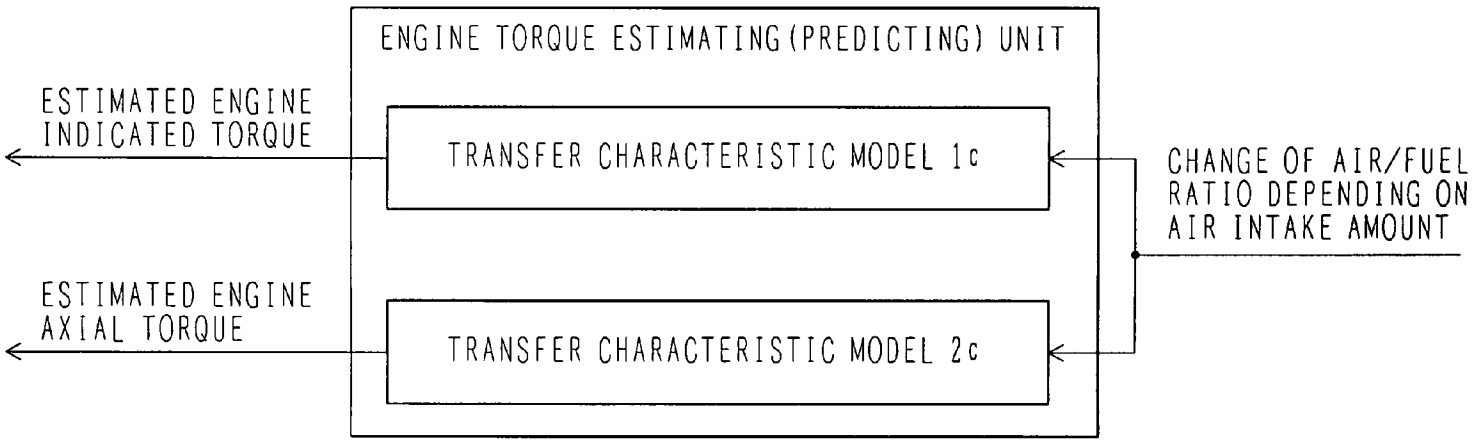
FIG. 10 is a block diagram for explaining a sixteenth form of the engine control system according to the present invention.
Figure 11:
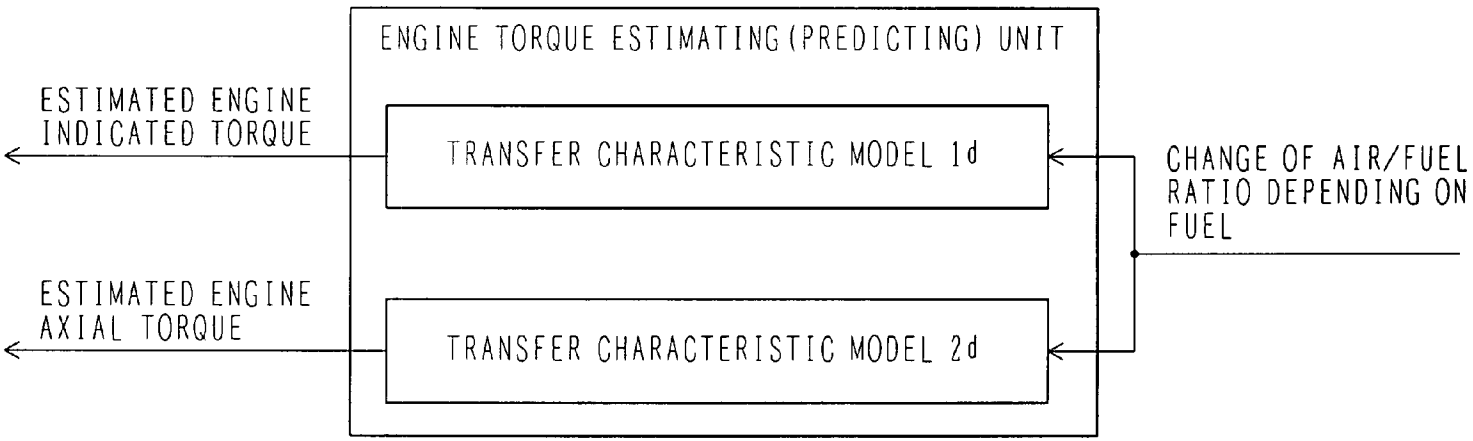
FIG. 11 is a block diagram for explaining a seventeenth form of the engine control system according to the present invention.
Figure 12:
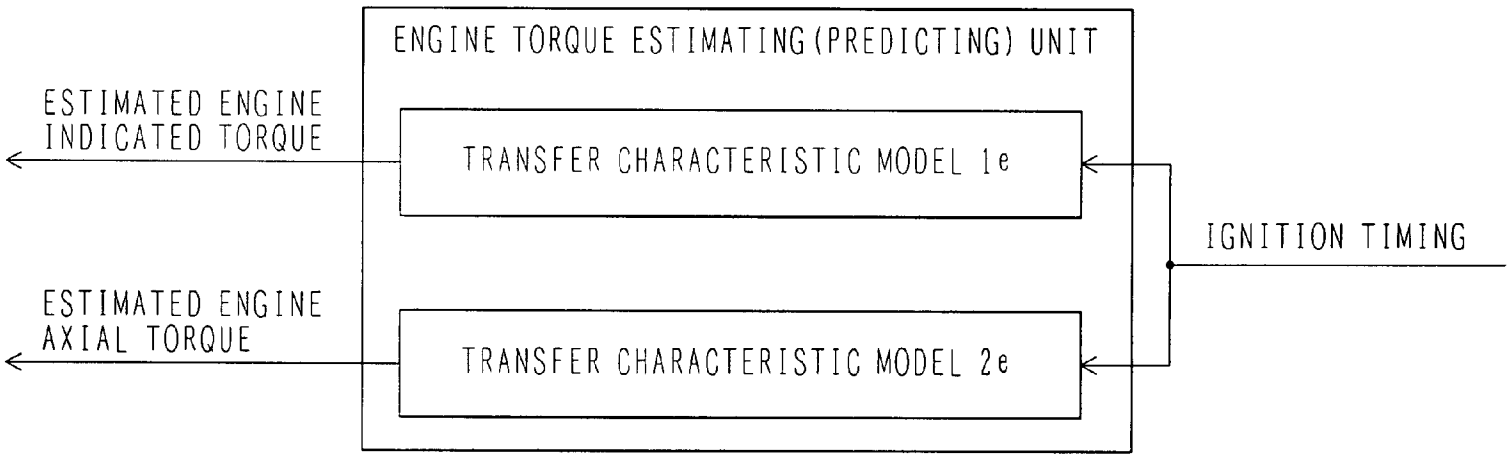
FIG. 12 is a block diagram for explaining an eighteenth form of the engine control system according to the present invention.
Figure 13:
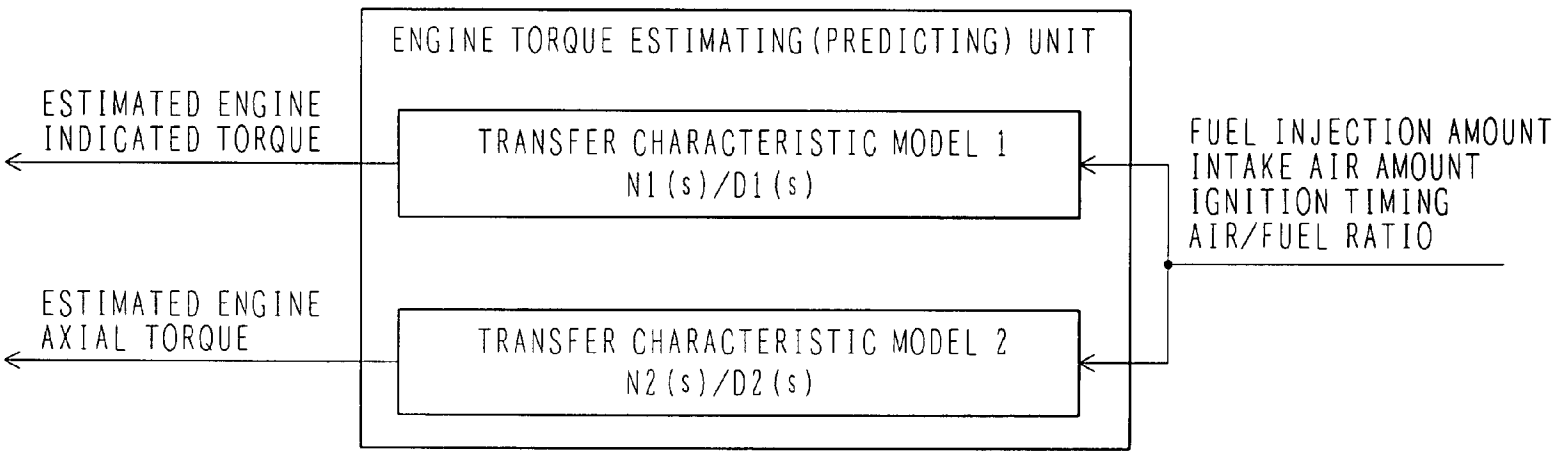
FIG. 13 is a block diagram for explaining a nineteenth form of the engine control system according to the present invention.
Figure 14:
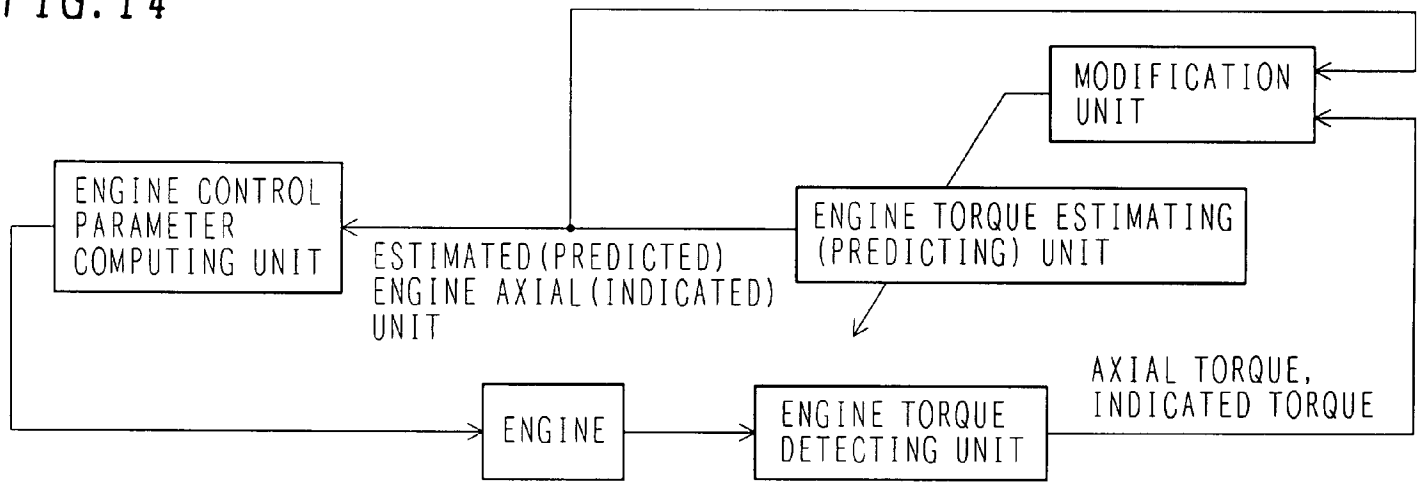
FIG. 14 is a block diagram for explaining a twentieth form of the engine control system according to the present invention.
Figure 15:
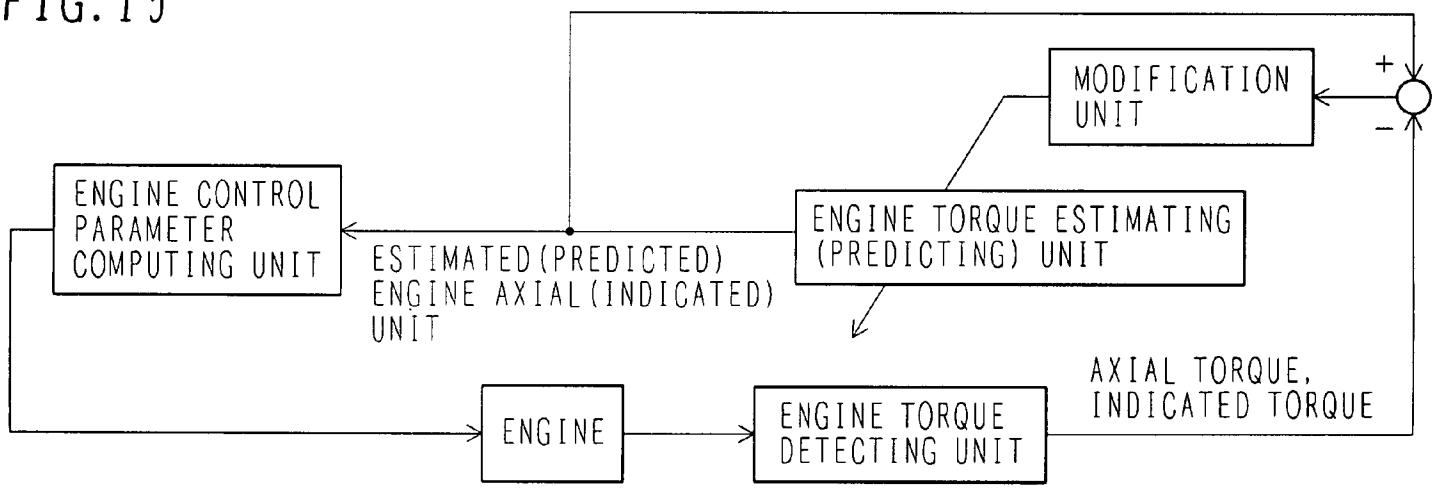
FIG. 15 is a block diagram for explaining a twenty-first form of the engine control system according to the present invention.
Figure 16:
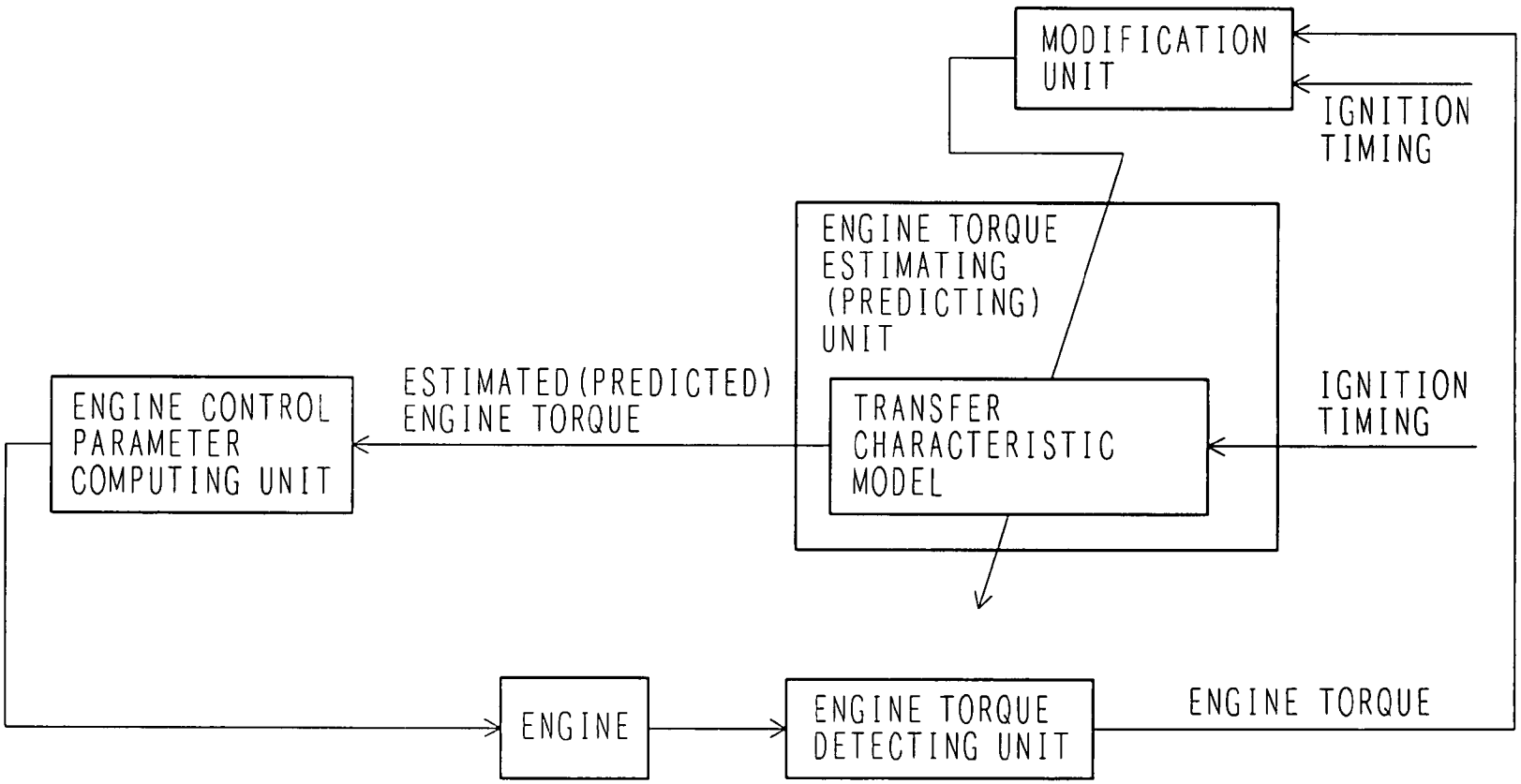
FIG. 16 is a block diagram for explaining a twenty-second form of the engine control system according to the present invention.
Figure 17:
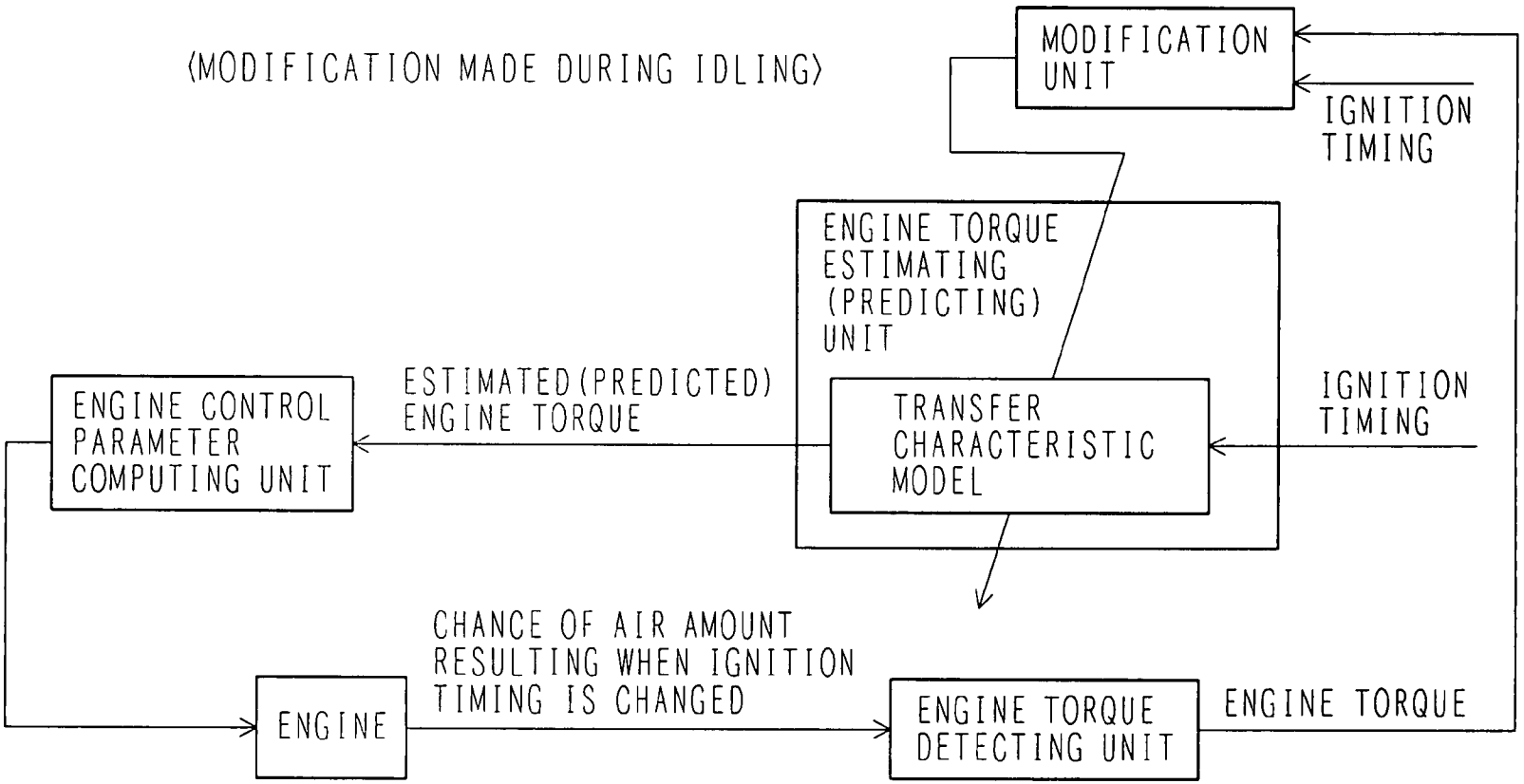
FIG. 17 is a block diagram for explaining a twenty-third form of the engine control system according to the present invention.
Figure 18:
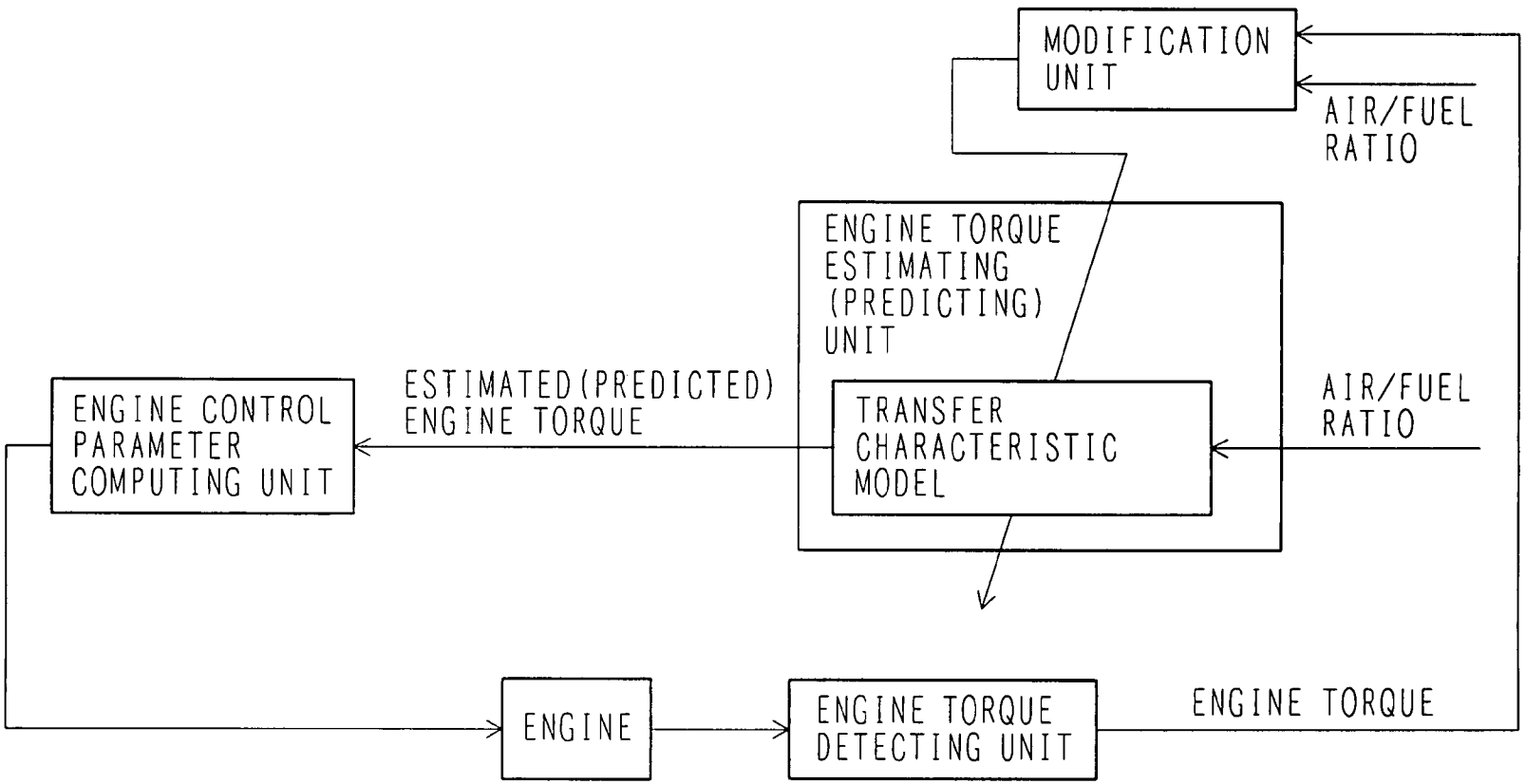
FIG. 18 is a block diagram for explaining a twenty-fifth form of the engine control system according to the present invention.
Figure 19:
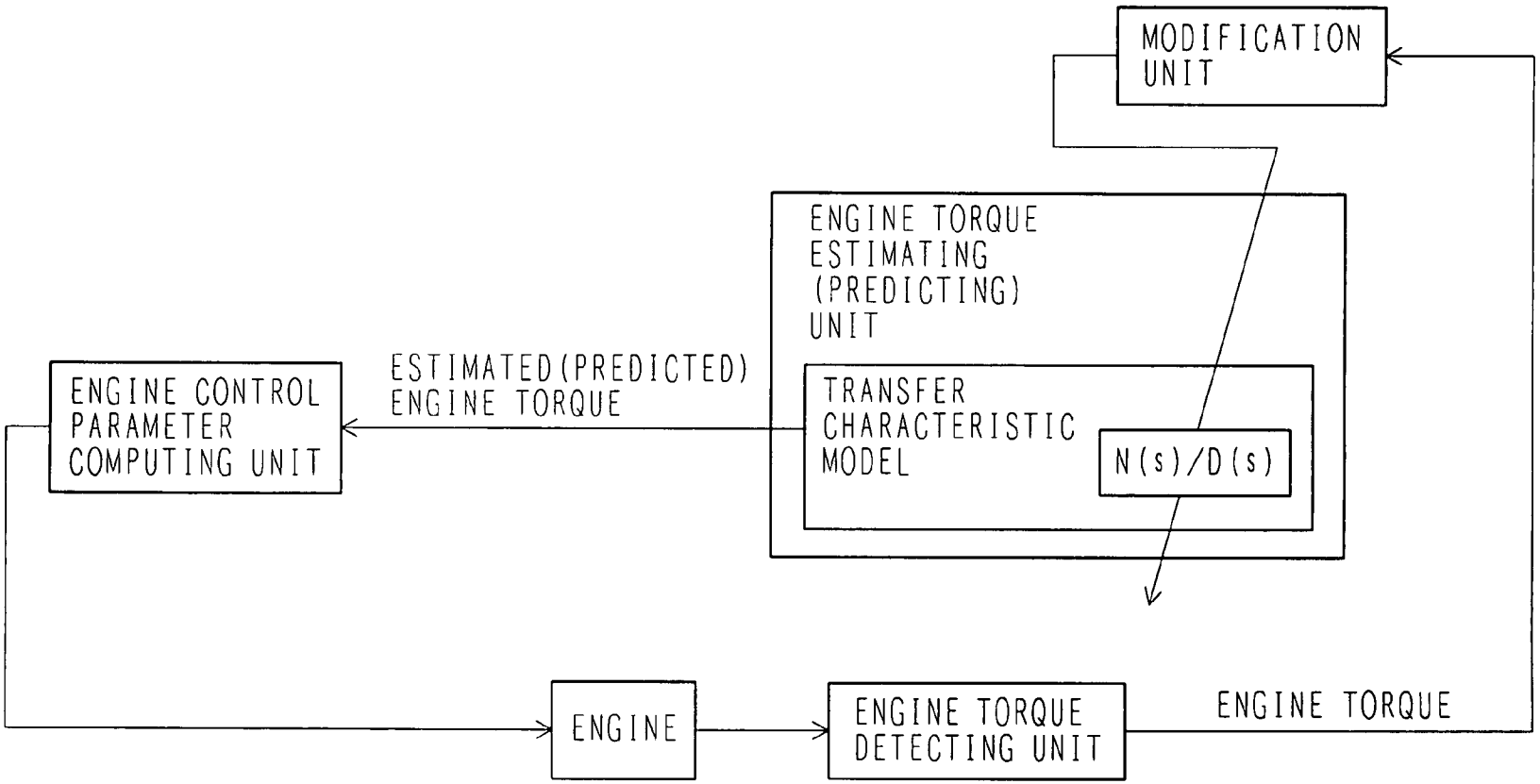
FIG. 19 is a block diagram for explaining a twenty-sixth form of the engine control system according to the present invention.
Figure 20:
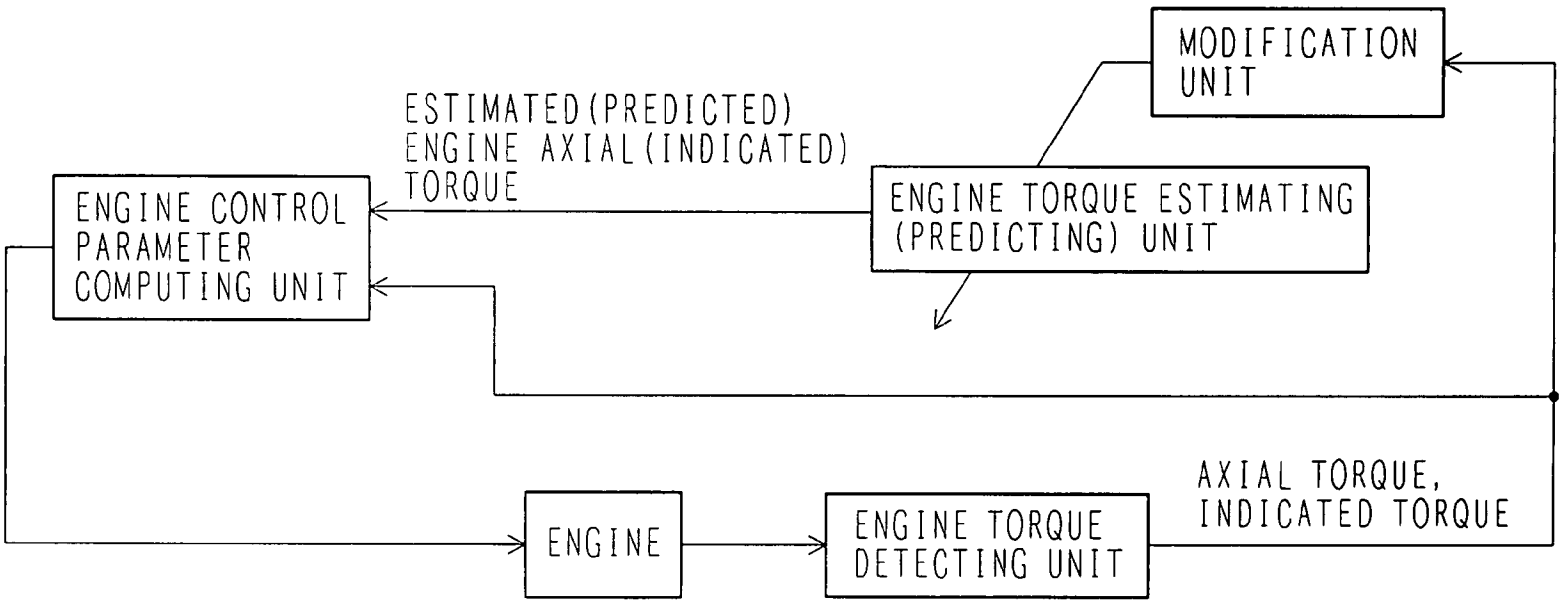
FIG. 20 is a block diagram for explaining a twenty-seventh form of the engine control system according to the present invention.
Figure 21:
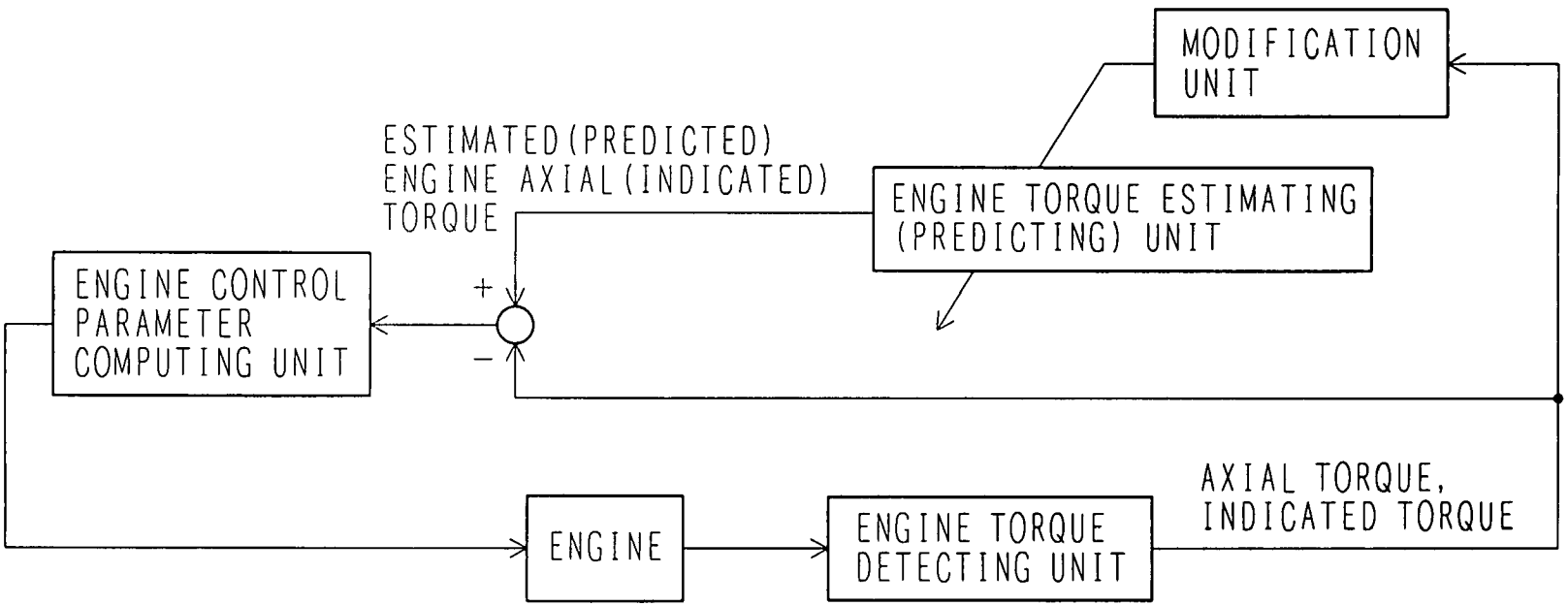
FIG. 21 is a block diagram for explaining a twenty-eighth form of the engine control system according to the present invention.
Figure 22:
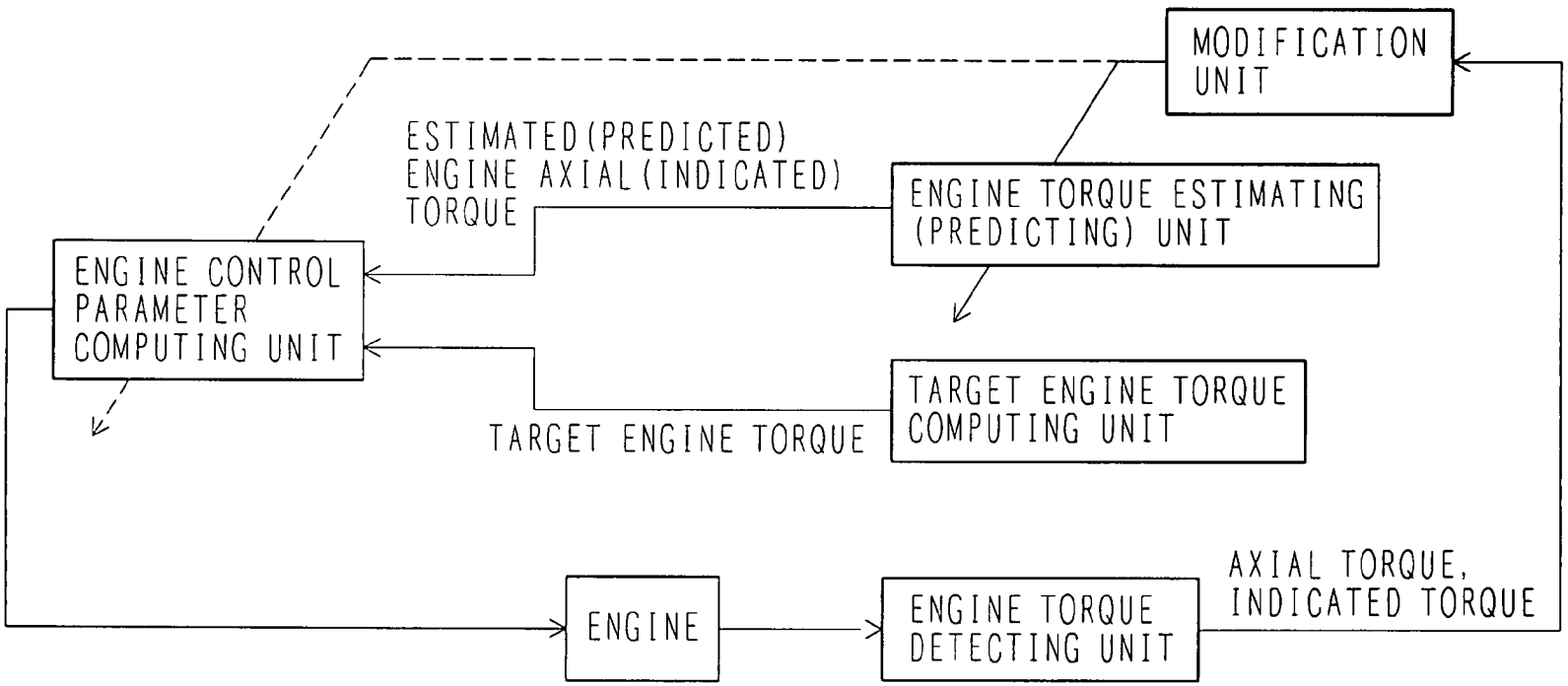
FIG. 22 is a block diagram for explaining a twenty-ninth form of the engine control system according to the present invention.
Figure 23:
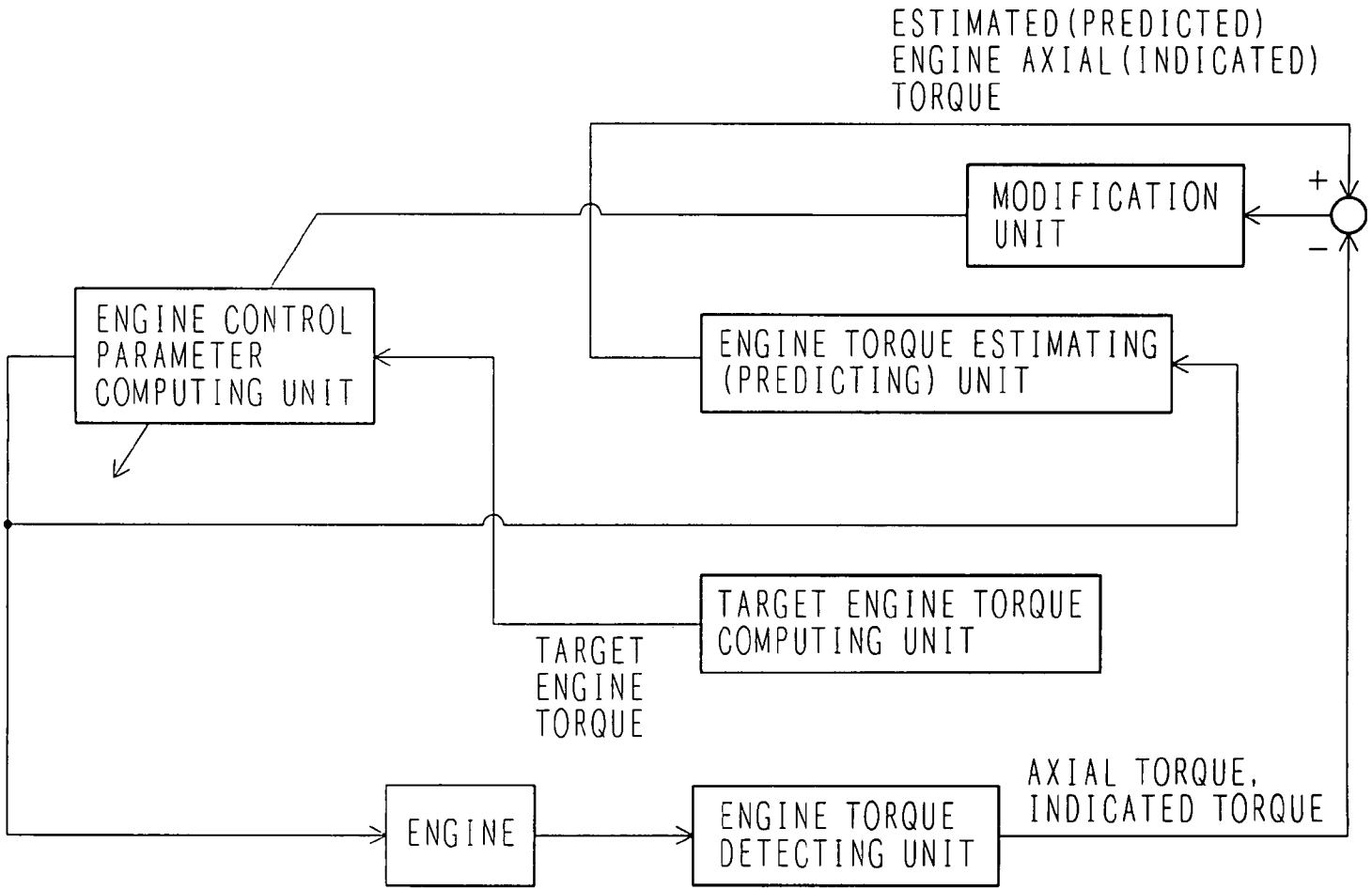
FIG. 23 is a block diagram for explaining a thirtieth form of the engine control system according to the present invention.
Figure 24:
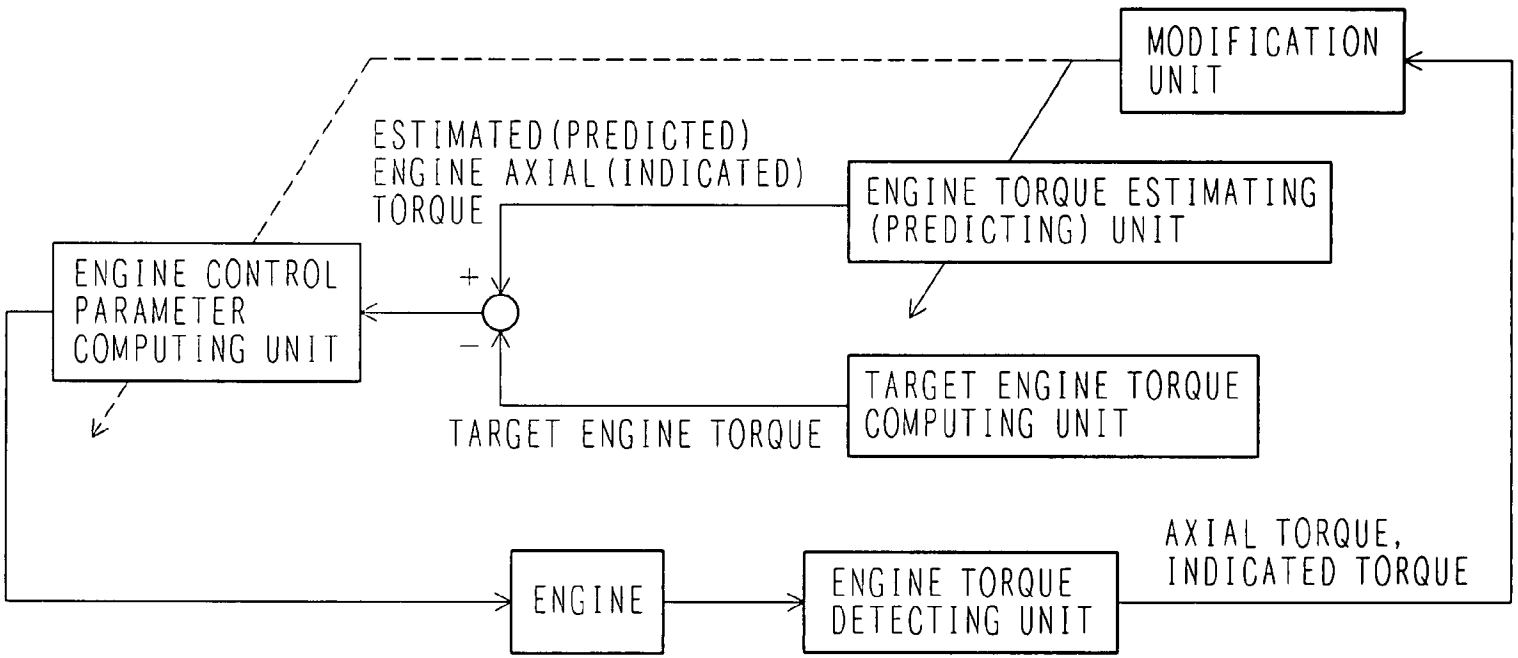
FIG. 24 is a block diagram for explaining a thirty-first form of the engine control system according to the present invention.
Figure 25:
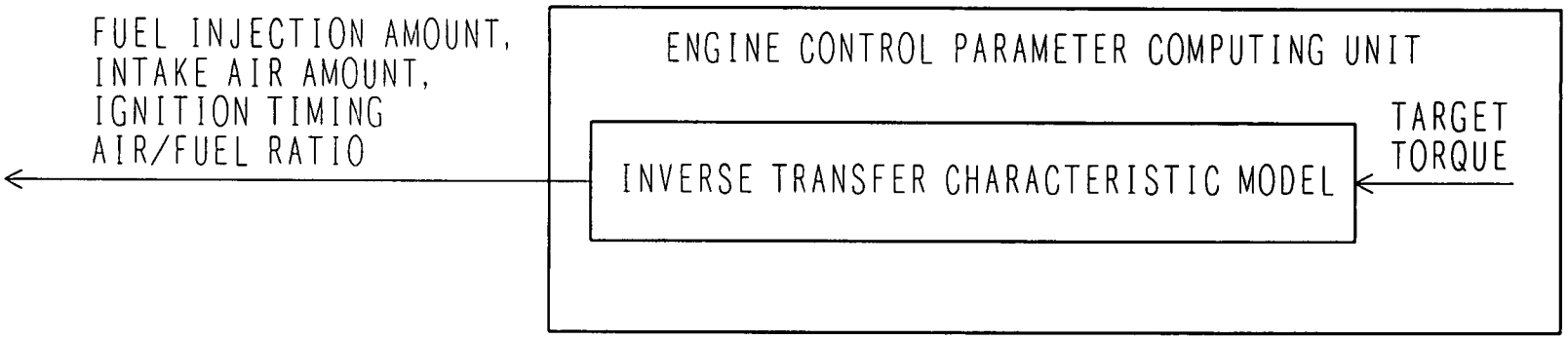
FIG. 25 is a block diagram for explaining a thirty-second form of the engine control system according to the present invention.
Figure 26:
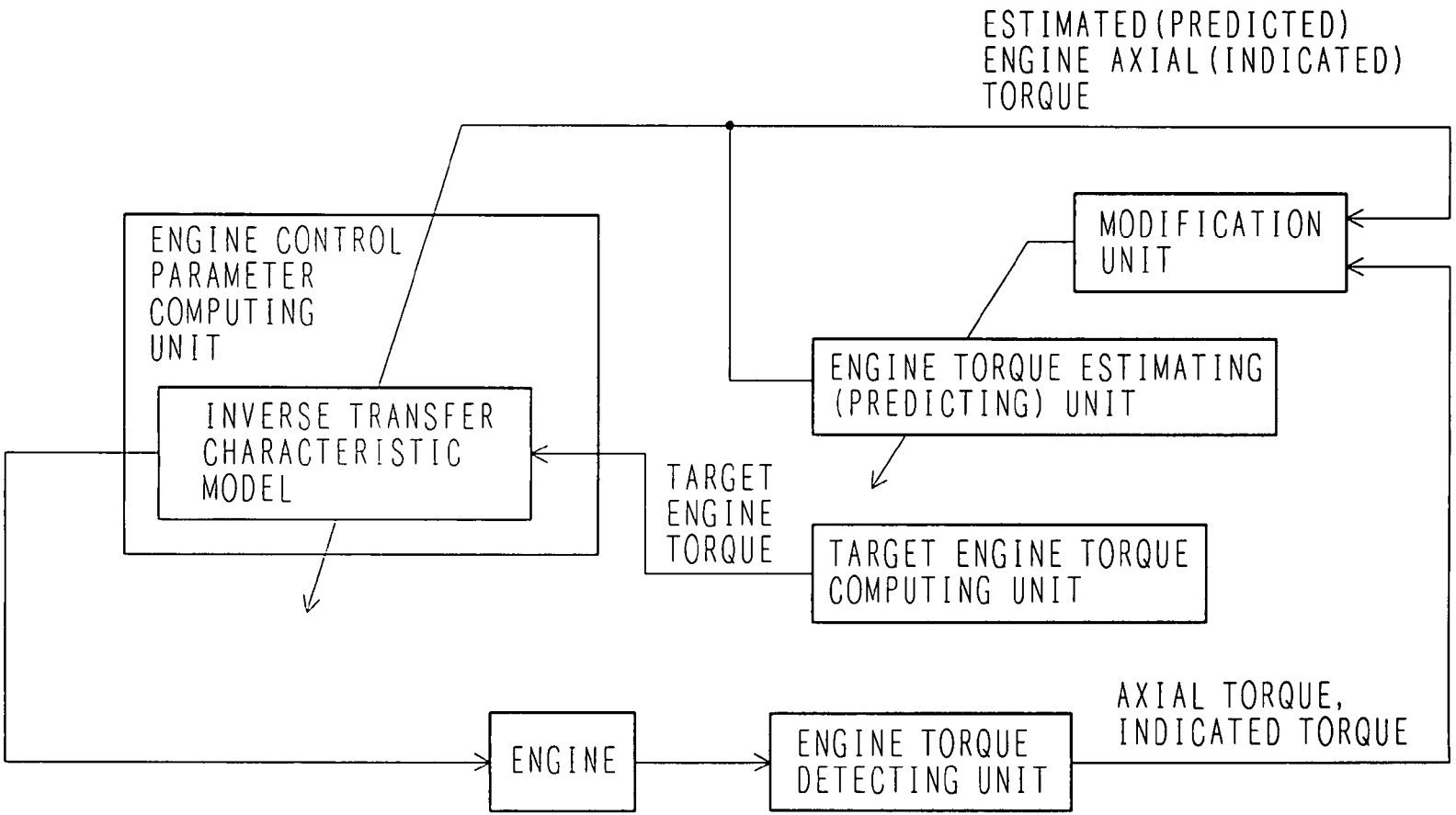
FIG. 26 is a block diagram for explaining a thirty-third form of the engine control system according to the present invention.
Figure 27:
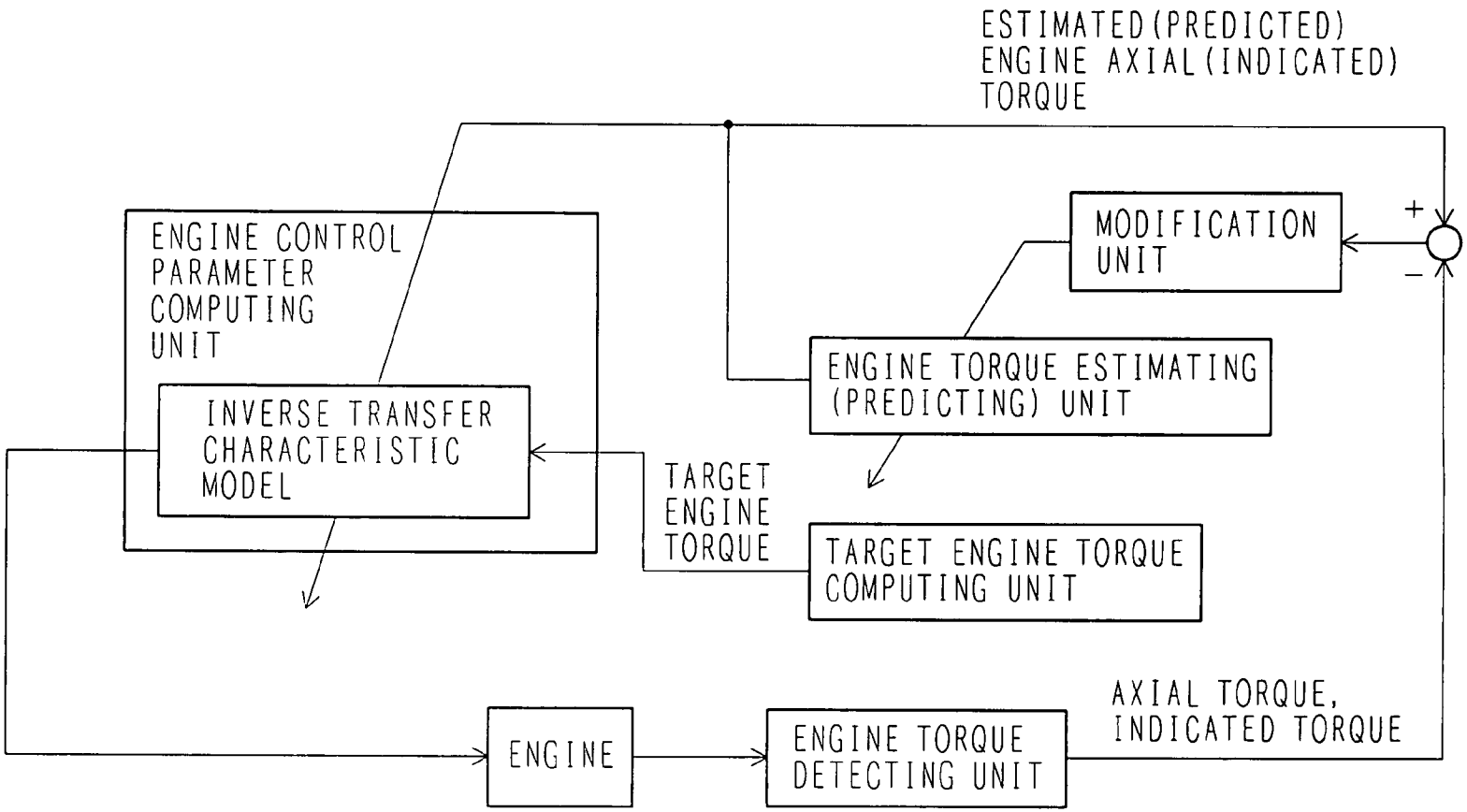
FIG. 27 is a block diagram for explaining a thirty-fourth form of the engine control system according to the present invention.
Figure 28:
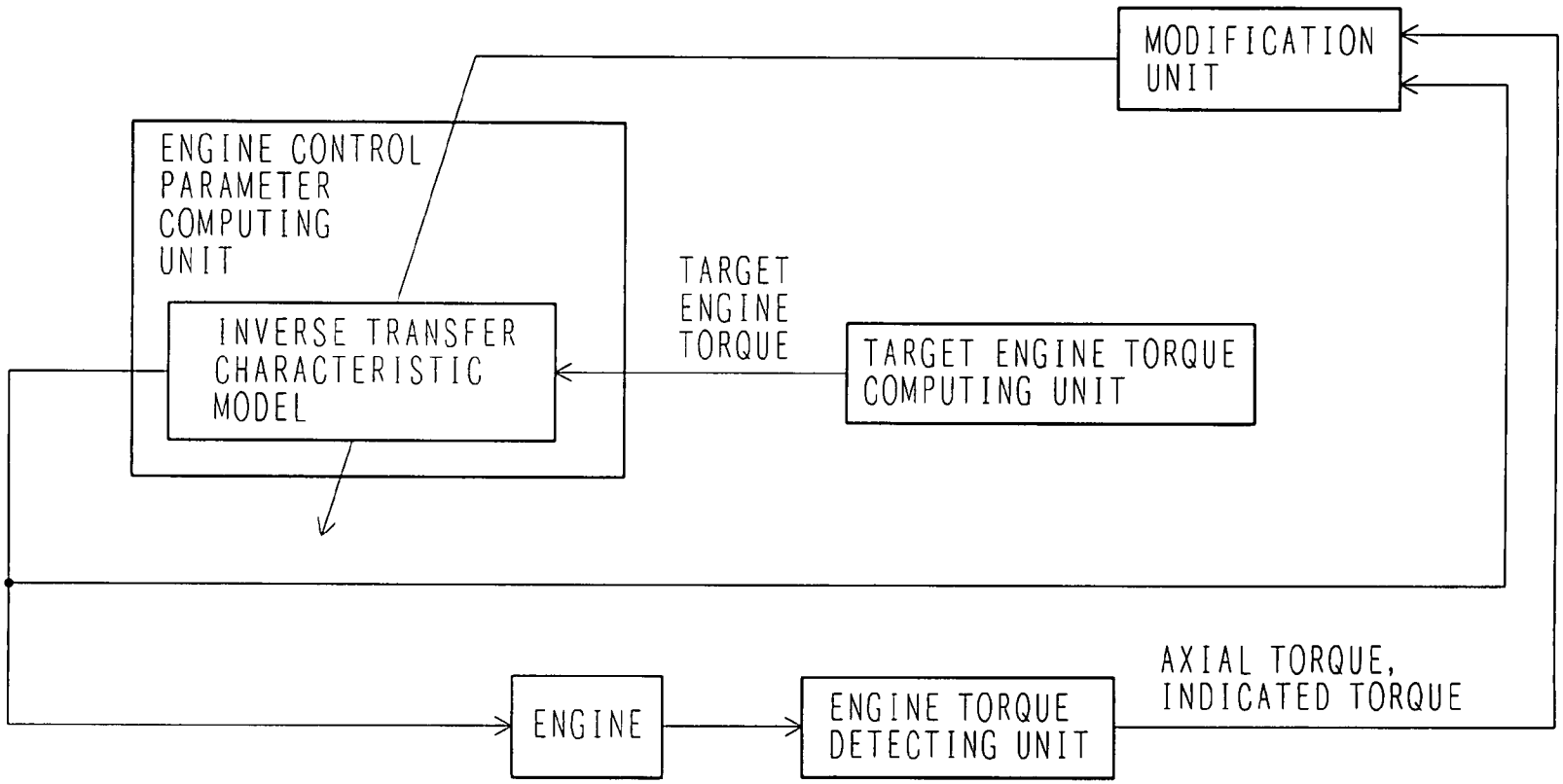
FIG. 28 is a block diagram for explaining a thirty-fifth form of the engine control system according to the present invention.
Figure 29:
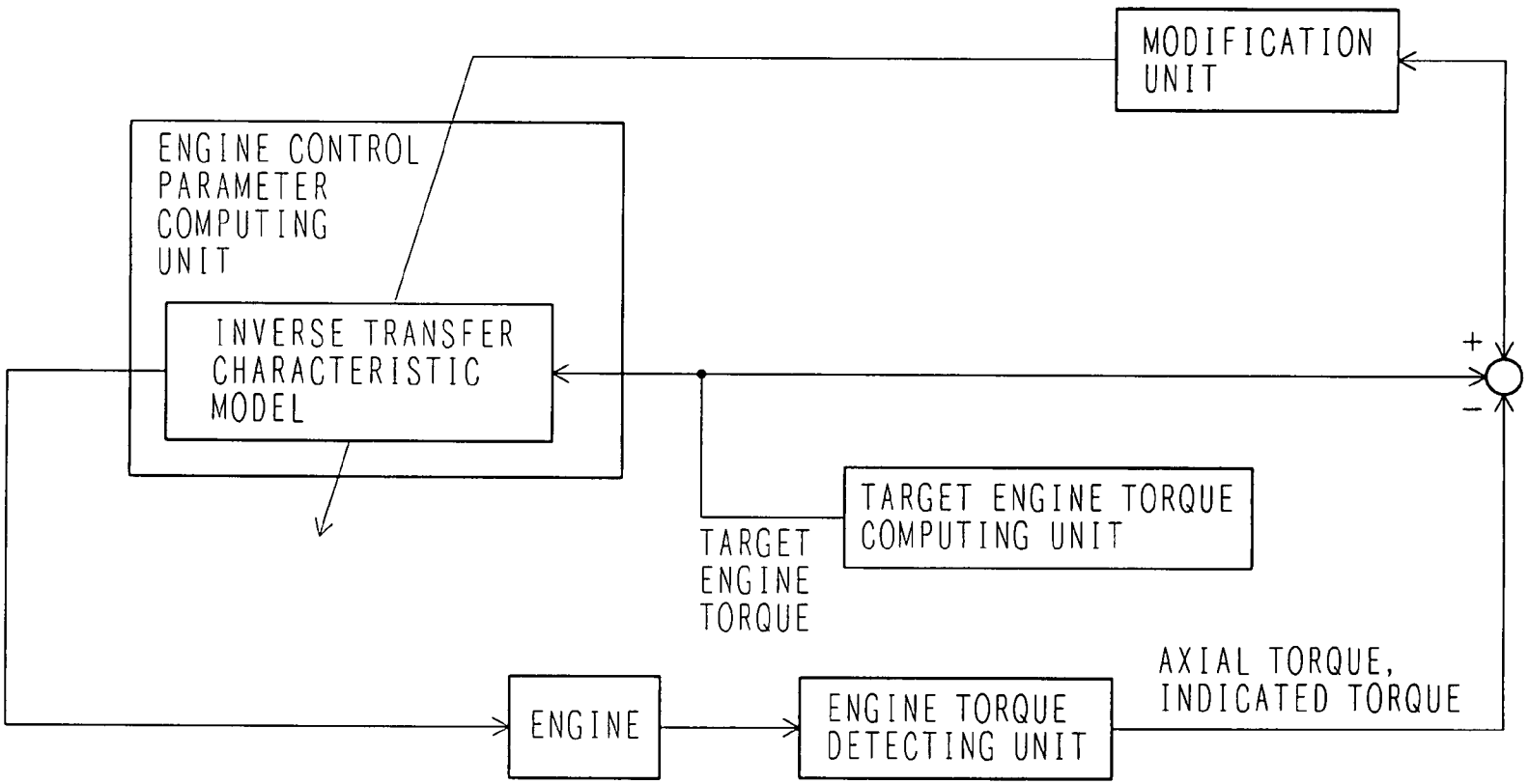
FIG. 29 is a block diagram for explaining a thirty-sixth form of the engine control system according to the present invention.
Figure 30:
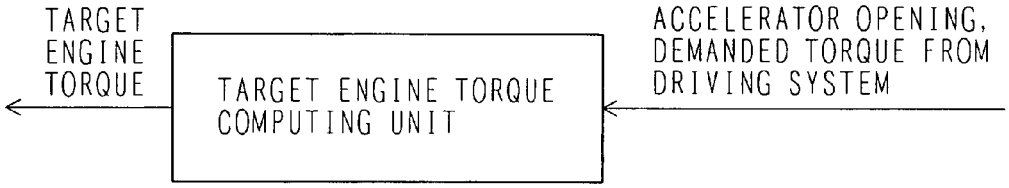
FIG. 30 is a block diagram for explaining a thirty-seventh form of the engine control system according to the present invention.
Figure 31:
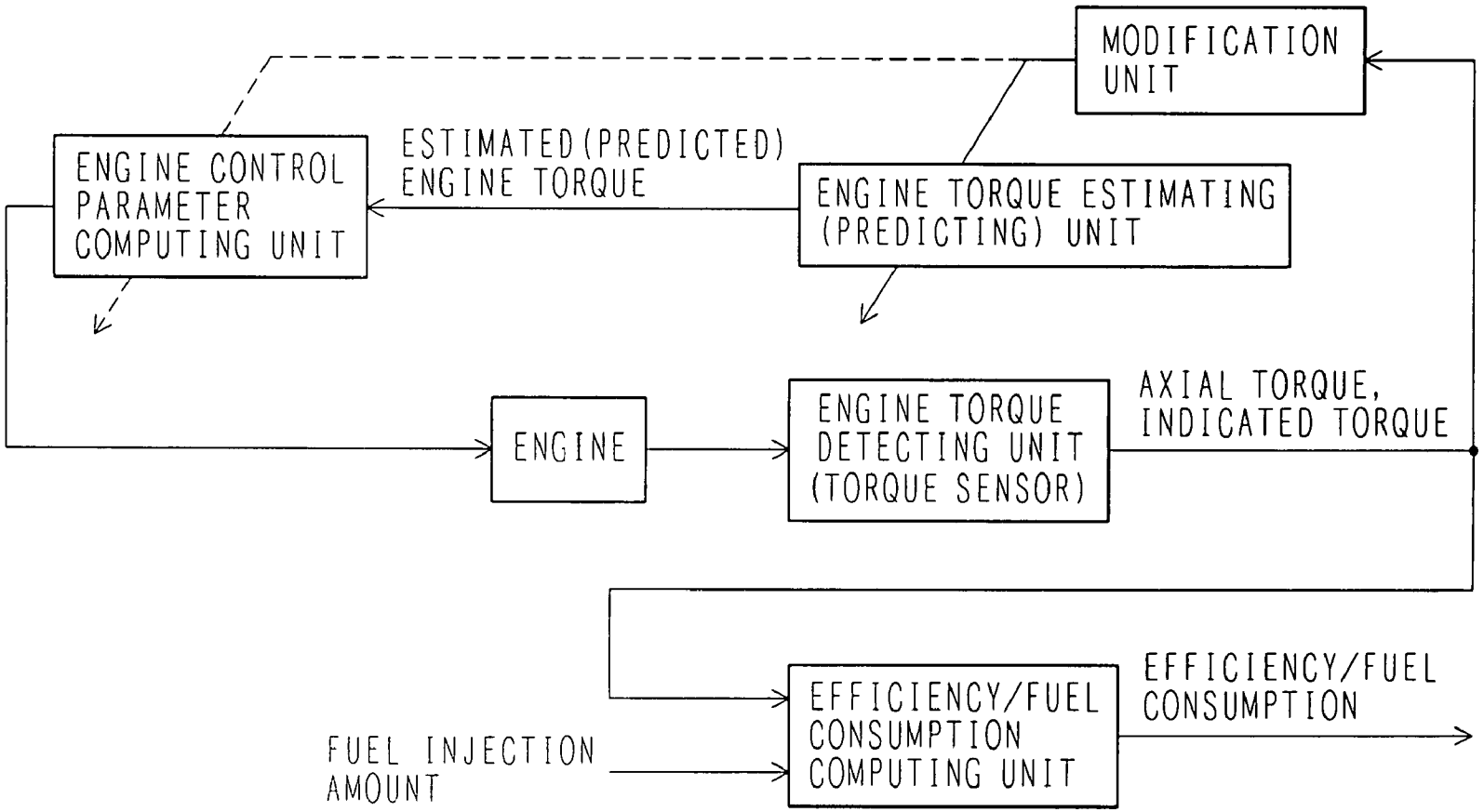
FIG. 31 is a block diagram for explaining a thirty-eighth form of the engine control system according to the present invention.
Figure 32:
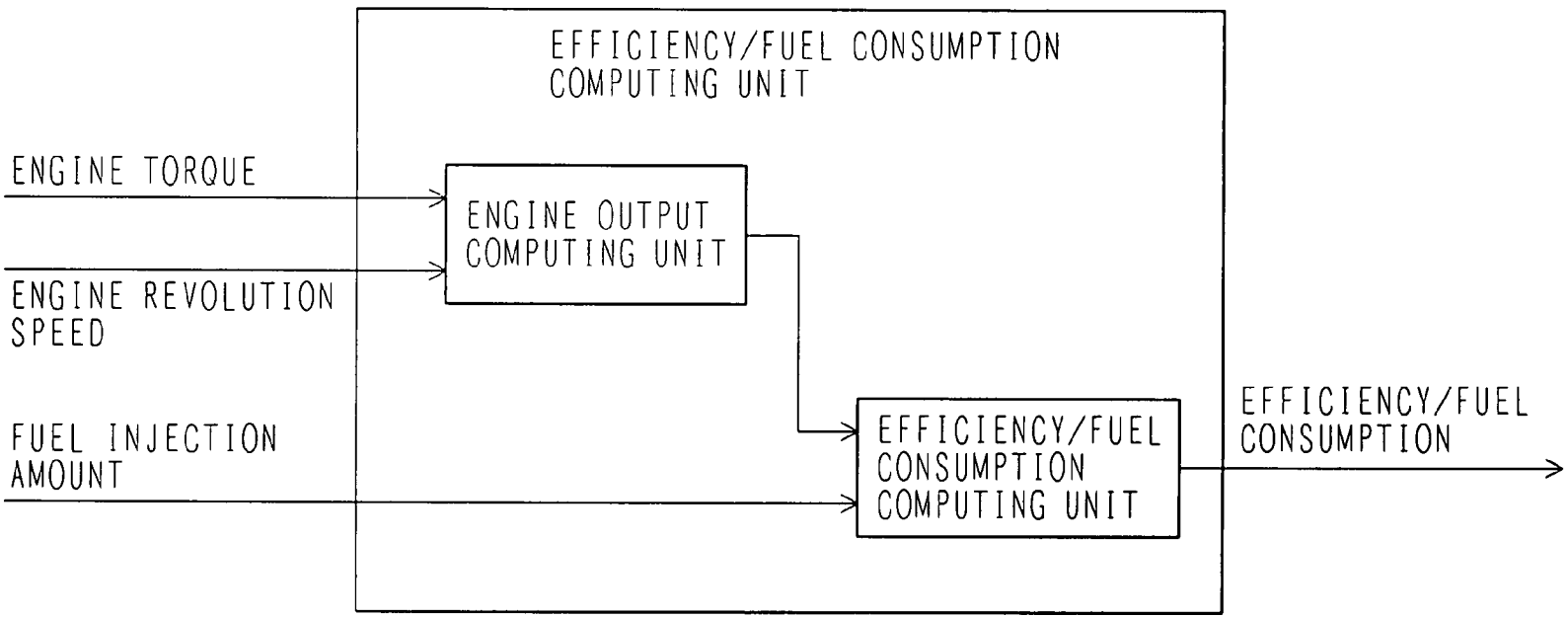
FIG. 32 is a block diagram for explaining a thirty-ninth form of the engine control system according to the present invention.
Figure 33:
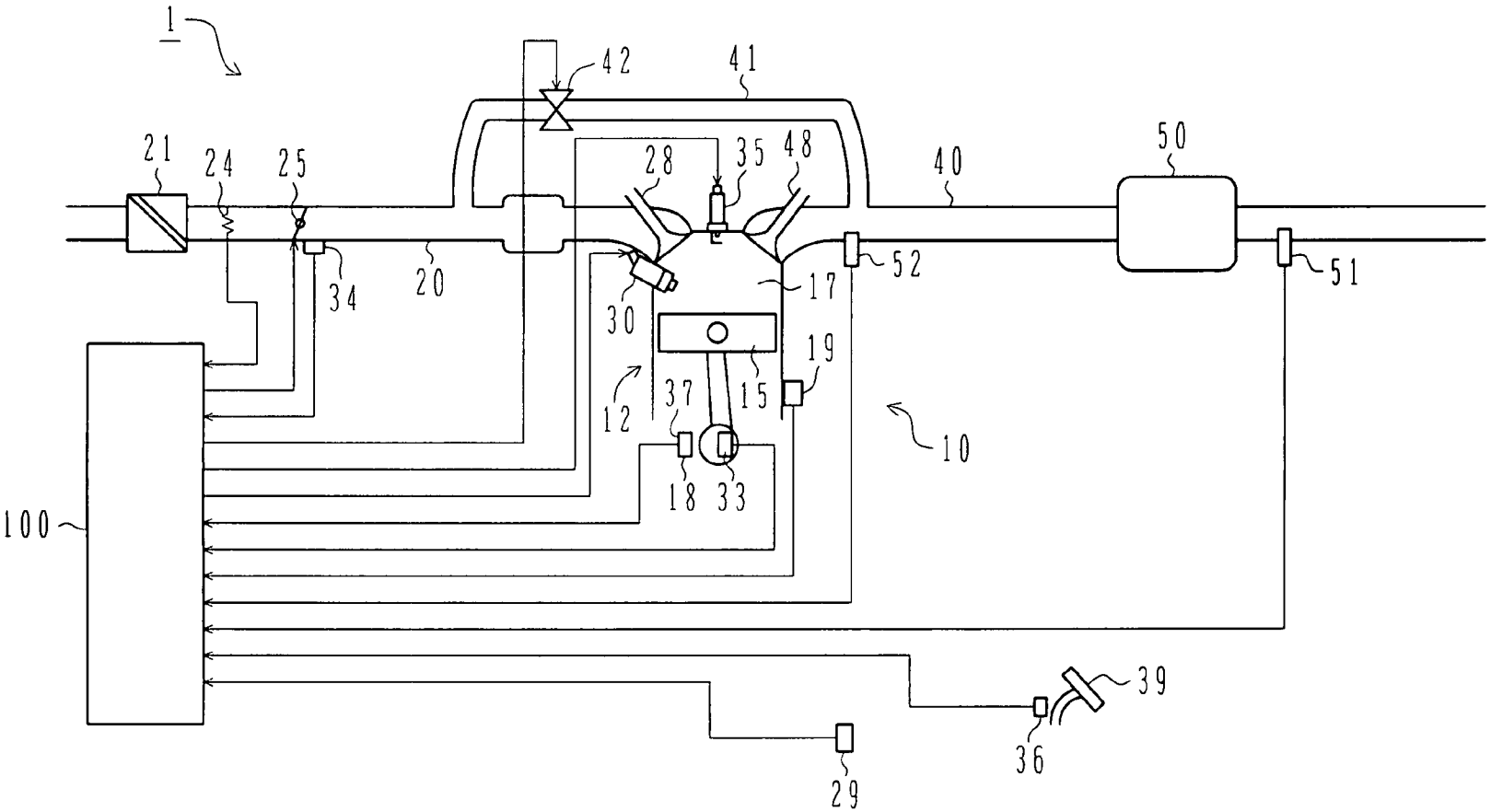
FIG. 33 is a schematic view showing an engine control system according to a first embodiment of the present invention along with an engine to which the engine control system is applied.

FIG. 33 is a schematic view showing an engine control system according to a first embodiment of the present invention along with a vehicular engine to which the engine control system is applied.

An engine 10 shown in FIG. 33 is a multi-cylinder engine having four cylinders, for example. The engine 10 comprises a cylinder block 12 and a piston 15 slidably fitted in each of individual cylinders #1, #2, #3 and #4 of the cylinder block 12. A combustion chamber 17 is defined above the piston 15. An ignition plug 35 is disposed to face the combustion chamber 17.

Air used for combustion of fuel is taken in from an air cleaner 21 disposed in a start end portion of an intake passage 20 and enters a collector 27 after passing through an airflow sensor 24 and an electronically controlled throttle valve 25. Then, the intake air is introduced from the collector 27 to the combustion chamber 17 of each cylinder #1, #2, #3 or #4 through an intake valve 28 disposed at a downstream end (intake port) of the intake passage 20. Also, a fuel injection valve 30 is disposed to face the combustion chamber 17.

A gas mixture of the air introduced to the combustion chamber 17 and the fuel injected from the fuel injection valve 30 is ignited by the ignition plug 35 for combustion and expansion. Resulting combustion waste gas (exhaust gas) is discharged from the combustion chamber 17 through an exhaust valve 48 to individual passages forming an upstream portion of an exhaust passage 40. Then, the exhaust gas flows from the individual passages through an exhaust collector and enters a three-way catalyst 50 disposed in the exhaust passage 40. After being cleaned by the three-way catalyst 50, the exhaust gas is discharged to the exterior.

An $O_2$ sensor 51 is disposed in the exhaust passage 40 downstream of the three-way catalyst 50, and an A/F sensor 52 is disposed in the exhaust passage 40 at a position near the exhaust collector upstream of the three-way catalyst 50.

The A/F sensor 52 has a linear output characteristic with respect to the concentration of oxygen contained in the exhaust gas. The relationship between the oxygen concentration in the exhaust gas and the air/fuel ratio is substantially linear. Therefore, the air/fuel ratio in the exhaust collector can be obtained from the A/F sensor 52 for detecting the oxygen concentration. Also, based on a signal from the $O_2$ sensor 51, the oxygen concentration downstream of the three-way catalyst 50 or whether it is rich or lean with respect to the stoichiometric value can be determined.

A part of the exhaust gas discharged from the combustion chamber 17 to the exhaust passage 40 is introduced to the intake passage 20 through an EGR passage 41, as required, for circulation to the combustion chamber 17 of each cylinder through a corresponding branched passage of the intake passage 20. An EGR valve 42 is disposed in the EGR passage 41 for adjustment of an EGR rate.

An engine control system 1 of this embodiment includes a control unit 100 in which a microcomputer is incorporated to execute various kinds of control for the engine 10.

Figure 34:
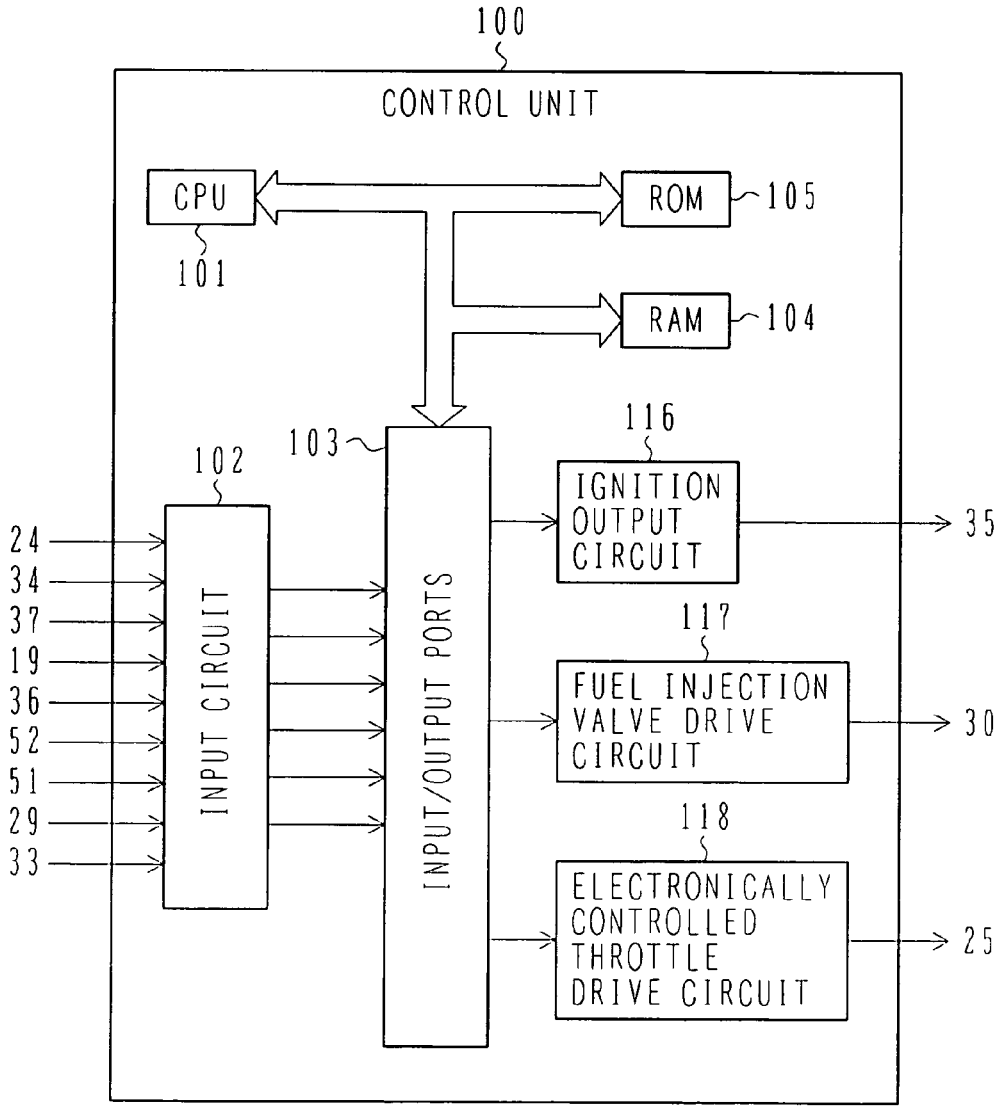
FIG. 34 is a block diagram showing the internal configuration of a control unit in the first embodiment.

The control unit 100 basically comprises, as shown in FIG. 34, a CPU 101, an input circuit 102, input/output ports 103, a RAM 104, a ROM 105, etc.

The control unit 100 receives, as input signals, a signal corresponding to the air amount (intake air amount) detected by the airflow sensor 24, a signal corresponding to the opening of the throttle valve 25 (i.e., the throttle opening) detected by a throttle sensor 34, a signal representing the rotation (engine revolution speed) and phase of a crankshaft 18 detected by a crank angle sensor 37, a signal corresponding to the oxygen concentration in the exhaust gas detected by the $O_2$ sensor 51 which is disposed in the exhaust passage 40 downstream of the three-way catalyst 50, a signal corresponding to the oxygen concentration (air/fuel ratio) detected by the A/F sensor 52 which is disposed in the exhaust passage 40 near the exhaust collector upstream of the three-way catalyst 50, a signal corresponding to the engine cooling water temperature detected by a water temperature sensor 19 which is disposed in the cylinder block 12, a signal corresponding to the amount of depression of an accelerator pedal 39 (i.e., the amount indicating torque demanded by a driver) obtained from an accelerator sensor 36, a signal corresponding to the speed of a vehicle mounting the engine 10, which is detected by a vehicle speed sensor 29, a signal corresponding to the axial torque of the engine obtained from a torque sensor 33 which is disposed on the crankshaft 18, and so on.

In the control unit 100, respective outputs of the A/F sensor 52, the $O_2$ sensor 51, the throttle sensor 34, the airflow sensor 24, the crank angle sensor 37, the water temperature sensor 16, the accelerator sensor 36, the torque sensor 33, and so on are applied to the input circuit 102 and are subjected to signal processing such as noise removal. Thereafter, the input signals are sent to the input/output ports 103. Respective values applied to the input ports are stored in the RAM 104 and are subjected to arithmetic and logical operations in the CPU 101. Control programs describing details of the arithmetic and logical operations are written in the ROM 105 in advance. Respective values computed in accordance with the control programs and representing corresponding actuator control inputs are stored in the RAM 104 and then sent to the output ports 103.

A signal for operating the ignition plug 35 is set as an on/off signal that is turned on when a current is supplied to a primary coil in an ignition output circuit 116, and is turned off when no current is supplied. The ignition timing is defined as the time at which the operating signal shifts from the on- to off-state. The signal for the ignition plug 35, which has been set at the output port 103, is amplified by the ignition output circuit 116 to a level of energy sufficient for the ignition, and then supplied to the ignition plug 35. Also, a signal for driving the fuel injection valve 30 (i.e., an air/fuel control signal) is set as an on/off signal that is turned on when the fuel injection valve 30 is opened, and is turned off when it is closed. The air/fuel control signal is amplified by a fuel injection valve drive circuit 117 to a level of energy sufficient for opening the fuel injection valve 30, and then supplied to the fuel injection valve 30. A drive signal for realizing a target opening of the electronically controlled throttle valve 25 is sent to the electronically controlled throttle valve 25 via an electronically controlled throttle valve drive circuit 118.

In the control unit 100, the air/fuel ratio upstream of the three-way catalyst 50 is obtained based on the signal from the A/F sensor 52, and the oxygen concentration downstream of the three-way catalyst 50 or whether it is rich or lean with respect to the stoichiometric value is determined based on the signal from the $O_2$ sensor 51. Also, using the outputs of both the sensors 51, 52, feedback control is executed to sequentially modify the fuel injection amount (fuel amount) or the intake air amount (air amount) so that the cleaning efficiency of the three-way catalyst 50 is optimized.

The processing executed by the control unit 100 for engine torque control will be described in detail below.

Figure 35:
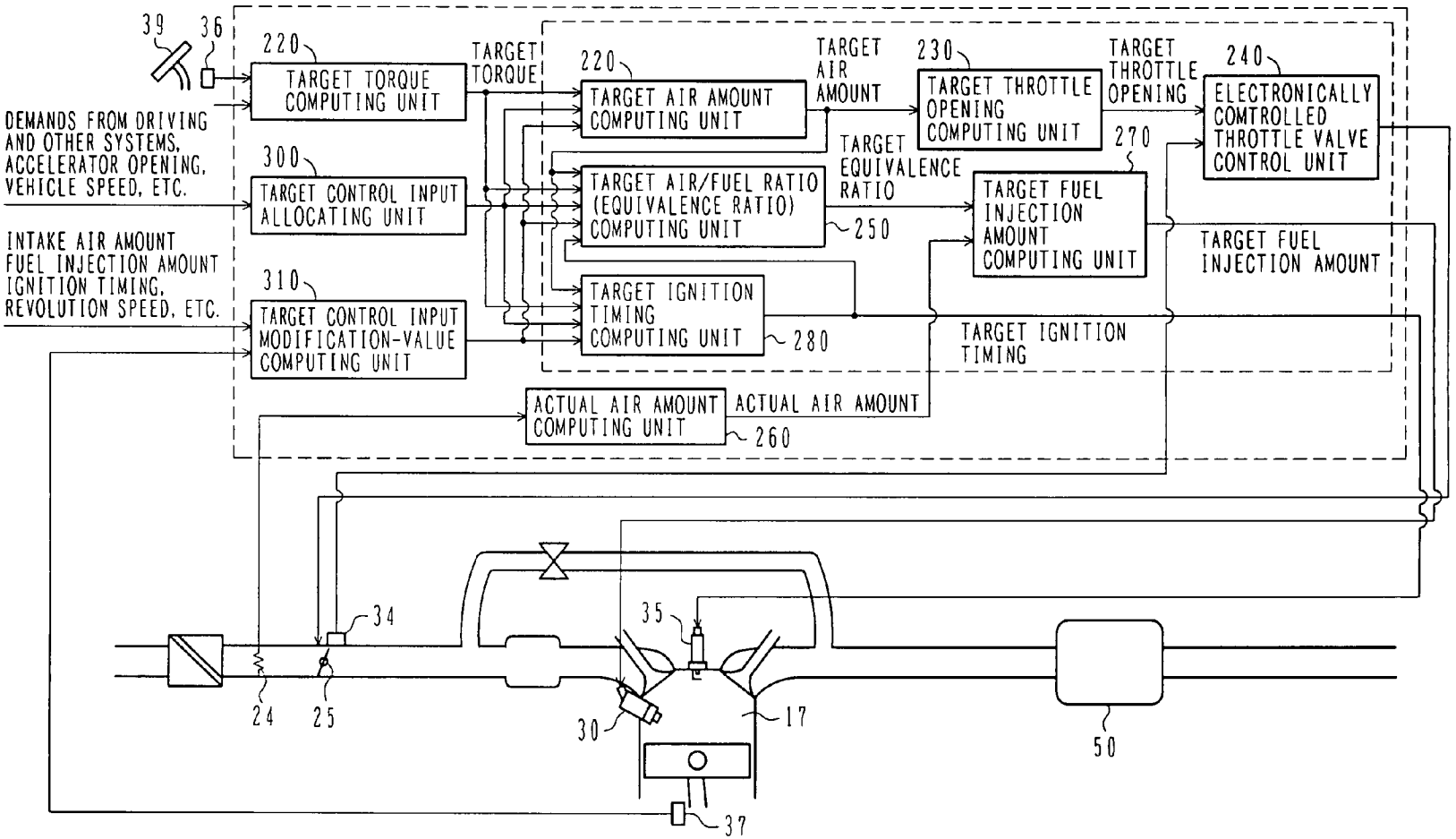
FIG. 35 is a block diagram showing a control system of the control unit in the first embodiment.

FIG. 35 is a functional block diagram showing a control system of the control unit 100 and shows a principal part of air-preceding type torque based control. This control system comprises a target torque computing unit 210, a target air amount computing unit 220, a target throttle opening computing unit 230, an electronically controlled throttle valve control unit 240, a target air/fuel ratio computing unit 250, an actual air amount computing unit 260, a target fuel injection amount computing unit 270, a target ignition timing computing unit 280, a target control input allocating unit 300, and a target control input modification-value computing unit 310.

First, the target torque computing unit 210 totally computes target torque from the accelerator opening and the torque demanded from various driving systems. Then, a target air amount is computed from the target torque and the target air/fuel ratio, and a target throttle opening for realizing the target air amount is computed. Further, the electronically controlled throttle valve control unit 240 executes F/B control of the throttle opening in accordance with the output of the throttle opening sensor 34. The fuel injection amount is computed from the actual air amount detected by the airflow sensor 24 and the target air/fuel ratio. The target fuel injection amount computing unit 270 computes a target fuel injection amount from both the actual air amount computed by the actual air amount computing unit 260 using the output of the airflow sensor 24 and the target air/fuel ratio (equivalence ratio) computed by the target air/fuel ratio (equivalence ratio) computing unit 250. There are three factors deciding the engine torque, i.e., the target air amount (fuel amount corresponding to it), the target air/fuel ratio, and the target ignition timing. Depending on each operation scene, the target control input allocating unit 300 decides how those three control inputs are allocated. Further, torque control accuracy is monitored using the signal from the torque sensor 33, and respective parameters of the target air amount computing unit 220, the target air/fuel ratio (equivalence ratio) computing unit 250, and the target ignition timing computing unit 280 are corrected as appropriate. Respective modification values are computed by the target control input modification-value computing unit 310.

Details of those units will be described one by one below.

<Target Torque Amount Computing Unit 210 (FIG. 36)>

Figure 36:
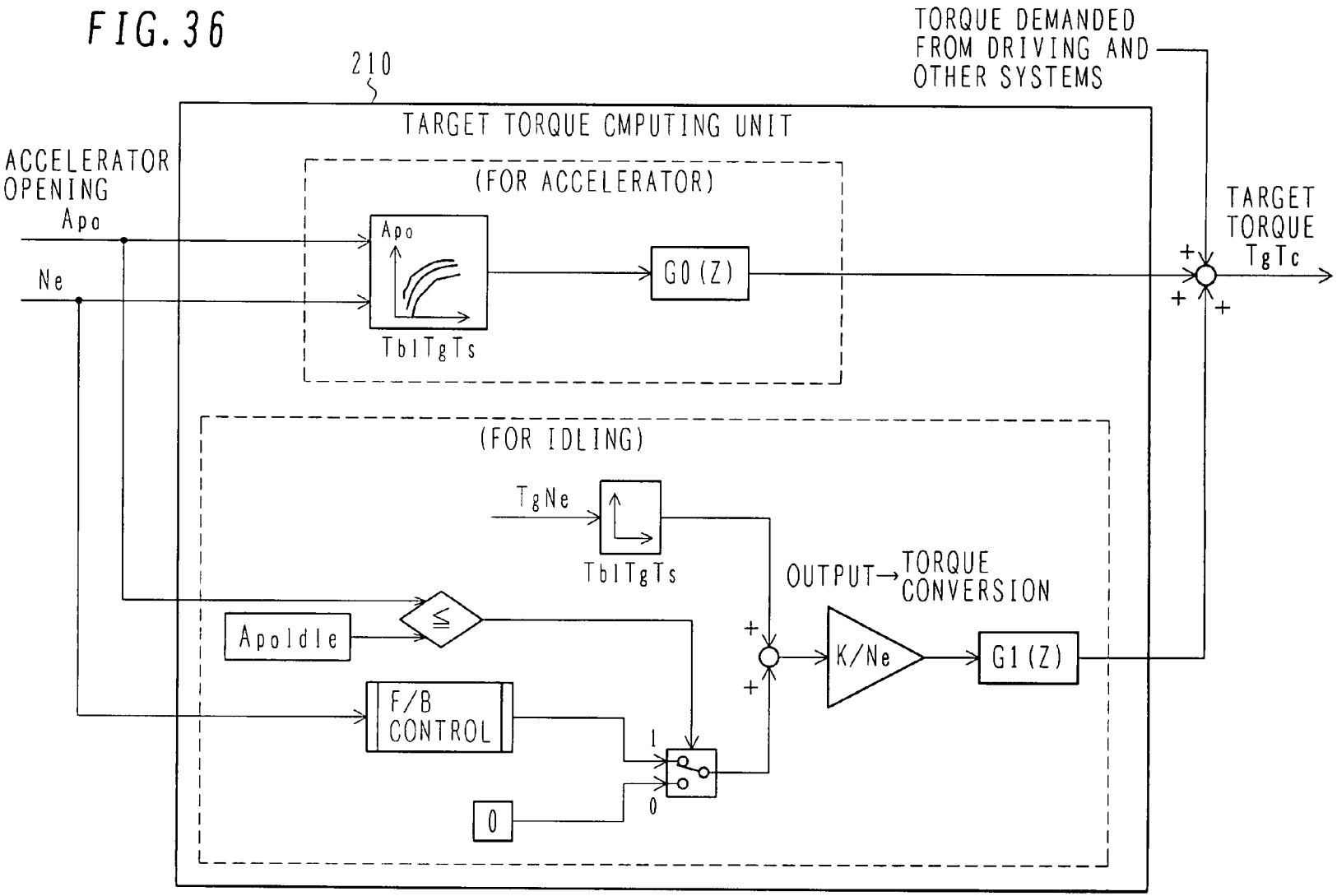
FIG. 36 is a block diagram for explaining a target torque computing unit in the first embodiment.

This computing unit 210 is constructed as shown in FIG. 36. TgTc in FIG. 36 represents the target torque. The target torque is totally computed from accelerator demanded torque, idling torque, and torque demanded from the driving and other systems. While the sum of the accelerator demanded torque, the idling torque, and the torque demanded from the driving and other systems is obtained as the target torque here, the target torque may be given by selecting, e.g., a maximum value or a minimum value among them.

While the accelerator demanded torque is obtained by referring to a map TblTgTs based on the accelerator opening (Apo) and the engine revolution speed (Ne), a desired torque track is created by applying a transfer characteristic G0(Z). The desired torque track is preferably decided depending on the characteristics (character) of each vehicle. Since the accelerator demanded torque is processed in terms of torque control and the idling torque is processed in terms of output control, the idling torque is obtained through torque conversion of the output. Further, the desired torque track is created by applying a transfer characteristic G1(Z) to the idling side. An idling F/F control component TgTf0 is decided by referring to a table TblTgTf based on the target revolution speed TgNe. The idling F/B control functions only in the idling state to compensate for an error of the F/F control component. Whether the idling state is or not is determined such that the engine is regarded as being in the idling state when the accelerator opening Apo is smaller than a predetermined value ApIIdle. The algorithm for the F/B control is not particularly shown here, but it can be executed, for example, as PID control. Because the setting value of TblTgTf is affected by friction, it is preferably decided based on actual data.

<Target Control Input Allocating Unit 300 (FIG. 37)>

Figure 37:
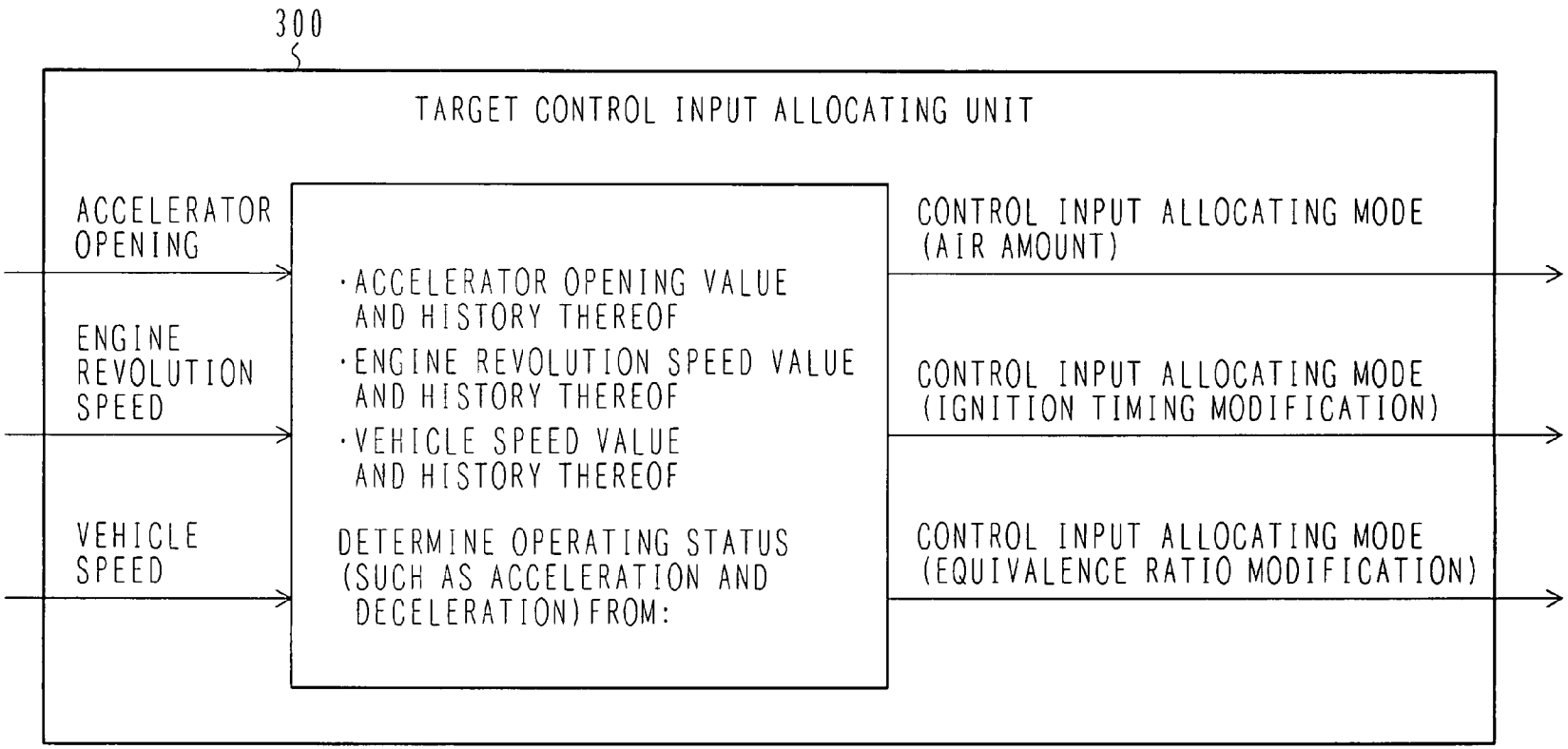
FIG. 37 is a block diagram for explaining a target control input allocating unit in the first embodiment.

As described above, there are three factors deciding the engine torque, i.e., the target air amount (or the fuel amount corresponding to it), the target air/fuel ratio, and the target ignition timing. Depending on each operation scene, the target control input allocating unit 300 decides how those three control inputs are allocated. Details are shown in FIG. 37. This embodiment employs the accelerator opening, the engine revolution speed, and the vehicle speed as information for judging the operation scene. Though not shown in detail here, for example, an acceleration demanded scene is judged when, looking at a history of the accelerator opening, the amount of change in the accelerator opening is not smaller than a predetermined value, and a deceleration demanded scene is judged when the amount of change in the accelerator opening is not larger than a predetermined value (on the minus side). Further, by looking at a history of the vehicle speed, it is possible to confirm how degree the vehicle has been accelerated or decelerated. By totally taking into account those items of information, the allocating unit 300 judges each operation scene and outputs a control input allocating mode indicating how the control inputs, i.e., the air amount, the air/fuel ratio, and the ignition timing, are allocated to realize the target torque computed by the target torque computing unit 210.

<Target Air Amount Computing Unit 220 (FIG. 38)>

Figure 38:
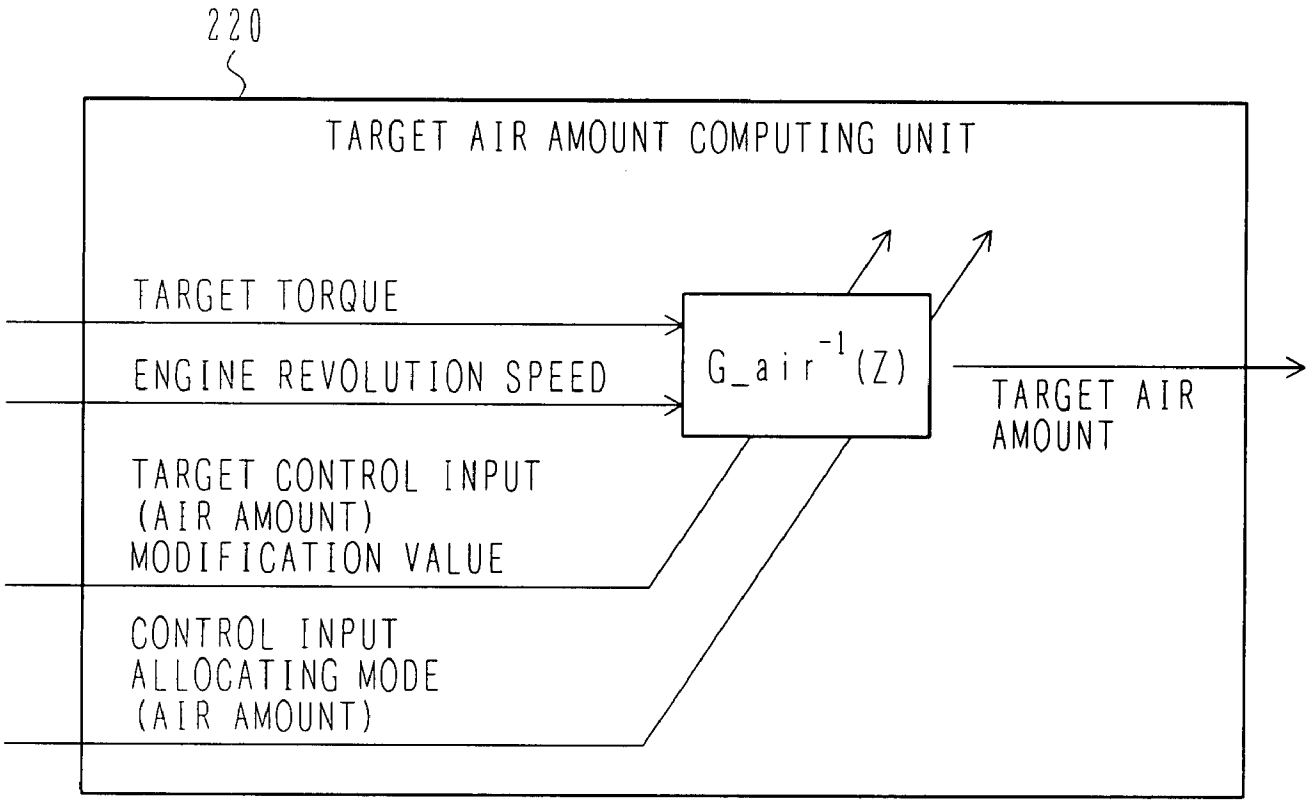
FIG. 38 is a block diagram for explaining a target air amount computing unit in the first embodiment.

This computing unit 220 computes a target air amount for realizing the target torque. More specifically, as shown in FIG. 38, the target air amount is computed from the target torque by using a transfer function $G_air^{-1}(Z)$. G_air(Z) is defined as shown in FIG. 38 and represents a transfer characteristic from the air amount near the throttle valve 25 to the engine axial torque. In general, n≧m holds. Accordingly, $G_air^{-1}(Z)$ represents an inverse transfer characteristic from the engine axial torque to the air amount near the throttle valve 25. Note that a_air1, a_air2, . . . , a_airn, b_air0, b_air1, . . . , b_airm are preferably decided based on a physical model and experimental values. While a_air1, a_air2, . . . , a_airn, b_air0, b_air1, . . . , b_airm represent, as mentioned above, the transfer characteristics from the air amount near the throttle valve 25 to the engine axial torque, those parameters are subjected to online tuning, as appropriate, by using a later-described target control input (air amount) modification value so that the desired torque track is realized. The torque component borne by the air amount is also adjusted, as appropriate, depending on the control input allocating mode.

Figure 39:
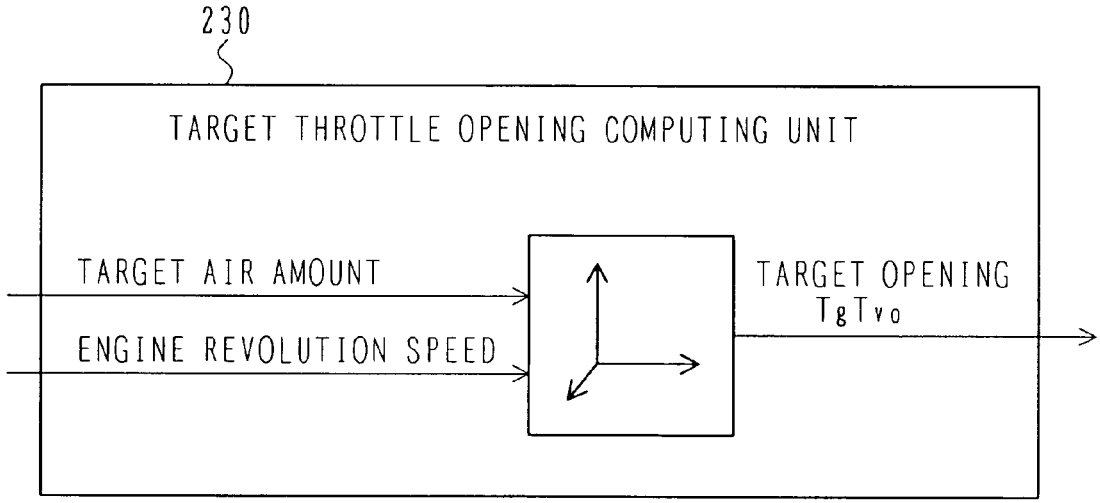
FIG. 39 is a block diagram for explaining a target throttle opening computing unit in the first embodiment.

<Target Throttle Opening Computing Unit 230 (FIG. 39)>

This computing unit 230 obtains a target throttle opening TgTvo by referring to a map based on the target air amount and the engine revolution speed. Map values are prepared as theoretical values or experimental values.

Figure 40:
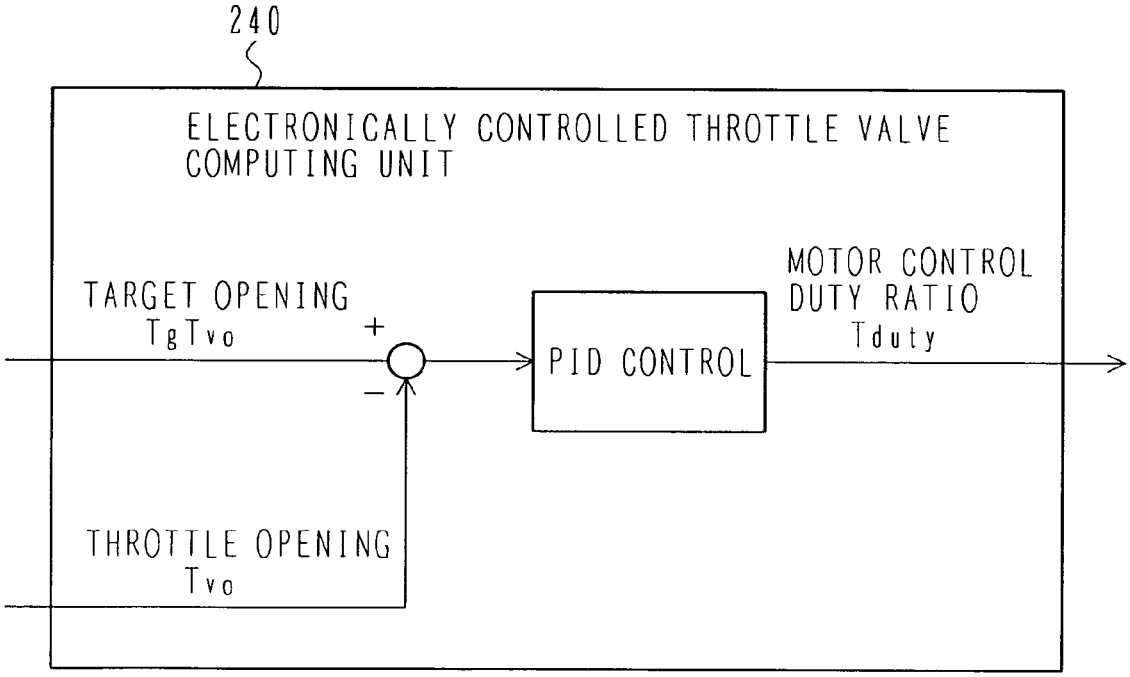
FIG. 40 is a block diagram for explaining an electronically controlled throttle control unit in the first embodiment.

<Electronically Controlled Throttle Valve Control Unit 240 (FIG. 40)>

This control unit 240 computes a throttle driving control input Tduty from the target throttle opening TgTvo and an actual throttle opening Tvo. Tduty represents the duty ratio of a PWM signal inputted to a drive circuit for controlling a throttle motor drive current. Here, Tduty is obtained through PID control. Though not explained in detail, respective gains in the PID control are preferably tuned to optimum values by using an actual engine.

<Target Ignition Timing Computing Unit 280 (FIG. 41)>

Figure 41:
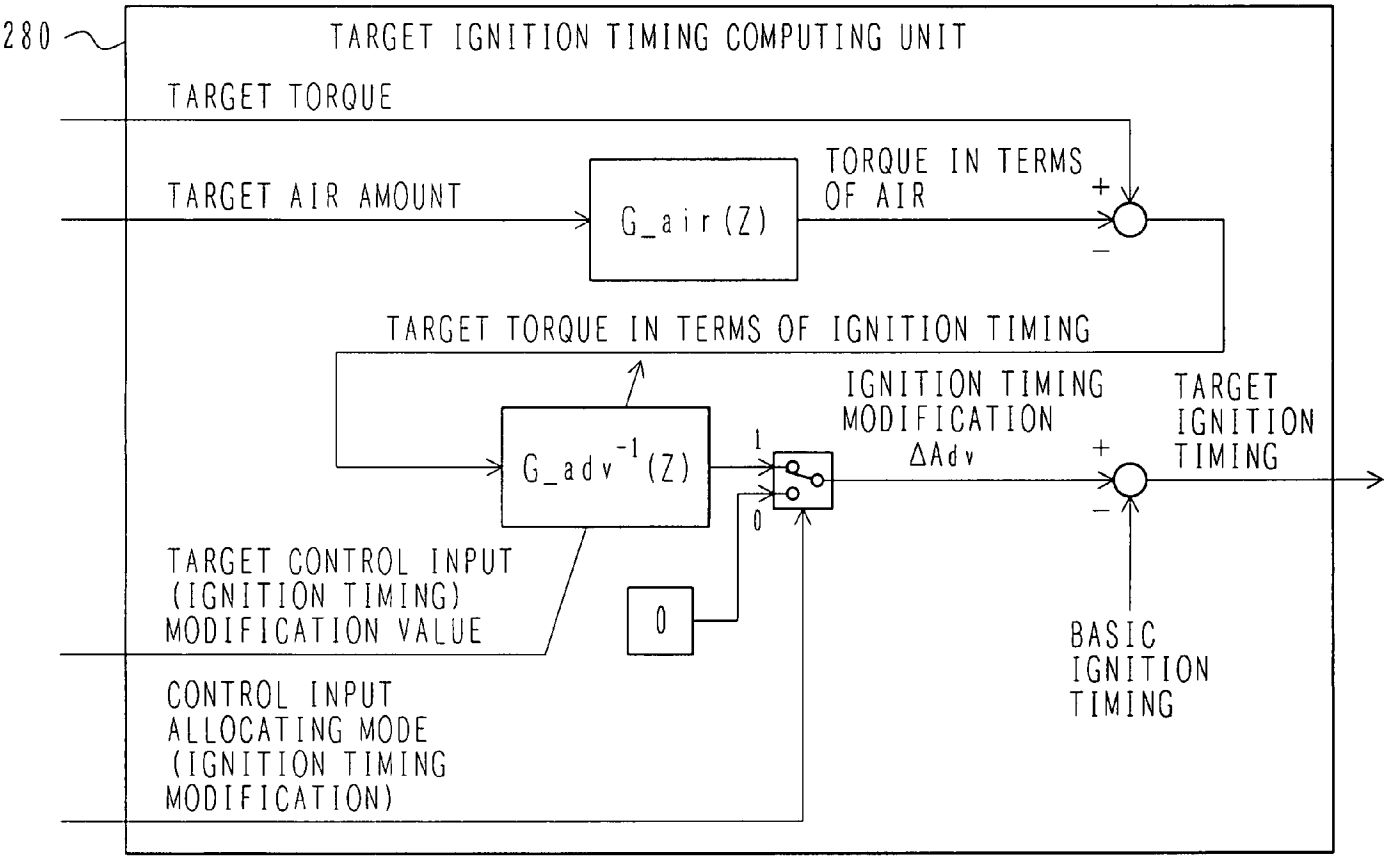
FIG. 41 is a block diagram for explaining a target ignition timing computing unit in the first embodiment.

This computing unit 280 computes target ignition timing for realizing the target torque. More specifically, as shown in FIG. 41, the target ignition timing is computed from the ignition-timing allocated target torque by using a transfer function $G_adv^{-1}(Z)$. The ignition-timing allocated target torque is given as the difference between the target torque and the air allocated torque to be generated based on air. The air allocated torque to be generated based on air is computed using the transfer characteristic G_air(Z), described above in connection with the target air amount computing unit 220, from the air amount near the throttle valve 25 to the engine axial torque.

Here, G_adv(Z) is defined as shown in FIG. 41 and represents a transfer characteristic from the ignition to the engine axial torque. In general, n≧m holds. Accordingly, $G_adv^{-1}(Z)$ represents an inverse transfer characteristic from the engine axial torque to the ignition. Note that a_adv1, a_adv2, . . . , a_advn, b_adv0, b_adv1, . . . , b_advm are preferably decided based on a physical model and experimental values. While a_adv1, a_adv2, . . . , a_advn, b_adv0, b_adv1, . . . , b_advm represent, as mentioned above, the transfer characteristics from the ignition to the engine axial torque, those parameters are subjected to online tuning, as appropriate, by using a later-described target control input (ignition timing modification component) modification value so that the desired torque track is realized. Further, whether to execute the torque control based on the ignition timing or not is determined depending on the control input allocating mode.

Incidentally, basic ignition timing shown in FIG. 41 is preferably MBT (Minimum advance for Best Torque), and torque is controlled using a deviation of the ignition timing from the MBT.

<Target Air/Fuel Ratio (Equivalence Ratio) Computing Unit 250 (FIG. 42)>

Figure 42:
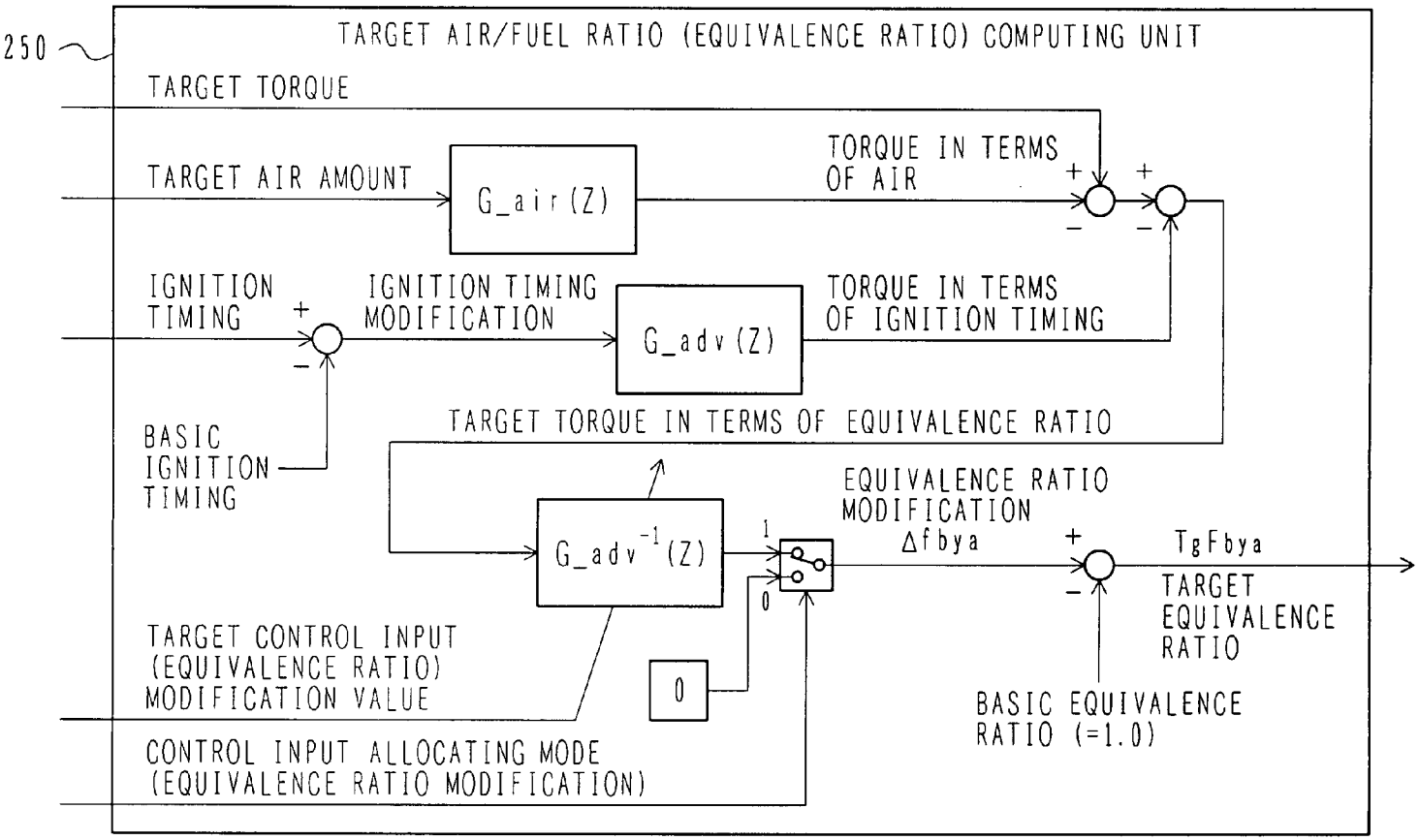
FIG. 42 is a block diagram for explaining a target air/fuel ratio (equivalence ratio) computing unit in the first embodiment.

This computing unit 250 computes a target equivalence ratio for realizing the target torque. More specifically, as shown in FIG. 42, the target equivalence ratio is computed from the equivalence-ratio allocated target torque by using a transfer function $G_af^{-1}(Z)$. The equivalence-ratio allocated target torque is given as the difference resulting by subtracting, from the target torque, both the air allocated torque to be generated based on air and the ignition-timing allocated torque to be generated based on the ignition timing modification component. The air allocated torque to be generated based on air is computed using the transfer characteristic G_air(Z), described above in connection with the target air amount computing unit 220, from the air amount near the throttle valve 25 to the engine axial torque. The ignition-timing modification component torque to be generated with the ignition timing control is computed using the transfer characteristic G_adv(Z), described above in connection with the target ignition timing computing unit 280, from the ignition to the engine axial torque.

Here, G_af(Z) is defined as shown in FIG. 42 and represents a transfer characteristic from the equivalence ratio, i.e., the fuel injection, to the engine axial torque. In general, n≧m holds. Accordingly, $G_af^{-1}(Z)$ represents an inverse transfer characteristic from the engine axial torque to the fuel injection. Note that a_af1, a_af2, . . . , a_afn, b_af0, b_af1, . . . , b_afm are preferably decided based on a physical model and experimental values. While a_af1, a_af2, . . . , a_afn, b_af0, b_af1, . . . , b_afm represent, as mentioned above, the transfer characteristics from the fuel injection to the engine axial torque, those parameters are subjected to online tuning, as appropriate, by using a later-described target control input (equivalence ratio modification component) modification value so that the desired torque track is realized. Further, whether to execute the torque control based on the equivalence ratio or not is determined depending on the control input allocating mode.

In addition, a basic equivalence ratio shown in FIG. 42 is preferably a stoichiometric (theoretical) air/fuel ratio, and the equivalence ratio at the stoichiometric air/fuel ratio is assumed to be 1.0. The torque is controlled in accordance with a deviation of the equivalence ratio from the stoichiometric air/fuel ratio.

<Actual Air Amount Computing Unit 260 (FIG. 43)>

Figure 43:
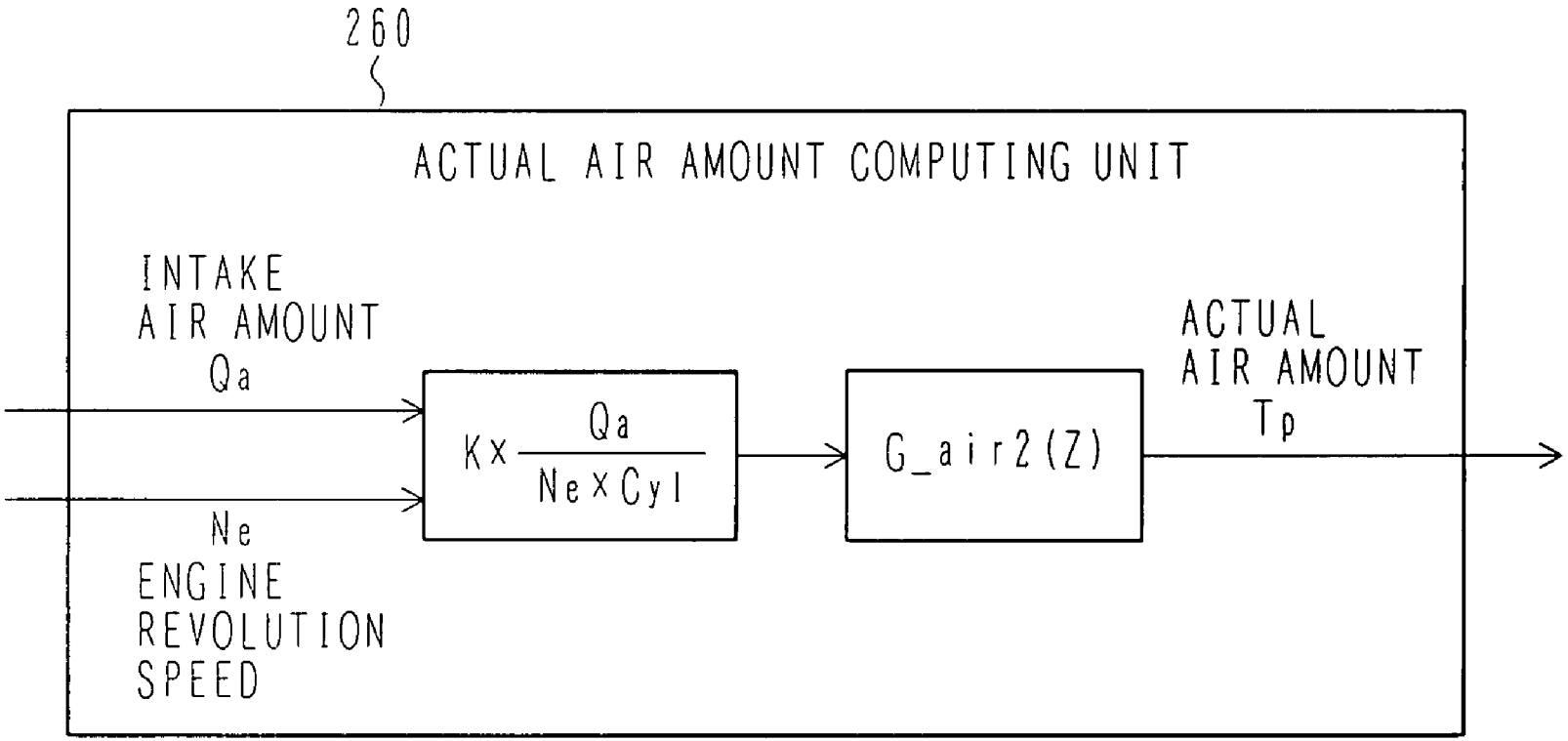
FIG. 43 is a block diagram for explaining an actual air amount computing unit in the first embodiment.

This computing unit 260 computes an actual air amount. For convenience, as shown in FIG. 43, the actual air amount is computed as a value that is normalized to an air amount flowing into one cylinder per cycle. In FIG. 43, Qa represents the air amount detected by the airflow sensor 24. K is decided so that Tp (actual air amount) is the fuel injection amount at the stoichiometric air/fuel ratio. Cly represents the number of cylinders of the engine. Further, the air amount in the cylinder is computed from the air amount near the throttle valve 25 (i.e., the air amount detected by the airflow sensor) by using a transfer function G_air2(Z). Parameter values of the transfer function G_air2(Z) are preferably decided based on a physical model and experimental values. Details are omitted here because there are many known examples, documents, etc.

Figure 44:
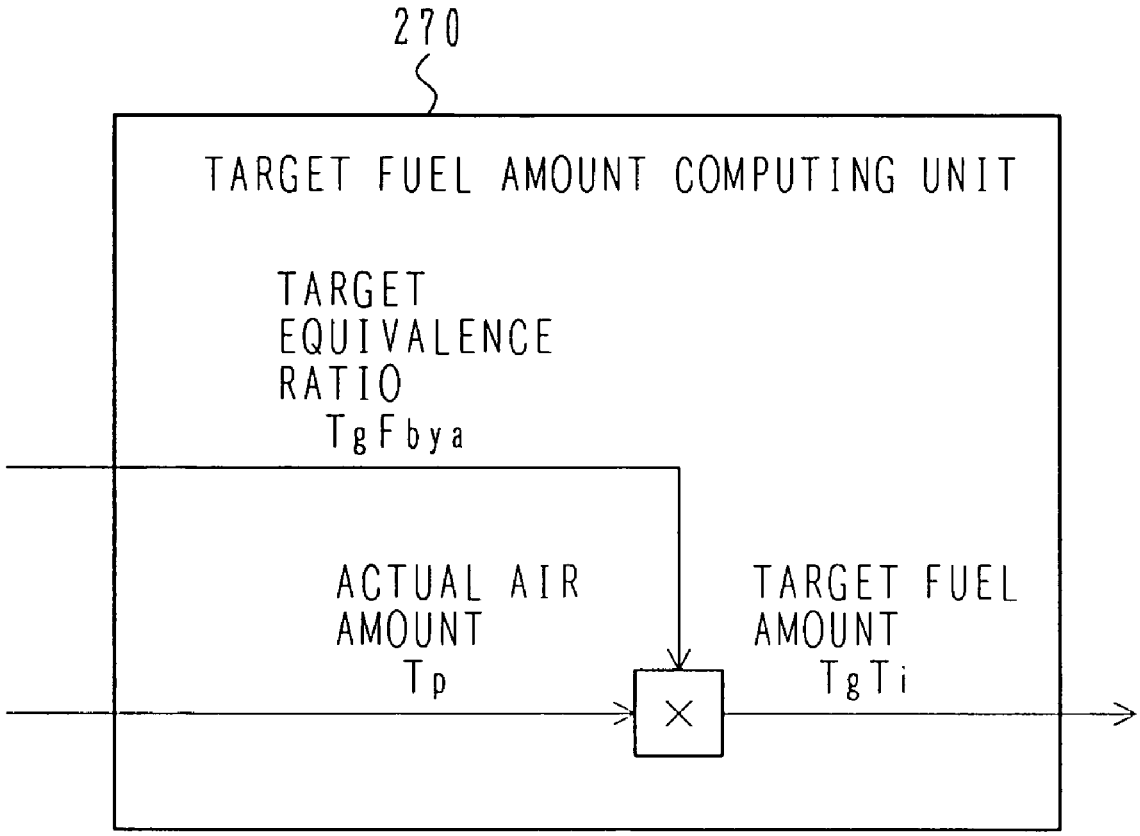
FIG. 44 is a block diagram for explaining a target fuel amount computing unit in the first embodiment.

<Target Fuel Injection Amount Computing Unit 270 (FIG. 44)>

This computing unit 270 computes a target fuel injection amount. The target fuel injection amount (TgTi) is obtained by multiplying the actual air amount Tp, which has been computed by the actual air amount computing unit 260, by the target equivalence ratio TgFbya, which has been computed by the target air/fuel ratio (equivalence ratio) computing unit 250.

<Target Control Input Modification-Value Computing Unit 310 (FIG. 45)>

In this computing unit 310, the parameters of the above-mentioned transfer functions G_air(Z), G_adv(Z) and G_af (Z) are subjected to online tuning by using the output signal of the torque sensor 33. More specifically, as shown in FIG. 45, the parameters of G_air(Z), i.e., a_air1, a_air2, . . . , a_airn, b_air0, b_air1, . . . , b_airm, are decided based on an identification mechanism 1 by using time-serial data of the air amount Qa(k) and time-serial data of the torque sensor output signal Tq(k).

Figure 45:
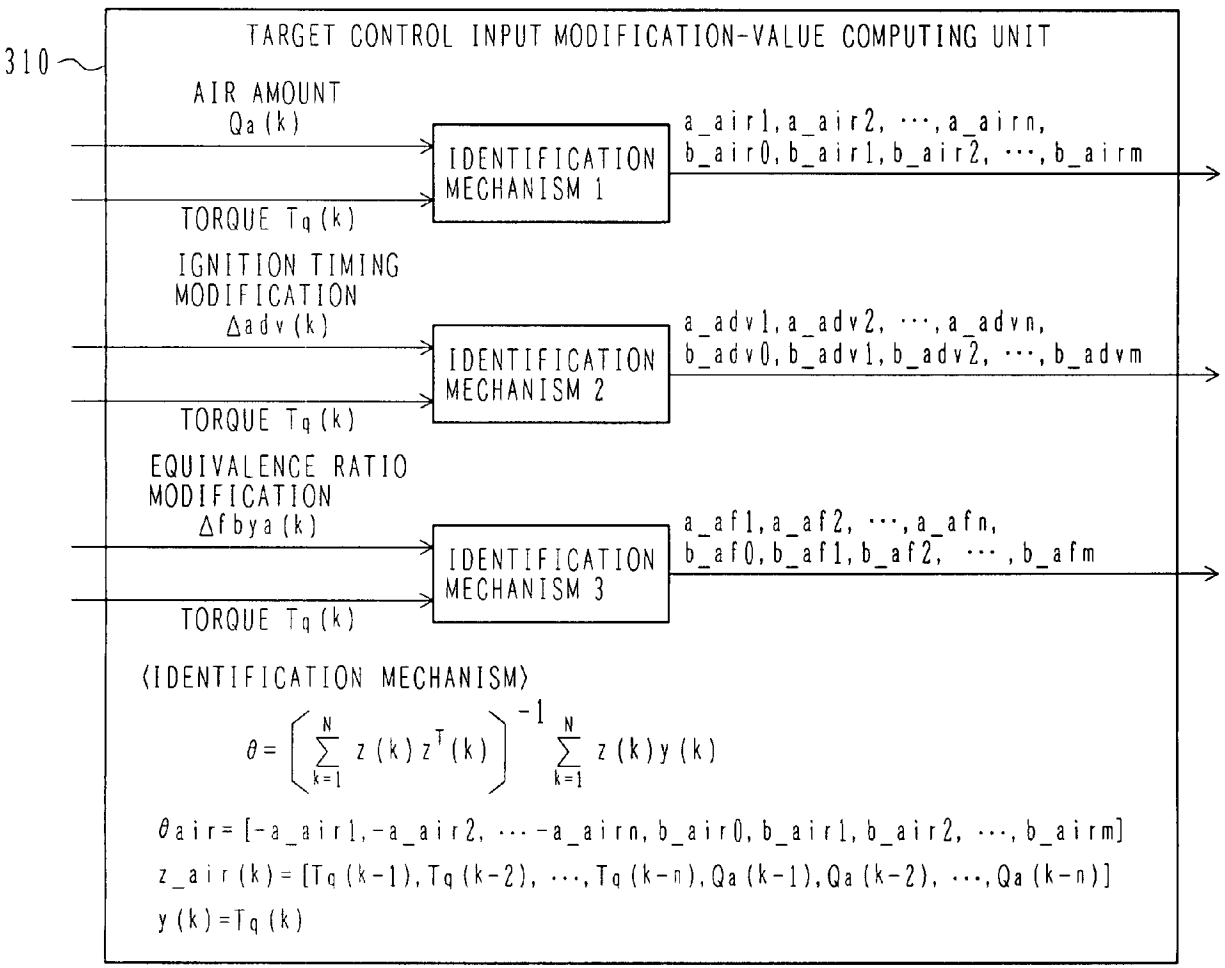
FIG. 45 is a block diagram for explaining a target control input modification-value computing unit in the first embodiment.

Detailed processing executed by the identification mechanism is as shown in FIG. 45. Specifically, the parameters of G_air(Z) are decided (using the least square method) such that a formula error between the estimated air-allocated torque, which is estimated from the air amount Qa(k) based on the model G_air(Z), and the actual torque Tq(k) is minimized. The least square method is preferably carried out as the sequential least square method. The sequential least square method is not described here because there are many known documents, published books, etc.

Similarly, the parameters of G_adv(Z) are decided (using the least square method) such that a formula error between the estimated ignition-timing modification component torque, which is estimated from an ignition timing modification Δadv (k) based on the model G_adv(Z), and the actual torque Tq(k) is minimized. Further, the parameters of G_af(Z) are decided (using the least square method) such that a formula error between the estimated equivalence-ratio modification component torque, which is estimated from an equivalence ratio modification Δfbya(k) based on the model G_af(Z), and the actual torque Tq(k) is minimized.

Note that, regarding the ignition timing modification and the equivalence ratio modification, the parameters may be identified using a torque change instead of an absolute value of the torque.

Second Embodiment

FIGS. 33, 34 and 35 having been referred to in the first embodiment are common to this second embodiment and a duplicate description of those drawings is omitted here. Also, the various units shown in FIG. 35, i.e., the target torque computing unit 210 (FIG. 36), the target air amount computing unit 220 (FIG. 38), the target throttle opening computing unit 230 (FIG. 39), the electronically controlled throttle valve control unit 240 (FIG. 40), the target air/fuel ratio (equivalence ratio) computing unit 250 (FIG. 42), the actual air amount computing unit 260 (FIG. 43), the target fuel injection amount computing unit 270 (FIG. 44), the target ignition timing computing unit 280 (FIG. 41), the target control input allocating unit 300 (FIG. 37), and the target control input modification-value computing unit 310 (FIG. 45), are the same in this second embodiment and are not described in detail here. This second embodiment uses a various torque computing unit 330, not shown in FIG. 35, which will be described below.

<Various Torque Computing Unit 330 (FIG. 46)>

Figure 46:
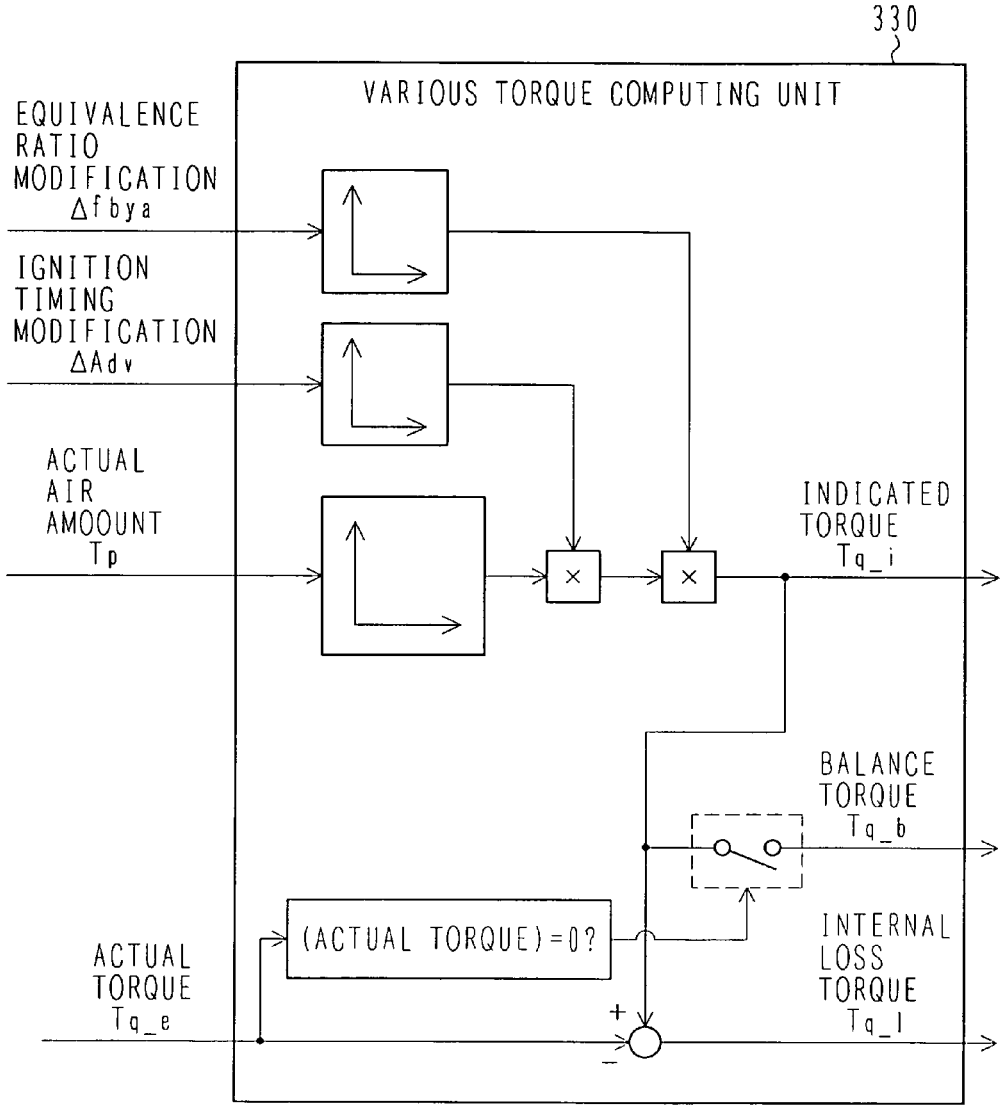
FIG. 46 is a block diagram for explaining a various torque computing unit in a second embodiment.

This computing unit 330 computes indicated torque, internal loss torque, and balance torque of the engine by using several sensors, such as the torque sensor 33. More specifically, as shown in FIG. 46, a value obtained by referring to a table based on the actual air amount Tp is multiplied by two values, which are obtained by referring to respective tables based on the ignition timing modification Δadv (computed as shown in FIG. 41) and the equivalence ratio modification Δfbya (computed as shown in FIG. 42), thus obtaining the indicated torque. This means that a basic value of the indicated torque is computed from the air amount (i.e., the stoichiometric-air/fuel-ratio equivalent fuel amount depending on the air amount), and the basic value is modified with a component corresponding to an ignition deviation (from the MBT) and a component corresponding to an equivalence ratio deviation (from the stoichiometric air/fuel ratio), thus obtaining the final indicated torque. Also, the difference between the indicated torque and the axial torque detected by the torque sensor 33 is taken as the internal loss torque. Further, the indicated torque resulting when the output of the torque sensor 33 is 0, i.e., when the axial torque is 0, is taken as the balance torque representing the state where the axial torque performs no work in the relevant operating condition.

Third Embodiment

Figure 47:
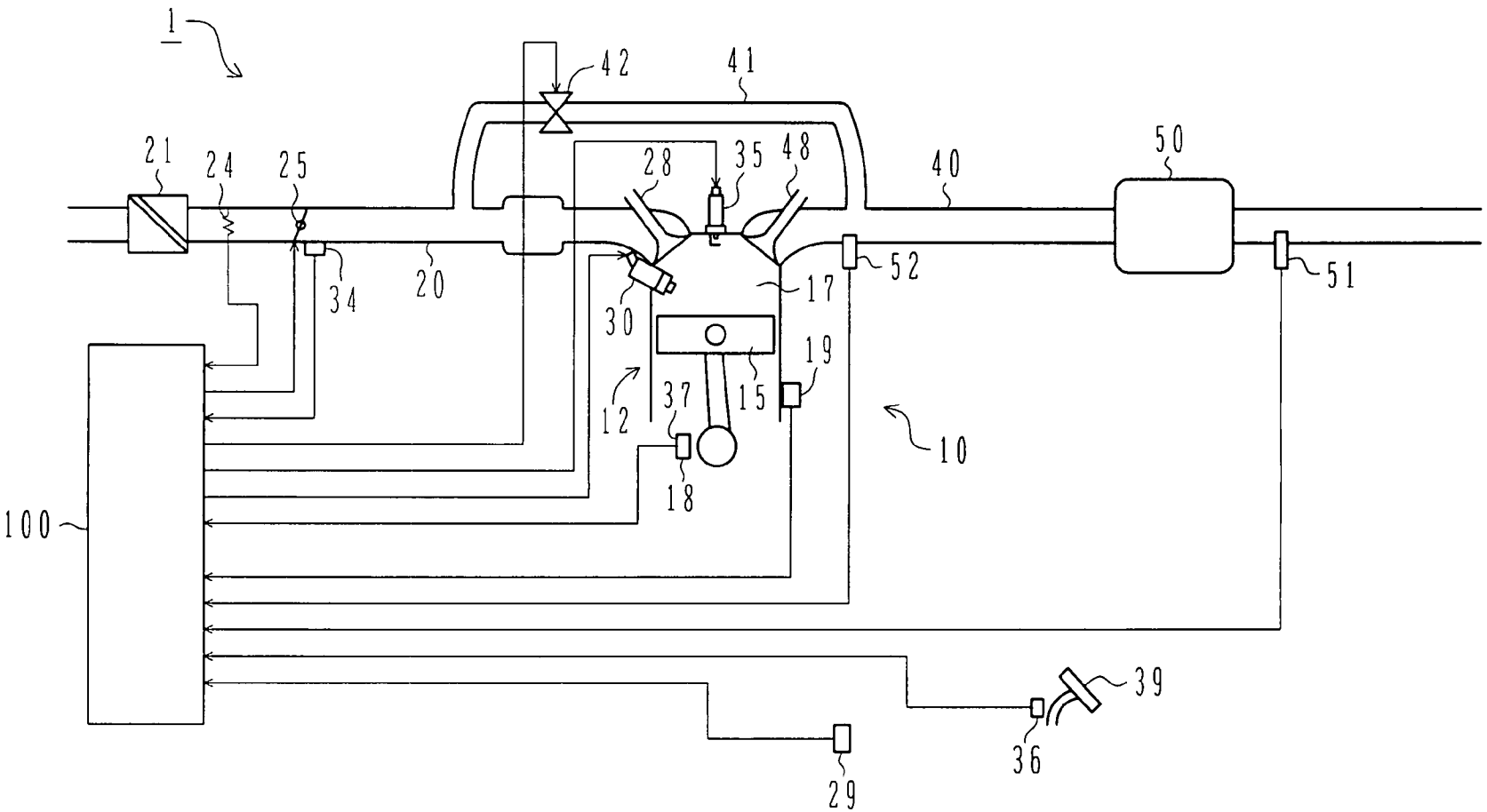
FIG. 47 is a schematic view showing an engine control system according to a third embodiment of the present invention along with an engine to which the engine control system is applied.
Figure 48:
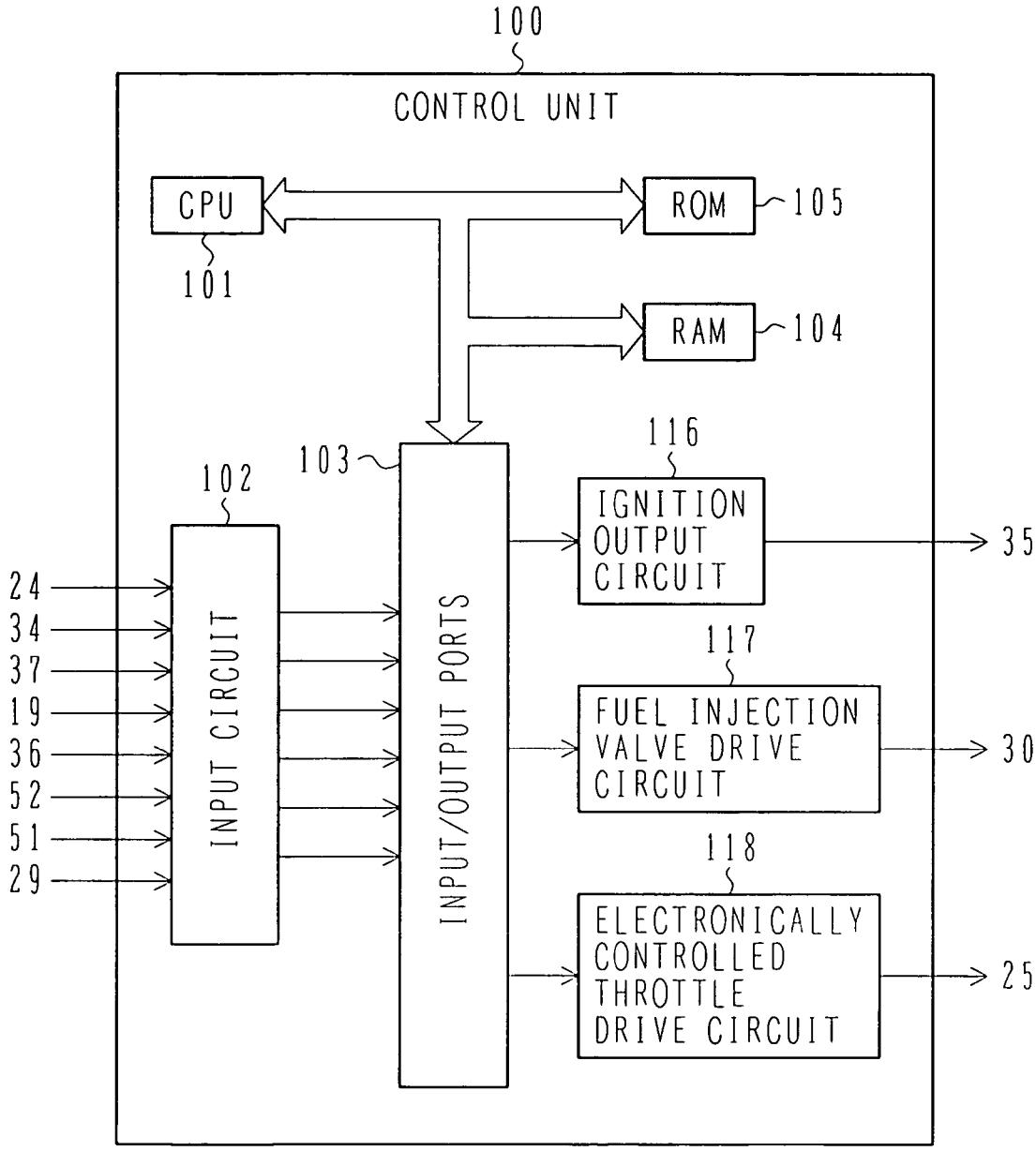
FIG. 48 is a block diagram showing the internal configuration of a control unit in the third embodiment.
Figure 49:
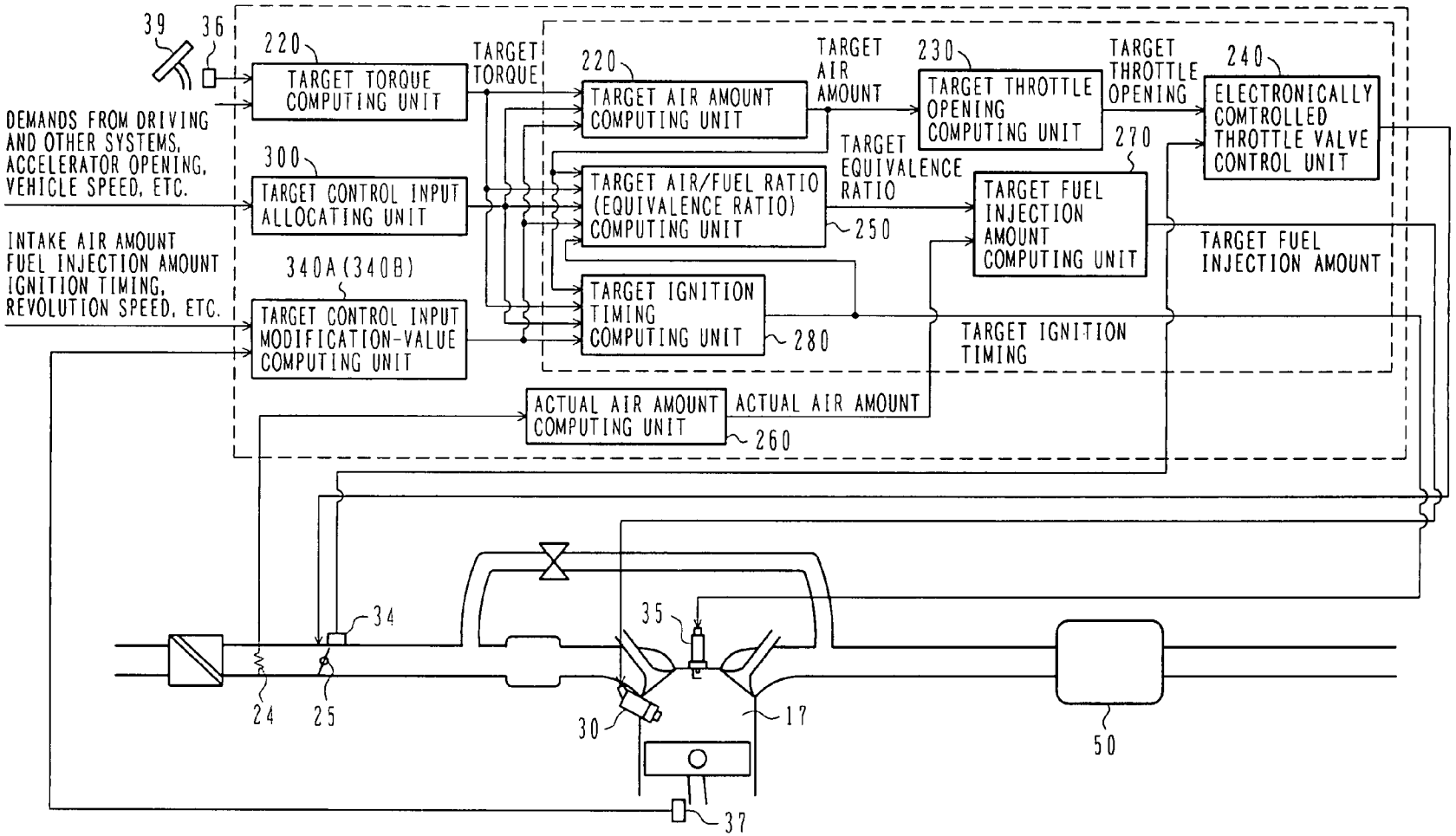
FIG. 49 is a block diagram showing a control system of the control unit in the third embodiment.

FIGS. 47, 48 and 49 schematically show an engine control system according to a third embodiment, the internal configuration of a control unit, and a control system of the control unit, and they correspond to FIGS. 33, 34 and 35 having been referred to in the first embodiment, respectively. This third embodiment differs from the first embodiment in that the torque sensor 33 is not disposed (FIG. 47), the signal from the torque sensor 33 is not inputted to the control unit 100 (FIG. 48), and a target control input modification-value computing unit 340 estimates engine axial torque from the signal from the crank angle sensor 37, which represents the engine revolution speed, instead of using the signal from the torque sensor 33 (FIG. 49). The various units shown in FIG. 35, i.e., the target torque computing unit 210 (FIG. 36), the target air amount computing unit 220 (FIG. 38), the target throttle opening computing unit 230 (FIG. 39), the electronically controlled throttle valve control unit 240 (FIG. 40), the target air/fuel ratio (equivalence ratio) computing unit 250 (FIG. 42), the actual air amount computing unit 260 (FIG. 43), the target fuel injection amount computing unit 270 (FIG. 44), the target ignition timing computing unit 280 (FIG. 41), and the target control input allocating unit 300 (FIG. 37), are the same in this third embodiment and are not described in detail here. Because this third embodiment differs from the first embodiment in processing executed by the target control input modification-value computing unit, the following description is made of target control input modification-value computing units 340A, 340B used in this third embodiment.

<Target Control Input Modification-Value Computing Unit 340A (without idling F/B) (FIG. 50)>

Figure 50:
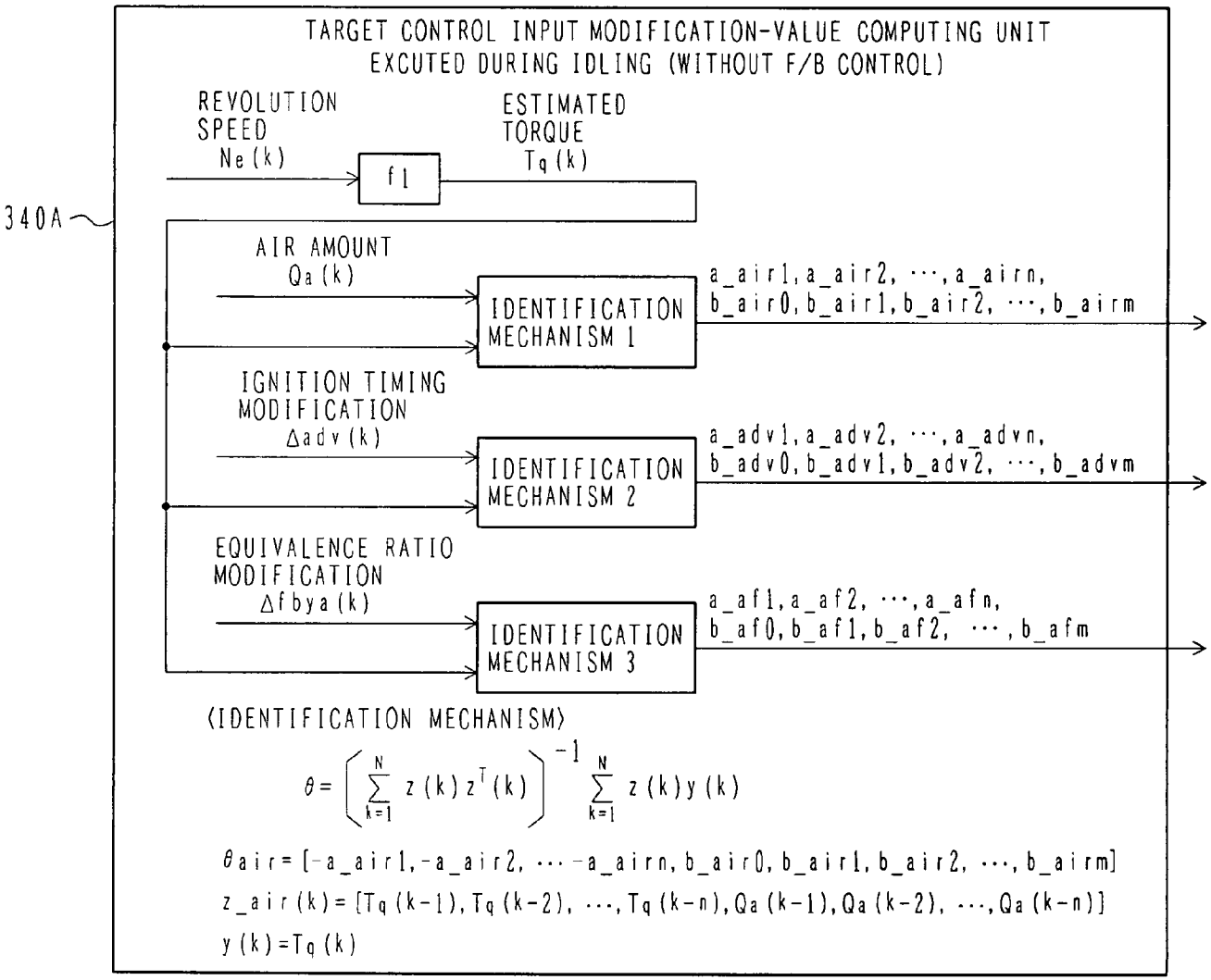
FIG. 50 is a block diagram for explaining a target control input modification-value computing unit (without idling F/B) in the third embodiment.

This computing unit 340A estimates a torque change amount from a change amount of the engine revolution speed resulting when the air amount, the ignition timing, and the air/fuel ratio are individually changed in the state under idling and without idling F/B control. More specifically, as shown in FIG. 50, when the air amount, for example, is changed during idling, the torque is increased and decreased and so is the revolution speed correspondingly in the case of the idling F/B control being not executed. This increase and decrease of the revolution speed are converted to torque. In other words, a transfer characteristic from the air amount to the revolution speed at that time is learned online, and the parameters of the transfer function G_air(Z) in the target air amount computing unit 220 (FIG. 38) are tuned based on the learning result. In this embodiment, since the transfer characteristic from the air amount to the axial torque is learned during idling, it is preferable that the transfer characteristic be used primarily during idling when the control input (target air amount) is computed. Also, regarding the ignition timing and the air/fuel ratio, similar transfer characteristics from those variables to the revolution speed change is learned by changing the ignition timing and the equivalence ratio during idling. In addition, it is known that the relationship between a deviation of the ignition timing and torque sensitivity hardly depends on the operating region. Therefore, the transfer characteristic from the ignition timing to the axial torque can also be applied to the state other than the idling in spite of the transfer characteristic having been learned during idling. Although a function f1 in FIG. 50 can be theoretically decided, it is preferably decided in consideration of experimental values as well because of the presence of friction.

<Target Control Input Modification-Value Computing Unit 340B (with idling F/B) (FIG. 51)>

Figure 51:
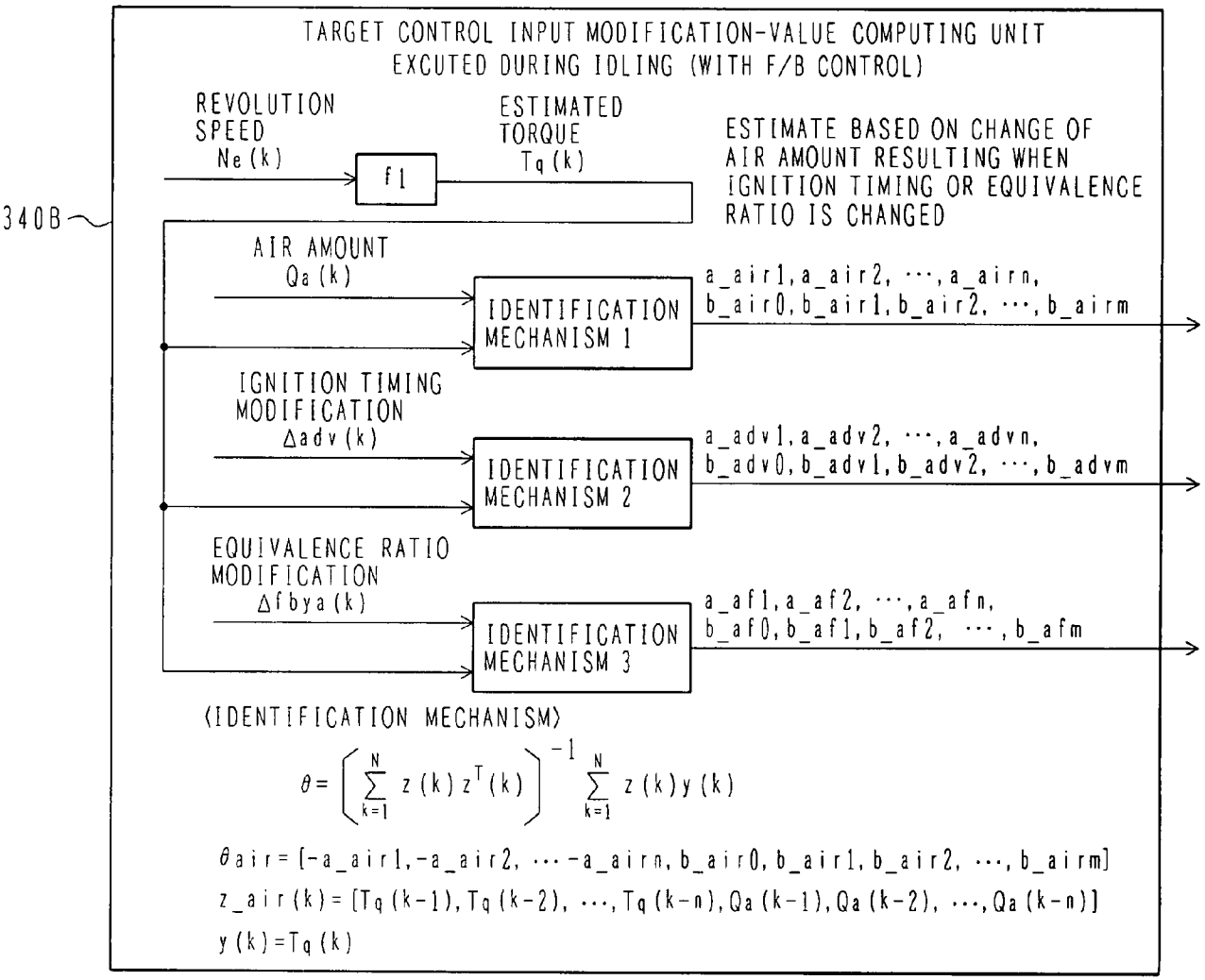
FIG. 51 is a block diagram for explaining a target control input modification-value computing unit (with idling F/B) in the third embodiment.

This computing unit 340B estimates a torque change amount from a change amount of the air amount resulting when the ignition timing and the air/fuel ratio, for example, are individually changed in the state under idling and with idling F/B control. More specifically, as shown in FIG. 51, when the ignition timing, for example, is changed during idling, the air amount is increased and decreased correspondingly so as to maintain the revolution speed, i.e., maintain the torque, in the case of the idling F/B control being executed. This increase and decrease of the air amount are converted to torque. The relationship between an ignition timing change component and a torque change component is learned, and the parameters of the transfer function G_adv(Z) in the target ignition timing computing unit 280 (FIG. 41) are tuned based on the learning result. In addition, it is known that the relationship between a deviation of the ignition timing and torque sensitivity hardly depends on the operating region. Therefore, the transfer characteristic from the ignition timing to the axial torque can also be applied to the state other than the idling in spite of the transfer characteristic having been learned during idling. Although a function f2 in FIG. 51 can be theoretically decided, it is preferably decided in consideration of experimental values as well because of the presence of friction.

As an alternative, the relationship between the air amount and the torque may be learned by executing the idling F/B control depending on only the ignition timing to change the air amount. This learning method is similarly applied to the equivalence ratio.

Fourth Embodiment

FIGS. 33, 34 and 35 having been referred to in the first embodiment are common to this fourth embodiment and a duplicate description of those drawings is omitted here. Also, the various units shown in FIG. 35, i.e., the target torque computing unit 210 (FIG. 36), the target air amount computing unit 220 (FIG. 38), the target throttle opening computing unit 230 (FIG. 39), the electronically controlled throttle valve control unit 240 (FIG. 40), the target air/fuel ratio (equivalence ratio) computing unit 250 (FIG. 42), the actual air amount computing unit 260 (FIG. 43), the target fuel injection amount computing unit 270 (FIG. 44), the target ignition timing computing unit 280 (FIG. 41), and the target control input allocating unit 300 (FIG. 37), are the same in this fourth embodiment and are not described in detail here. Because this fourth embodiment differs from the first embodiment in processing executed by the target control input modification-value computing unit, the following description is made of target control input modification-value computing unit 350 used in this fourth embodiment.

<Target Control Input Modification-Value Computing Unit 350 (FIG. 52)>

Figure 52:
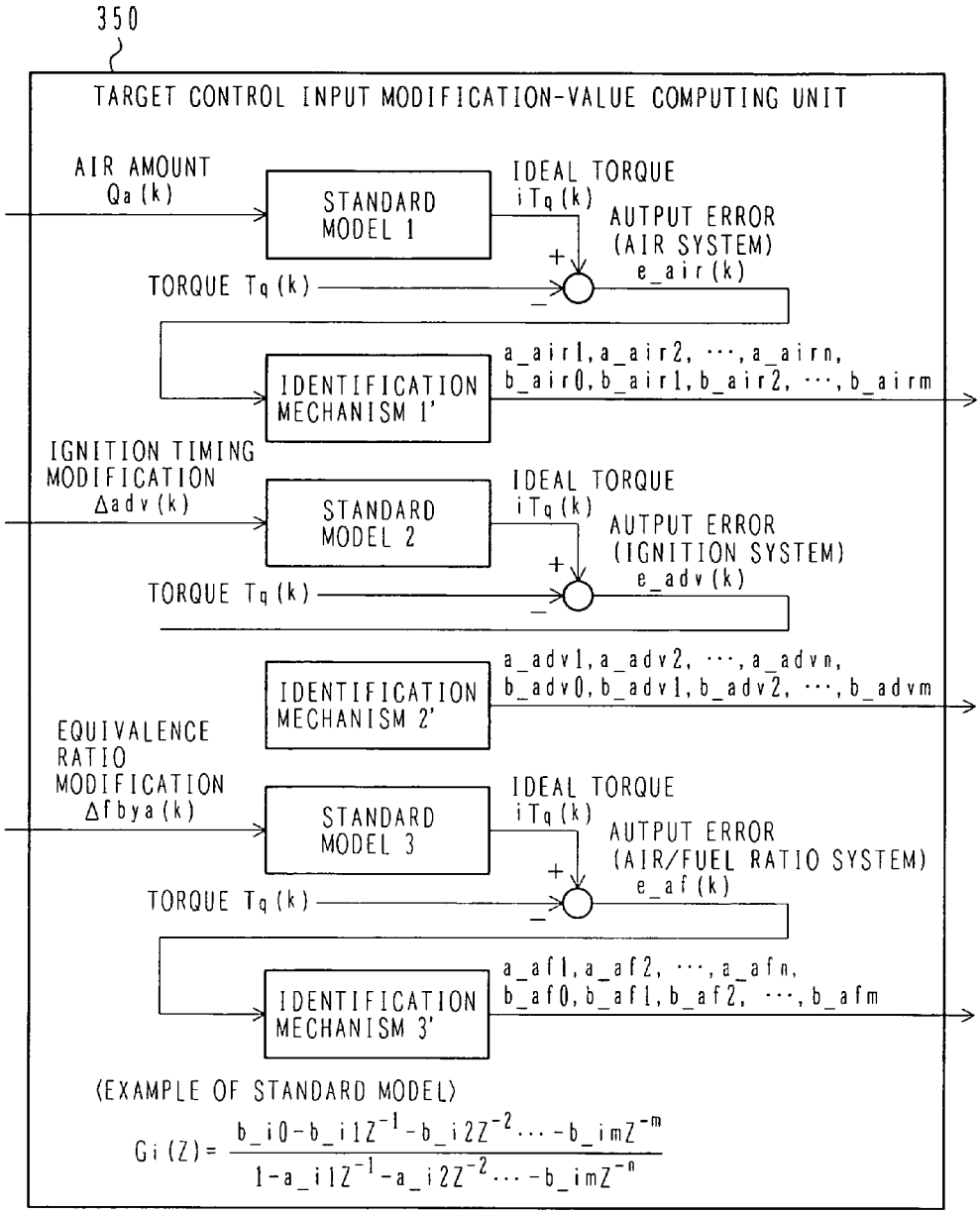
FIG. 52 is a block diagram for explaining a target control input modification-value computing unit in a fourth embodiment.

In this computing unit 350, the parameters of the above-mentioned transfer functions G_air(Z), G_adv(Z) and G_af (Z) are subjected to online tuning by using the output signal of the torque sensor 33. More specifically, as shown in FIG. 52, an ideal torque track for the air amount component is computed based on a standard model 1 with inputting of time-serial data of the air amount Qa(k), and the difference between the ideal torque track and the output signal of the torque sensor 30, i.e., an error e_air(k) from the ideal torque track, is computed. Then, the parameters of G_air(Z), i.e., a_air1, a_air2, . . . , a_airn, b_air0, b_air1, . . . , b_airm, are decided based on an identification mechanism 1' so that the error e_air(k) is minimized.

Detailed processing executed by the identification mechanism is not described in detail here because there are many documents and books regarding the linear search method, the nonlinear search method, etc.

Likewise, the parameters of G_adv(Z) are decided based on an identification mechanism 2' so that the difference between ideal torque of the ignition timing modification component, which is estimated from ignition timing modification Δadv(k) based on a standard model 2, and the output signal of the torque sensor 30 is minimized. Further, the parameters of G_af(Z) are decided based on an identification mechanism 3' so that the difference between ideal torque of the equivalence ratio modification component, which is estimated from equivalence ratio modification Δfbya(k) based on a standard model 3, and the output signal of the torque sensor 30 is minimized.

Note that, regarding the ignition timing modification and the equivalence ratio modification, the parameters may be identified using a torque change instead of an absolute value of the torque.

Fifth Embodiment

FIGS. 33, 34 and 35 having been referred to in the first embodiment are common to this fifth embodiment and a duplicate description of those drawings is omitted here. Also, the various units shown in FIG. 35, i.e., the target torque computing unit 210 (FIG. 36), the target air amount computing unit 220 (FIG. 38), the target throttle opening computing unit 230 (FIG. 39), the electronically controlled throttle valve control unit 240 (FIG. 40), the actual air amount computing unit 260 (FIG. 43), the target fuel injection amount computing unit 270 (FIG. 44), the target ignition timing computing unit 280 (FIG. 41), the target control input allocating unit 300 (FIG. 37), and the target control input modification-value computing unit 310, are the same in this fifth embodiment and are not described in detail here. Because this fifth embodiment differs from the first embodiment in processing executed by the target air/fuel ratio (equivalence ratio) computing unit, the following description is made of a target air/fuel ratio (equivalence ratio) computing unit 290 used in this fourth embodiment.

<Target Air Amount Ratio Computing Unit 290 (FIG. 53)>

Figure 53:
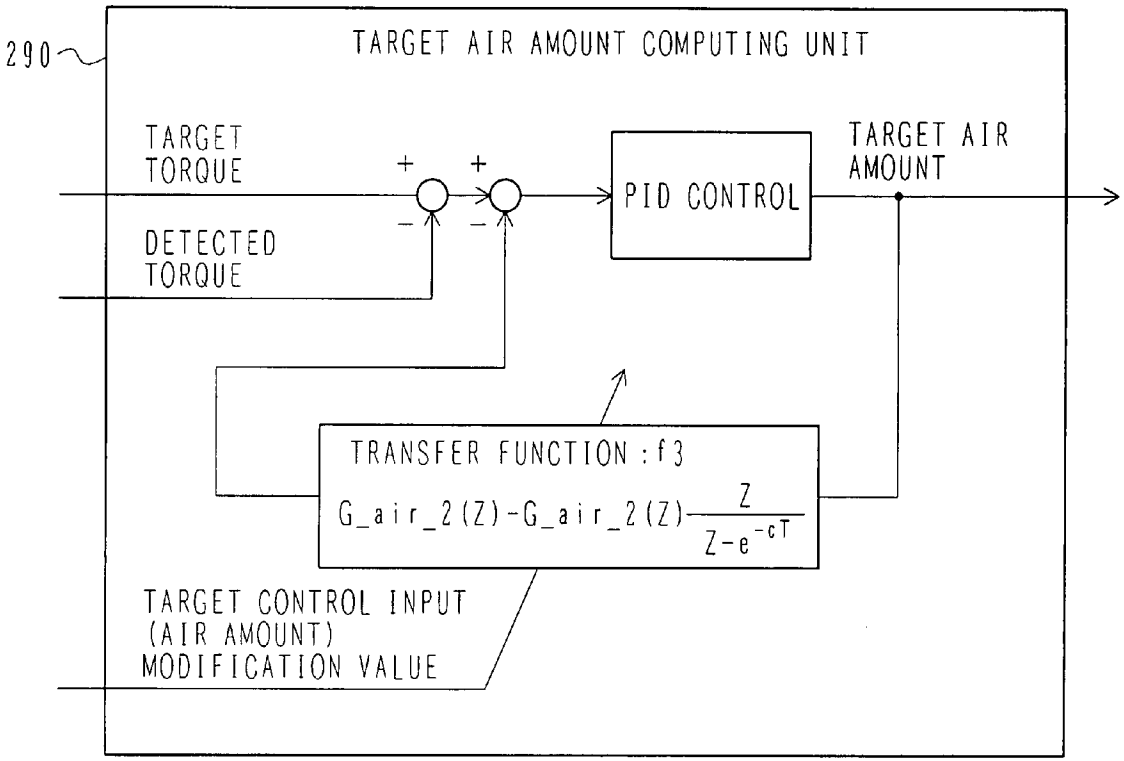
FIG. 53 is a block diagram for explaining a target air amount computing unit in a fifth embodiment.

This computing unit 290 computes a target air amount for realizing the target torque. More specifically, as shown in FIG. 53, the target air amount is computed from the difference between the target torque and the output of the torque sensor 33 (detected torque) through PI control. On that occasion, a minor loop is added as shown. The minor loop executes F/B control of the target air amount through a transfer function f3 such that a F/B component is further subtracted from the difference between the target torque and the output of the torque sensor 33 (detected torque). Here, G_air_2(Z)·(Z/(Z-exp(-cT))) represents a transfer characteristic from the air amount to the torque. Such a manner of constructing a true inner loop in addition to PI control is known as compensation of dead time with the Smith method and is effective in compensating for a shortcoming caused when the PI control is applied to a dead time system.

While a2_air1, a2_air2, . . . , a2_airn, b2_air0, b2_air1, . . . , b2_airm represent, as mentioned above, the transfer characteristics from the air amount near the throttle valve 25 to the axial torque, those parameters are subjected to online tuning, as appropriate, by using the above-described target control input (air amount) modification value so that the desired torque track is realized.

Sixth Embodiment

FIGS. 33, 34 and 35 having been referred to in the first embodiment are common to this sixth embodiment and a duplicate description of those drawings is omitted here. Also, the various units shown in FIG. 35, i.e., the target torque computing unit 210 (FIG. 36), the target air amount computing unit 220 (FIG. 38), the target throttle opening computing unit 230 (FIG. 39), the electronically controlled throttle valve control unit 240 (FIG. 40), the target air/fuel ratio (equivalence ratio) computing unit 250 (FIG. 42), the actual air amount computing unit 260 (FIG. 43), the target fuel injection amount computing unit 270 (FIG. 44), the target ignition timing computing unit 280 (FIG. 41), the target control input allocating unit 300 (FIG. 37), and the target control input modification-value computing unit 310 (FIG. 45), are the same in this sixth embodiment and are not described in detail here. This sixth embodiment uses an efficiency (fuel consumption) computing unit 360, not shown in FIG. 35, which will be described below.

<Efficiency (Fuel Consumption) Computing Unit 360 (FIG. 54)>

Figure 54:
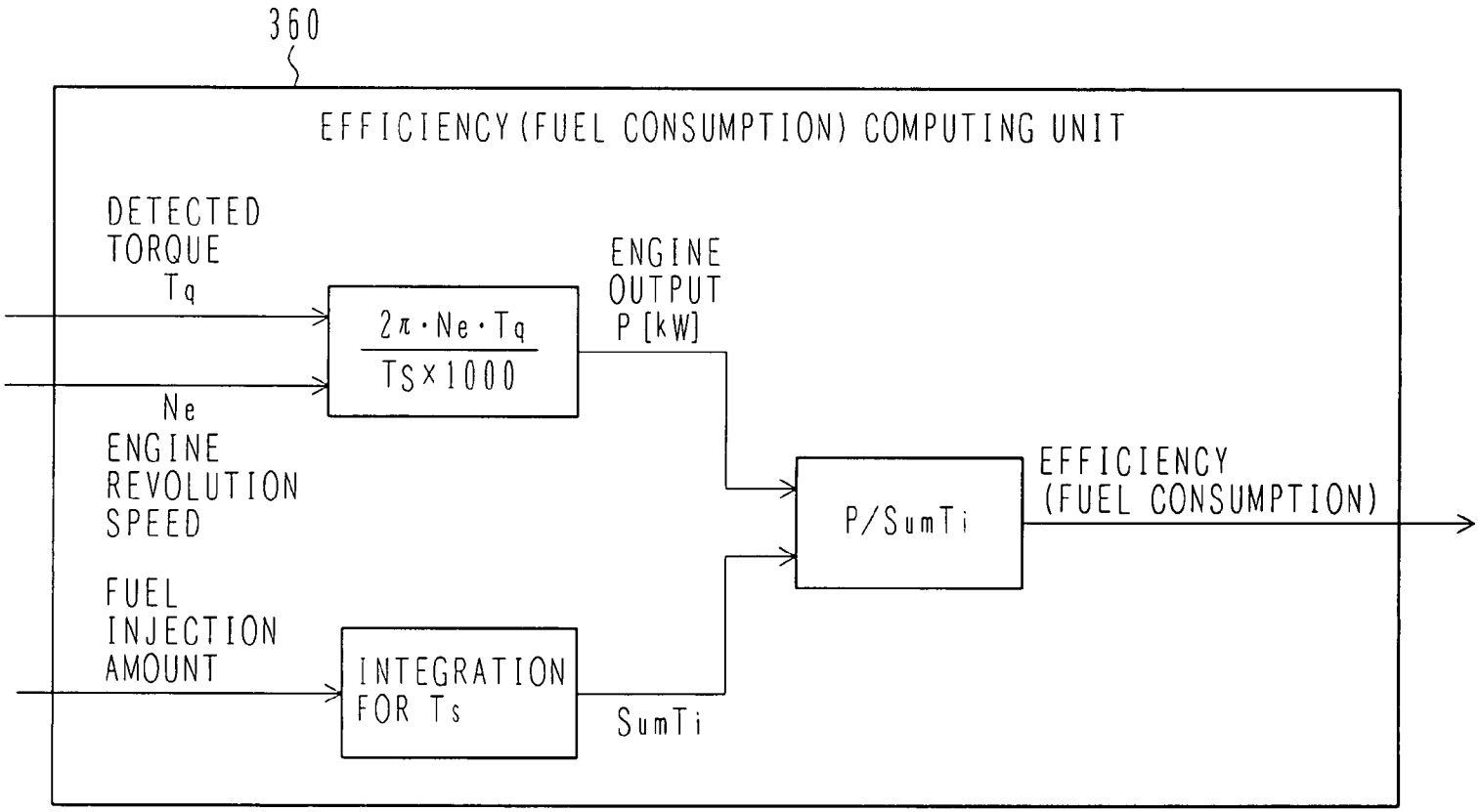
FIG. 54 is a block diagram for explaining an efficiency (fuel consumption) computing unit in the sixth embodiment.

This computing unit 360 computes efficiency (fuel consumption) of the engine by using the axial torque (i.e., the output signal of the torque sensor 33). More specifically, as shown in FIG. 54, an engine output P [kw] per predetermined period Ts is computed from the detected torque, i.e., the output of the torque sensor 33, and the engine revolution speed based on a formula shown in FIG. 54. The engine efficiency is obtained by dividing the engine output P [kw] by a total fuel injection amount sumTi per the predetermined period Ts.

What is claimed is:

1. An engine control system comprising:

means for detecting engine torque in at least one of direct and indirect manners;

means for computing an engine control parameter;

means for modifying said engine control parameter based on the detected torque detected by said engine torque detecting means;

means for estimating engine torque;

means for computing said engine control parameter based on the estimated torque estimated by said engine torque estimating means; and means for modifying said engine control parameter and/or a parameter of said engine torque estimating means based on the detected torque.

2. The engine control system according to claim 1, wherein said engine torque detecting means detects axial torque of an engine.

3. The engine control system according to claim 1, wherein said engine torque detecting means is constituted as a torque sensor.

4. The engine control system according to claim 1, wherein said engine torque detecting means indirectly detects the engine torque based on at least one of a fuel injection amount, an intake air amount, and ignition timing.

5. The engine control system according to claim 1, wherein said engine torque detecting means indirectly detects the engine torque based on at least one of a fuel injection amount, an intake air amount, ignition timing, and an engine revolution speed.

6. The engine control system according to claim 5, wherein said engine torque detecting means indirectly detects the engine torque based on the engine revolution speed during idling.

7. The engine control system according to claim 1, wherein said engine torque detecting means detects indicated torque of an engine.

8. The engine control system according to claim 7, wherein said engine torque detecting means indirectly detects the indicated torque of said engine based on at least one of a fuel injection amount, an intake air amount, and ignition timing.

9. The engine control system according to claim 1, wherein said engine torque detecting means detects indicated torque and axial torque of an engine.

10. The engine control system according to claim 9, further comprising internal loss torque estimating means for estimating internal loss torque based on a difference between the indicated torque and the axial torque of said engine.

11. The engine control system according to claim 9, further comprising torque setting means for setting the indicated torque resulting when the axial torque is 0, as balance torque representing a state where the axial torque performs no work under the relevant operating conditions.

12. The engine control system according to claim 1, wherein said engine torque estimating means includes a transfer characteristic model from at least one of a fuel injection amount, an intake air amount, ignition timing, and an air/fuel ratio to indicated torque anchor axial torque of an engine.

13. The engine control system according to claim 12, wherein said engine torque estimating means includes a transfer characteristic model from the intake air amount to the torque under a condition of the air/fuel ratio being constant.

14. The engine control system according to claim 12, wherein said engine torque estimating means includes a transfer characteristic model up to the torque when the air/fuel ratio is changed.

15. The engine control system according to claim 14, wherein said means for modifying the parameter of said engine torque estimating means computes a relationship between the air/fuel ratio and torque sensitivity from a torque change amount with respect to an air/fuel ratio change amount, and modifies the transfer characteristic up to the torque when the ignition timing is changed.

16. The engine control system according to claim 12, wherein said engine torque estimating means includes a transfer characteristic model up to the torque when the air/fuel ratio is changed with the air intake amount.

17. The engine control system according to claim 12, wherein said engine torque estimating means includes a transfer characteristic model up to the torque when the air/fuel ratio is changed with fuel.

18. The engine control system according to claim 12, wherein said engine torque estimating means includes a transfer characteristic model up to the torque when the ignition timing is changed.

19. The engine control system according to claim 18, wherein said means for modifying the parameter of said engine torque estimating means computes a relationship between the ignition timing and torque sensitivity from a torque change amount with respect to an ignition timing change amount, and modifies the transfer characteristic up to the torque when the ignition timing is changed.

20. The engine control system according to claim 18, wherein said means for modifying the parameter of said engine torque estimating means computes a relationship between the ignition timing and torque sensitivity from an intake air change amount with respect to an ignition timing change amount during idling, and modifies the transfer characteristic up to the torque when the ignition timing is changed.

21. The engine control system according to claim 20, wherein the transfer characteristic up to the torque when the ignition timing is changed, which has been modified during idling, is applied to a state other than the idling.

22. The engine control system according to claim 12, wherein said transfer characteristic model is expressed by a transfer function.

23. The engine control system according to claim 22, wherein said means for modifying the parameter of said engine torque estimating means modifies a parameter of said transfer function.

24. The engine control system according to claim 1 wherein said means for modifying the parameter of said engine torque estimating means modifies the parameter of said engine torque estimating means based on the estimated torque estimated by said engine torque estimating means and the detected torque detected by said engine torque detecting means.

25. The engine control system according to claim 24, wherein said means for modifying the parameter of said engine torque estimating means modifies the parameter such that a difference between the estimated torque estimated by said engine torque estimating means and the detected torque detected by said engine torque detecting means is reduced.

26. The engine control system according to claim 1, wherein said means for computing the engine control parameter computes the engine control parameter based on the estimated torque estimated by said engine torque estimating means and the detected torque detected by said engine torque detecting means.

27. The engine control system according to claim 1, wherein said means for computing the engine control parameter computes the engine control parameter such that a difference between the estimated torque estimated by said engine torque estimating means and the detected torque detected by said engine torque detecting means is reduced.

28. The engine control system according to claim 1, further comprising target engine torque computing means for computing target torque, wherein said means for computing the engine control parameter computes the engine control parameter based on the estimated torque estimated by said engine torque estimating means and the target torque.

29. The engine control system according to claim 28, wherein the engine control parameter are modified based on the estimated torque estimated by said engine torque estimating means and the detected torque detected by said engine torque detecting means.

30. The engine control system according to claim 28, wherein said means for computing the engine control parameter computes the engine control parameter such that a difference between the estimated torque estimated by said engine torque estimating means and the target torque is reduced.

31. The engine control system according to claim 28, wherein said target engine torque computing means computes the target torque based on an accelerator opening and/or torque demanded from a driving system.

32. The engine control system according to claim 1, wherein said means for computing the engine control parameter includes an inverse transfer characteristic model from the engine torque to at least one of a fuel injection amount, an intake air amount, and ignition timing, and computes, based on the inverse transfer characteristic model, at least one of a target fuel injection amount, a target intake air amount, and target ignition timing for realizing the target torque.

33. The engine control system according to claim 32, wherein said means for computing the engine control parameter includes the inverse transfer characteristic model from the engine torque to at least one of the fuel injection amount, the intake air amount, and the ignition timing, and modifies a parameter of said inverse transfer characteristic model based on the estimated torque estimated by said engine torque estimating means and the detected torque detected by said engine torque detecting means.

34. The engine control system according to claim 33, wherein said means for computing the engine control parameter includes the inverse transfer characteristic model from the engine torque to at least one of the fuel injection amount, the intake air amount, and the ignition timing, and modifies a parameter of said inverse transfer characteristic model such that a difference between the estimated torque estimated by said engine torque estimating means and the detected torque detected by said engine torque detecting means is reduced.

35. The engine control system according to claim 32, wherein said means for computing the engine control parameter includes the inverse transfer characteristic model from the engine torque to at least one of the fuel injection amount, the intake air amount, and the ignition timing, and modifies a parameter of said inverse transfer characteristic model based on the target torque and the detected torque detected by said engine torque detecting means.

36. The engine control system according to claim 35, wherein said means for computing the engine control parameter includes the inverse transfer characteristic model from the engine torque to at least one of the fuel injection amount, the intake air amount, and the ignition timing, and modifies a parameter of said inverse transfer characteristic model such that a difference between the target torque and the detected torque detected by said engine torque detecting means is reduced.

37. The engine control system according to claim 1, further comprising means for computing efficiency and/or fuel consumption of an engine based on a fuel injection amount and the detected torque.

38. The engine control system according to claim 37, wherein said means for computing efficiency and/or fuel consumption computes an engine output from the detected axial torque and an engine revolution speed during a predetermined period, computes a total fuel supply amount during the predetermined period, and computes the efficiency and/or the fuel consumption based on a relationship between said engine output and said total fuel supply amount.

39. An automobile equipped with an engine to which an engine control system according to claim 1 is applied.

40. An engine control system comprising:

an engine torque detecting unit for detecting engine torque in at least one of direct and indirect manners;

a computing unit for computing an engine control parameter;

a modifying unit for modifying said engine control parameter based on the detected torque detected by said engine torque detecting unit;

an estimating unit for estimating engine torque;

a computing unit for computing said engine control parameter based on the estimated torque estimated by said engine torque estimating unit; and a modifying unit for modifying said engine control parameter and/or a parameter of said engine torque estimating unit based on the detected torque.

* * * * *